US007396641B2

(12) United States Patent
Fukui

(10) Patent No.: US 7,396,641 B2
(45) Date of Patent: Jul. 8, 2008

(54) BLACK AND WHITE PHOTOTHERMOGRAPHIC MATERIAL

(75) Inventor: Kouta Fukui, Minami-Ashigara (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 11/898,748

(22) Filed: Sep. 14, 2007

(65) Prior Publication Data

US 2008/0076078 A1 Mar. 27, 2008

(30) Foreign Application Priority Data

Sep. 27, 2006 (JP) ..... 2006-263432

(51) Int. Cl.
*G03C 1/00* (2006.01)

(52) U.S. Cl. ..... 430/617; 430/618; 430/619; 430/620; 430/964

(58) Field of Classification Search ..... 430/617–620, 430/964

See application file for complete search history.

(56) References Cited

U.S. PATENT DOCUMENTS

2007/0003882 A9* 1/2007 Fukui ..... 430/350

FOREIGN PATENT DOCUMENTS

| | | |
|---|---|---|
| JP | A 2001-92075 | 4/2001 |
| JP | A 2001-312026 | 11/2001 |
| JP | A 2001-330925 | 11/2001 |
| JP | A 2002-49123 | 2/2002 |

* cited by examiner

*Primary Examiner*—Geraldina Visconti
(74) *Attorney, Agent, or Firm*—Margaret A. Burke; Sheldon J. Moss

(57) ABSTRACT

The present invention provides a black and white photothermographic material having, on at least one side of a support, at least a photosensitive silver halide, a non-photosensitive organic silver salt, and a reducing agent for silver ions, wherein the reducing agent for silver ions is a compound represented by the following formula (PP) and having a molecular weight of from 450 to 3000, and the black and white photothermographic material further comprises a compound represented by the following formula (II).

Formula (PP)

Formula (II)

22 Claims, No Drawings

BLACK AND WHITE PHOTOTHERMOGRAPHIC MATERIAL

CROSS-REFERENCE TO RELATED APPLICATIONS

This application claims priority under 35 USC 119 from Japanese Patent Application No. 2006-263432, the disclosure of which is incorporated by reference herein.

BACKGROUND OF THE INVENTION

1. Field of the Invention

The present invention relates to a black and white photothermographic material. More particularly, the invention relates to a black and white photothermographic material which exhibits excellent image tone, excellent raw stock storage stability, and excellent image storage stability.

2. Description of the Related Art

In recent years, in the field of films for medical diagnosis and in the field of films for graphic arts, there has been a strong desire for decreasing the amount of processing liquid waste from the viewpoints of protecting the environment and economy of space. For this reason, technology regarding thermal developing image recording materials for medical diagnosis and for graphic arts, which can be exposed effectively by laser image setters or laser imagers and thermally developed to obtain clear black-toned images of high resolution and sharpness, is required. The thermal developing image recording materials do not require liquid processing chemicals and can therefore be supplied to customers as a simpler and environmentally friendly thermal processing system.

Thermal image forming systems utilizing organic silver salts are described, for example, in the specifications of U.S. Pat. Nos. 3,152,904 and 3,457,075 and in "Thermally Processed Silver Systems" by D. Klosterboer, appearing in "Imaging Processes and Materials", Neblette, 8th edition, edited by J. Sturge, V. Walworth, and A. Shepp, Chapter 9, pages 279 to 291, 1989. All patents, patent publications, and non-patent literature cited in this specification are hereby expressly incorporated by reference herein. In particular, photothermographic materials generally have an image forming layer in which a photosensitive compound (for example, silver halide), a reducing agent, a reducible silver salt (for example, an organic silver salt), and if necessary, a toner for controlling the color tone of developed silver images are dispersed in a binder. Photothermographic materials form black silver images by being heated to a high temperature (for example, 80° C. or higher) after imagewise exposure to cause an oxidation-reduction reaction between a reducible silver salt (functioning as an oxidizing agent) and a reducing agent. The oxidation-reduction reaction is accelerated by the catalytic action of a latent image on the silver halide generated by exposure. As a result, a black silver image is formed in the exposed region.

The photothermographic materials utilizing an organic silver salt have an advantageous characteristic of containing all components necessary for image formation in the film in advance and being capable of forming images only by heating. However, on the other hand, the photothermographic material has a problem in that it is difficult to attain high sensitivity due to generation of fog. In addition, the photothermographic material has a problem relating to storage stability in which, for example, sensitivity changes or fog increases during storage thereof. Moreover, because photosensitive silver halide grains remain in the material after image formation, there are serious problems in that film turbidity becomes high due to light absorption and light scattering, and fog increases during placement of the images under light conditions, which is called print-out.

As a reducing agent in the photothermographic material utilizing an organic silver salt, an o-bisphenol derivative is disclosed in Japanese Patent Application Laid-Open (JP-A) No. 2001-92075.

On the other hand, JP-A Nos. 2001-312026, 2003-215767, and 2003-215764, and U.S. Pat. No. 6,242,166 disclose photothermographic materials containing a color developing agent and a coupler. These materials use photosensitive silver halides such as silver chloride, silver bromide, silver chlorobromide, silver iodobromide, or silver iodochlorobromide. Because light scattering and light absorption due to the silver halide increase turbidity and opacity of the film, fogging becomes extremely high and is as high as 0.58 to 1.2 as described in the Examples of the above specifications. Accordingly, as described in JP-A Nos. 2003-215767 and 2003-215764, the obtained image is a primary image and is not an image for being directly viewed, and accordingly, the image is digitalized, and image processing is performed to reduce fogging and adjust gradation and color tone, whereby it is attempted to form a reprocessed image which can be provided for viewing.

The use of sulfonamido phenols as color developing agents is known. For example, JP-A Nos. 2001-330923, 2001-330925, and 2002-49123 disclose the use of a dye formed by a process using a coupling reaction of an oxidation product of sulfonamido phenols with a coupler, in order to improve image tone of a black and white photothermographic material. However, the use of conventional reducing agents and couplers cannot provide an image with desired color density and favorable color tone. There exists a problem in that yield of dye becomes low, because the reaction of forming a dye from a coupler and a developing agent is prevented by other various reactions that occur simultaneously at the time of development. For this reason, the conventional technology is insufficient to obtain desired color-forming dye density. Increasing the amount of coupler or developing agent for use in order to gain dye density is not only ineffective, but also does not satisfy photographic performance under the present circumstances because of occurrence of deterioration in storability.

SUMMARY OF THE INVENTION

The present invention has been made in view of the above circumstances and provides a black and white photothermographic material comprising, on at least one side of a support, at least a photosensitive silver halide, a non-photosensitive organic silver salt, and a reducing agent for silver ions, wherein the reducing agent for silver ions is a compound represented by the following formula (PP) and having a molecular weight of from 450 to 3000, and the black and white photothermographic material further comprises a compound represented by the following formula (II).

Formula (PP)

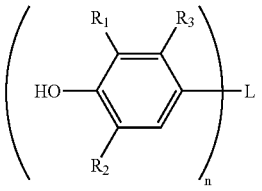

In formula (PP), $R_1$ and $R_2$ each independently represent a hydrogen atom or an alkyl group having 1 to 20 carbon atoms; at least one of $R_1$ and $R_2$ is an alkyl group having 1 to 20 carbon atoms; L represents a linking group having a valency of from 2 to 8 and represents an alkylene group, an arylene group, an aralkylene group, a heterocyclic linking group, or a combination thereof; $R_3$ represents a hydrogen atom or a substituent; and n represents an integer of from 2 to 8.

Formula (II)

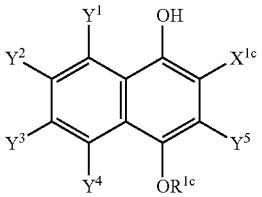

In formula (II), $R^{1c}$ represents an alkyl group, an aryl group, an alkenyl group, or an alkynyl group; $X^{1c}$ represents an alkoxycarbonyl group, a carbamoyl group, a sulfonyl group, or a sulfamoyl group; and $Y^1$ to $Y^5$ each independently represent a hydrogen atom or a substituent.

DETAILED DESCRIPTION OF THE INVENTION

An object of the present invention is to provide a black and white photothermographic material which exhibits favorable image tone and excellent storage stability.

By means of adjusting color tone of a developed silver image by adding a color image to the developed silver image, the present invention makes it possible to provide a material that produces an image rapidly with high sensitivity and favorable color tone, which could not be realized in conventional image formation by developed silver only. The combined use of a color image with an image of developed silver, which is comprised as the main component, has been proposed conventionally. However, it has been difficult for the image of developed silver and the color image to attain uniform color tone balance across the overall image density area from a low density area to a maximum density area. Moreover, because of low color forming efficiency, it is necessary to use components for forming color such as a color developing agent, coupler, and the like in a large amount, so that it is found that there are other problems in that color tone is deteriorated after long storage before use even if the photothermographic material exhibits favorable performance just after the production thereof, and components for forming color which exist after image formation cause change in color tone, occurrence of stain, or the like.

The present inventors have intensively researched means for solving the problems described above and found that the problems can be solved by using the reducing agent having a specific structure of the present invention as a reducing agent for silver ions forming a silver image, whereby they arrived at the present invention. In particular, in the case of a configuration in which plural image forming layers comprising an image forming layer forming a silver image and, adjacent to the image forming layer, an image forming layer which includes a coupler and forms a color image are provided, the present inventors have found that the above constitution is effective.

The black and white photothermographic material of the present invention is characterized in that it includes, on at least one side of a support, at least a photosensitive silver halide, a non-photosensitive organic silver salt, a reducing agent for silver ions, wherein the reducing agent for silver ions is a compound represented by formula (PP) described above and having a molecular weight of from 450 to 3000, and the black and white photothermographic material further includes a development accelerator represented by formula (II) described above.

When the molecular weight of the compound represented by formula (PP) is smaller than 450, it is not preferred because there is a problem in that image storability (particularly, image storability in a dark and hot place) is deteriorated. When the molecular weight is larger than 3000, it is not preferred because diffusion ability of the reducing agent is reduced, and there exists a problem in that development performance is lowered.

Preferably, in the compound represented by formula (PP) described above, $R_1$ and $R_2$ are each independently an alkyl group having 1 to 20 carbon atoms. More preferably, at least one of $R_1$ and $R_2$ is a secondary or tertiary alkyl group having 3 to 20 carbon atoms.

Preferably, in the compound represented by formula (PP) described above, L is a substituted alkylene group.

Preferably, in the compound represented by formula (II) described above, $R^{1c}$ is an alkyl group or an aryl group. More preferably, $R^{1c}$ is an alkyl group.

Preferably, $X^{1c}$ is a carbamoyl group. More preferably, $X^{1c}$ is an arylcarbamoyl group or an alkylcarbamoyl group, and even more preferably an arylcarbamoyl group.

Preferably, in the compound represented by formula (II) described above, $Y^1$ to $Y^5$ are each a hydrogen atom.

Particularly preferably, in the compound represented by formula (II) described above, $R^{1c}$ is an alkyl group, $X^{1c}$ is a carbamoyl group, and $Y^1$ to $Y^5$ are each a hydrogen atom.

Preferably, the black and white photothermographic material of the invention further includes a color developing agent and a coupler.

Preferably, the color developing agent is a compound represented by the following formula (1).

Formula (I)

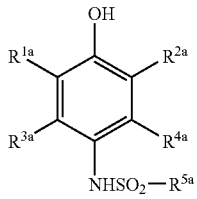

In formula (1), $R^{1a}$ and $R^{2a}$ each independently represent a hydrogen atom, a halogen atom, an alkyl group, an alkoxy group, an acyl group, an arylcarbonyl group, an alkylcarbonyl group, an aryloxycarbonyl group, an alkoxycarbonyl group, an arylcarbamoyl group, an alkylcarbamoyl group, a carbamoyl group, an arylsulfonyl group, an alkylsulfonyl group, an arylsulfamoyl group, an alkylsulfamoyl group, or a sulfamoyl group; $R^{3a}$ and $R^{4a}$ each independently represent a hydrogen atom or a substituent which substitutes for a hydrogen atom on a benzene ring; and $R^{5a}$ represents an alkyl group, an aryl group, or a heterocyclic group.

Preferably, the black and white photothermographic material of the present invention has, on one side of the support, a first image forming layer including at least the photosensitive silver halide, the non-photosensitive organic silver salt, and the reducing agent for silver ions, and a second image forming layer including at least the coupler, and at least one of the first image forming layer or the second image forming layer includes the color developing agent.

Preferably, the first image forming layer is a photosensitive silver image forming layer, and the second image forming layer is a non-photosensitive color image forming layer.

Preferably, the second image forming layer contains the color developing agent. More preferably, the first image forming layer does not substantially contain the color developing agent.

Preferably, the coupler is at least one compound represented by a formula selected from the group consisting of formulae (C-1), (C-2), (C-3), (M-1), (M-2), (M-3), (Y-1), (Y-2), and (Y-3) described below.

More preferably, in formulae (C-1), (C-2), (C-3), (M-1), (M-2), (M-3), (Y-1), (Y-2), and (Y-3) described below, $X_1$, $X_2$, $X_3$, $X_4$, $X_5$, $X_6$, $X_7$, $X_8$, and $X_9$ are each a hydrogen atom.

Particularly preferably, the coupler is a compound represented by formula (C-1) described below, and further preferably, in formula (C-1), $X_1$ is a hydrogen atom.

According to the present invention, a black and white photothermographic material which exhibits favorable image tone across the overall image density area from a low density area to a high density area, excellent raw stock storage stability during the time after production thereof until use for image formation, and excellent image storage stability is provided.

The present invention is explained below in detail.

(Compound Represented by Formula (PP))

The reducing agent for silver ions according to the present invention is a compound represented by the following formula (PP) and having a molecular weight of from 450 to 3000.

Formula (PP)

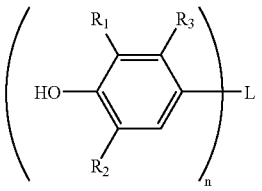

In formula (PP), $R_1$ and $R_2$ each independently represent a hydrogen atom or an alkyl group having 1 to 20 carbon atoms; at least one of $R_1$ and $R_2$ is an alkyl group having 1 to 20 carbon atoms; L represents a linking group having a valency of from 2 to 8, and represents an alkylene group, an arylene group, an aralkylene group, a heterocyclic linking group, or a combination thereof; $R_3$ represents a hydrogen atom or a substituent; and n represents an integer of from 2 to 8.

$R_1$ and $R_2$ each independently represent a hydrogen atom, or a substituted or unsubstituted alkyl group having 1 to 20 carbon atoms. The substituent of the alkyl group has no particular restriction, and examples thereof include, preferably, an aryl group, a hydroxy group, an alkoxy group, an aryloxy group, an alkylthio group, an arylthio group, an acylamino group, a sulfonamido group, a sulfonyl group, a phosphoryl group, an acyl group, a carbamoyl group, an ester group, a ureido group, a urethane group, a halogen atom, and the like.

$R_1$ and $R_2$ are preferably a primary, secondary, or tertiary alkyl group having 1 to 15 carbon atoms; and examples thereof include, specifically, a methyl group, an isopropyl group, a t-butyl group, a t-amyl group, a t-octyl group, a cyclohexyl group, a cyclopentyl group, a 1-methylcyclohexyl group, a 1-methylcyclopropyl group, and the like. $R_1$ and $R_2$ each represent, more preferably, an alkyl group having 1 to 8 carbon atoms, and among them, a methyl group, a t-butyl group, a t-amyl group, and a 1-methylcyclohexyl group are even more preferred, a methyl group and a t-butyl group are particularly preferred, and a t-butyl group is most preferred. $R_1$ and $R_2$ may be the same as or different from each other, but it is preferred that both of $R_1$ and $R_2$ are a t-butyl group.

$R_3$ represents a hydrogen atom or a group substituting for a hydrogen atom on a benzene ring. As the groups substituting for a hydrogen atom on the benzene ring, an alkyl group, an aryl group, a halogen atom, an alkoxy group, and an acylamino group are described preferably. $R_3$ is most preferably a hydrogen atom.

In the present invention, the addition amount of the compound of formula (PP) is preferably from 0.02 g/m$^2$ to 10.0 g/m$^2$, more preferably from 0.1 g/m$^2$ to 5.0 g/m$^2$, and even more preferably from 0.2 g/m$^2$ to 2.1 g/m$^2$. It is preferably contained in a range of from 5 mol % to 50 mol %, more preferably from 8 mol % to 30 mol %, and even more preferably from 10 mol % to 20 mol %, with respect to 1 mol of silver on the side having the image forming layer.

The compound of formula (PP) may be contained a layer other than the first image forming layer. The amount of the compound of formula (PP) contained in the second image forming layer including a coupler is preferably 50% by weight or less based on the amount of the compound of formula (PP) contained in the first image forming layer, and more preferably 10% by weight or less. Most preferably, the second image forming layer does not substantially contain the compound of formula (PP).

The compound of formula (PP) may be incorporated into the photothermographic material by being contained into the coating solution by any method, such as in the form of a solution, an emulsified dispersion, a solid fine particle dispersion, or the like.

As an emulsified dispersion method that is well known in the technical field, there is mentioned a method comprising dissolving the compound of formula (PP) in an oil such as dibutyl phthalate, tricresyl phosphate, glyceryl triacetate, diethyl phthalate, or the like, and an auxiliary solvent such as ethyl acetate, cyclohexanone, or the like, followed by mechanically preparing an emulsified dispersion.

As a solid fine particle dispersion method, there is mentioned a method comprising dispersing the powder of the compound of formula (PP) in a proper solvent such as water or the like, by means of ball mill, colloid mill, vibrating ball mill, sand mill, jet mill, roller mill, or ultrasonics, thereby obtaining a solid dispersion. In this process, there may be used a protective colloid (such as poly(vinyl alcohol)), or a surfactant (for instance, an anionic surfactant such as sodium triisopropylnaphthalenesulfonate (a mixture of compounds having the three isopropyl groups in different substitution sites)). In the mills enumerated above, generally used as the dispersion media are beads made of zirconia or the like, and Zr or the like eluting from the beads may be incorporated in the dispersion. Although depending on the dispersing conditions, the amount of Zr or the like incorporated in the dispersion is generally in a range of from 1 ppm to 1000 ppm. It is practically acceptable so long as Zr is incorporated in the photothermographic material in an amount of 0.5 mg or less per 1 g of silver. Preferably, an antiseptic (for instance, benzisothiazolinone sodium salt) is added in an aqueous dispersion.

The compound of formula (PP) is particularly preferably used as a solid particle dispersion, and is added in the form of fine particles having a mean particle size of from 0.01 μm to 10 μm, preferably from 0.05 μm to 5 μm, and more preferably from 0.1 μm to 2 μm. In the application, other solid dispersions are preferably used to be dispersed with this particle size range.

Specific examples of the compound represented by formula (PP) are shown below, but the compounds used in the invention are not limited to these specific examples.

PP-1

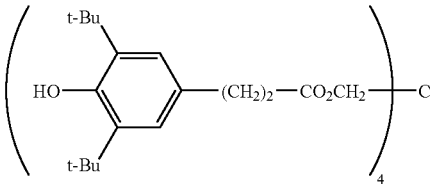

PP-2

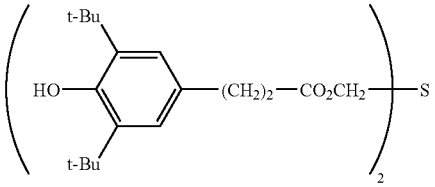

PP-3

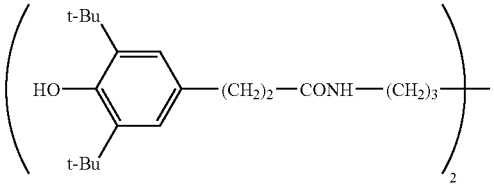

PP-4

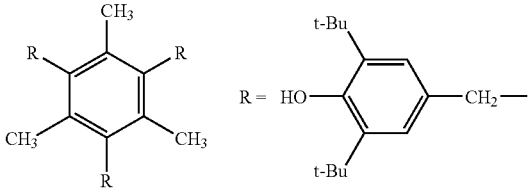

PP-5

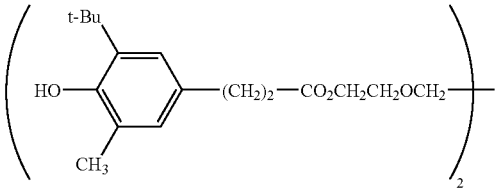

-continued

PP-6

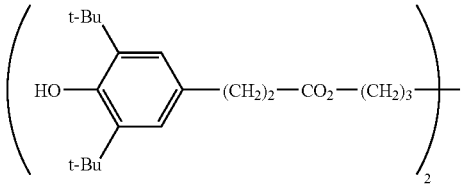

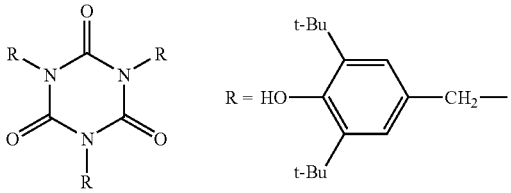

PP-8

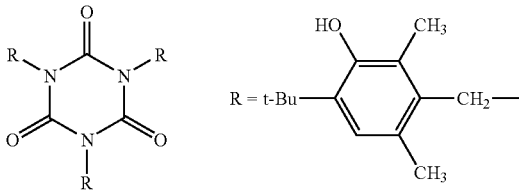

PP-9

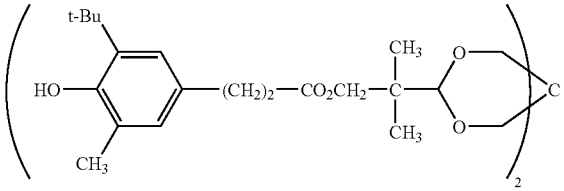

PP-10

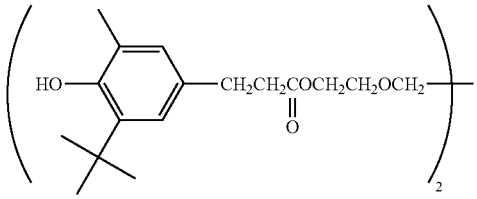

Molecular weight 586.8

(Compound Represented by Formula (II))

The compound represented by formula (II) used in the present invention will be described. The compound represented by formula (II) used in the present invention is a compound which is used in combination with the reducing agent for silver ions represented by formula (PP) and accelerates thermal development.

Formula (II)

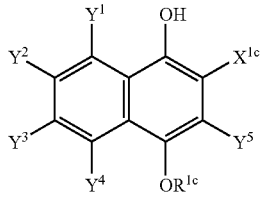

In formula (II), $R^{1c}$ represents an alkyl group, an aryl group, an alkenyl group, or an alkynyl group; $X^{1c}$ represents an alkoxycarbonyl group, a carbamoyl group, a sulfonyl group, or a sulfamoyl group; and $Y^1$ to $Y^5$ each independently represent a hydrogen atom or a substituent.

Preferably, in the compound represented by formula (II) described above, $R^{1c}$ is an alkyl group or an aryl group. More preferably, $R^{1c}$ is an alkyl group.

Preferably, $X^{1c}$ is a carbamoyl group. More preferably, $X^{1c}$ is an arylcarbamoyl group or an alkylcarbamoyl group, and even more preferably an arylcarbamoyl group.

Preferably, in the compound represented by formula (II) described above, $Y^1$ to $Y^5$ are each a hydrogen atom.

Particularly preferably, in the compound represented by formula (II) described above, $R^{1c}$ is an alkyl group, $X^{1c}$ is a carbamoyl group, and $Y^1$ to $Y^5$ are each a hydrogen atom.

The compound represented by the above formula (II) is further described in detail below.

The alkyl group represented by $R^{1c}$ is an alkyl group preferably having 1 to 30 carbon atoms, more preferably having 1 to 16 carbon atoms, and even more preferably having 1 to 13 carbon atoms, and is an alkyl group of straight-chain, branched, cyclic, or a combination thereof. Examples of the alkyl group include methyl, ethyl, n-propyl, isopropyl, n-butyl, sec-butyl, tert-butyl, n-hexyl, cyclohexyl, n-octyl, iso-octyl, n-amyl, tert-amyl, n-decyl, n-dodecyl, n-tridecyl, benzyl, phenethyl, and the like. The aryl group represented by $R^{1c}$ is an aryl group preferably having 6 to 30 carbon atoms, more preferably having 6 to 20 carbon atoms, and even more preferably having 6 to 12 carbon atoms; and examples thereof include phenyl, 4-methylphenyl, 2-chlorophenyl, 4-chlorophenyl, 2,4-dichlorophenyl, 3,4-dichlorophenyl, 2-methoxyphenyl, 4-methoxyphenyl, 4-hexyloxyphenyl, 2-dodecyloxyphenyl, naphthyl, and the like.

The alkenyl group represented by $R^{1c}$ is an alkenyl group preferably having 2 to 30 carbon atoms, more preferably having 2 to 20 carbon atoms, and even more preferably having 2 to 12 carbon atoms; and examples thereof include a vinyl group, an allyl group, an isopropenyl group, a butenyl group, a cyclohexenyl group, and the like. The alkynyl group represented by $R^{1c}$ is an alkynyl group preferably having 2 to 30 carbon atoms, more preferably having 2 to 20 carbon atoms, and even more preferably having 2 to 12 carbon atoms; and examples thereof include an ethynyl group, a propynyl group, and the like. $R^{1c}$ may further have a substituent. Preferable examples of the substituent include the groups represented by $Y^1$ to $Y^5$ described below. $R^{1c}$ preferably represents an alkyl group or an aryl group, and particularly preferably an alkyl group.

$X^{1c}$ represents an acyl group, an alkoxycarbonyl group, a carbamoyl group, a sulfonyl group, or a sulfamoyl group. The acyl group represented by $X^{1c}$ is an acyl group preferably having 2 to 20 carbon atoms, more preferably having 2 to 16 carbon atoms, and even more preferably having 2 to 12 carbon atoms; and examples thereof include acetyl, propionyl, butyryl, valeryl, hexanoyl, myristylyl, palmytoyl, stearyl, olelyl, acryloly, cyclohexanecarbonyl, benzoyl, formyl, pivaloyl, and the like. The alkoxycarbonyl group represented by $X^{1c}$ is an alkoxycarbonyl group preferably having 2 to 20 carbon atoms, more preferably having 2 to 16 carbon atoms, and even more preferably having 2 to 12 carbon atoms; and examples thereof include methoxycarbonyl, ethoxycarbonyl, butoxycarbonyl, phenoxycarbonyl, and the like.

The carbamoyl group represented by $X^{1c}$ is a carbamoyl group preferably having 1 to 20 carbon atoms, more preferably having 1 to 16 carbon atoms, and even more preferably having 1 to 12 carbon atoms; and examples thereof include carbamoyl, N,N-diethylcarbamoyl, N-dodecyl carbamoyl, N-decylcarbamoyl, N-hexadecylcarbamoyl, N-phenylcarbamoyl, N-(2-chlorophenyl)carbamoyl, N-(4-chlorophenyl)carbamoyl, N-(2,4-dichlorophenyl)carbamoyl, N-(3,4-dichlorophenyl)carbamoyl, N-pentachlorophenylcarbamoyl, N-(2-methoxyphenyl)carbamoyl, N-(4-methoxyphenyl)carbamoyl, N-(2,4-dimethoxyphenyl)carbamoyl, N-(2-dodecyloxyphenyl)carbamoyl, N-(4-dodecyloxyphenyl)carbamoyl, and the like.

The sulfonyl group represented by $X^{1c}$ is a sulfonyl group preferably having 1 to 20 carbon atoms, more preferably having 1 to 16 carbon atoms, and even more preferably having 1 to 12 carbon atoms; and examples thereof include mecyl, ethanesulfonyl, cyclohexanesulfonyl, benzenesulfonyl, tocyl, 4-chlorobenzenesulfonyl, and the like. The sulfamoyl group represented by $X^{1c}$ is a sulfamoyl group preferably having 0 to 20 carbon atoms, more preferably having 0 to 16 carbon atoms, and even more preferably having 0 to 12 carbon atoms; and examples thereof include sulfamoyl, methylsulfamoyl, dimethylsulfamoyl, phenylsulfamoyl, and the like.

$X^{1c}$ may further have a substituent. Examples of the preferred substituent include the groups represented by $Y^1$ to $Y^5$ described below. $X^{1c}$ preferably represents a carbamoyl group, more preferably an alkylcarbamoyl group or an arylcarbamoyl group, and particularly preferably an arylcarbamoyl group.

$Y^1$ to $Y^5$ each independently represent a hydrogen atom or a substituent. The substituent represented by $Y^1$ to $Y^5$ may be any substituent as long as it does not exert adverse influences on photographic performance. Examples of the substituent include a halogen atom (for example, a fluorine atom, a chlorine atom, a bromine atom, or an iodine atom), an alkyl group of straight-chain, branched, cyclic, or a combination thereof (preferably having 1 to 20 carbon atoms, more preferably having 1 to 16 carbon atoms, and even more preferably having 1 to 13 carbon atoms; for example, methyl, ethyl, n-propyl, isopropyl, sec-butyl, tert-butyl, tert-octyl, n-amyl, tert-amyl, n-dodecyl, n-tridecyl, cyclohexyl, or the like), an alkenyl group (preferably having 2 to 20 carbon atoms, more preferably having 2 to 16 carbon atoms, and even more preferably having 2 to 12 carbon atoms; for example, vinyl, allyl, 2-butenyl, 3-pentenyl, or the like), an aryl group (preferably having 6 to 30 carbon atoms, more preferably having 6 to 20 carbon atoms, and even more preferably having 6 to 12 carbon atoms; for example, phenyl, p-methylphenyl, naphthyl, or the like), an alkoxy group (preferably having 1 to 20 carbon atoms, more preferably having 1 to 16 carbon atoms, and even more preferably having 1 to 12 carbon atoms; for example, methoxy, ethoxy, propoxy, butoxy, or the like), an aryloxy group (preferably having 6 to 30 carbon atoms, more preferably having 6 to 20 carbon atoms, and even more preferably having 6 to 12 carbon atoms; for example, phenyloxy, 2-naphthyloxy, or the like), an acyloxy group (preferably having 2 to 20 carbon atoms, more preferably having 2 to 16 carbon atoms, and even more preferably having 2 to 12 carbon atoms; for example, acetoxy, benzoyloxy, or the like), an amino group (preferably having 0 to 20 carbon atoms, more preferably having 1 to 16 carbon atoms, and even more preferably having 1 to 12 carbon atoms; for example, a dimethylamino group, a diethylamino group, a dibutylamino group, an anilino group, or the like), an acylamino group (preferably having 2 to 20 carbon atoms, more preferably having 2 to 16 carbon atoms, and even more preferably having 2 to 13 carbon atoms; for example, acetylamino, tridecanoylamino, benzoylamino, or the like), a sulfonylamino group (preferably having 1 to 20 carbon atoms, more preferably having 1 to 16 carbon atoms, and even more preferably having 1 to 12 carbon atoms; for example, methanesulfonylamino, butanesulfonylamino, benzenesulfonylamino, or the like), a ureido group (preferably having 1 to 20 carbon atoms, more preferably having 1 to 16 carbon atoms, and even more preferably having 1 to 12 carbon atoms; for example, ureido, methylureido, phenylureido, or the like), a carbamate group (preferably having 2 to 20 carbon atoms, more preferably having 2 to 16 carbon atoms, and even more preferably having 2 to 12 carbon atoms; for example, methoxycarbonylamino, phenyloxycarbonylamino, or the like), a carboxy group, a carbamoyl group (preferably having 1 to 20 carbon atoms, more preferably having 1 to 16 carbon atoms, and even more preferably having 1 to 12 carbon atom; for example, carbamoyl, N,N-diethylcarbamoyl, N-dodecylcarbamoyl, N-phenylcarbamoyl, or the like), an alkoxycarbonyl group (preferably having 2 to 20 carbon atoms, more preferably having 2 to 16 carbon atoms, and even more preferably having 2 to 12 carbon atoms; for example, methoxycarbonyl, ethoxycarbonyl, butoxycarbonyl, or the like), an acyl group (preferably having 2 to 20 carbon atoms, more preferably having 2 to 16 carbon atoms, and even more preferably having 2 to 12 carbon atoms; for example, acetyl, benzoyl, formyl, pivaloyl, or the like), a sulfo group, a sulfonyl group (preferably having 1 to 20 carbon atoms, more preferably having 1 to 16 carbon atoms, and even more preferably having 1 to 12 carbon atoms; for example, mecyl, tocyl, or the like), a sulfamoyl group (preferably having 0 to 20 carbon atoms, more preferably having 0 to 16 carbon atoms, and even more preferably having 0 to 12 carbon atoms; for example, sulfamoyl, methylsulfamoyl, dimethylsulfamoyl, phenylsulfamoyl, or the like), a cyano group, a nitro group, a hydroxy group, a mercapto group, an alkylthio group (preferably having 1 to 20 carbon atoms, more preferably having 1 to 16 carbon atoms, and even more preferably having 1 to 12 carbon atoms; for example, methylthio, butylthio, or the like), a heterocyclic group (preferably having 2 to 20 carbon atoms, more preferably having 2 to 16 carbon atoms, and even more preferably having 2 to 12 carbon atoms; for example, pyridyl, imidazoyl, pyrrolidyl, or the like), and the like. These substituents may be further substituted by other substituents.

Among these, examples of preferable substituent represented by $Y^1$ to $Y^5$ include a halogen atom, an alkyl group, an aryl group, an alkoxy group, an aryloxy group, an acyloxy group, an anilino group, an acylamino group, a sulfonylamino group, a carboxy group, a carbamoyl group, an acyl group, a sulfo group, a sulfonyl group, a sulfamoyl group, a cyano group, a hydroxy group, a mercapto group, an alkylthio group, and a heterocyclic group.

In the practice of the present invention, the combination of an alkyl group for $R^{1c}$, a carbamoyl group for $X^{1c}$, and a hydrogen atom for $Y^1$ to $Y^5$ is most preferred.

Specific examples of the compound represented by formula (II) are shown below, however, the compounds used in the present invention are not limited to these specific examples.

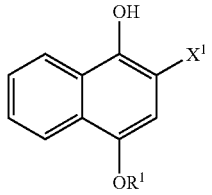

| Compound No. | $X^1$ | $R^1$ |
|---|---|---|
| 4-1 | $CONHC_6H_5$ | $CH_3$ |
| 4-2 | $CONHC_6H_5$ | $C_2H_5$ |
| 4-3 | $CONHC_6H_5$ | $C_3H_7$ |
| 4-4 | $CONHC_6H_5$ | $(i)C_3H_7$ |
| 4-5 | $CONHC_6H_5$ | $C_4H_9$ |
| 4-6 | $CONHC_6H_5$ | $C_5H_{11}$ |
| 4-7 | $CONHC_6H_5$ | $C_6H_{13}$ |
| 4-8 | $CONHC_6H_5$ | $c\text{-}C_6H_{11}$ |
| 4-9 | $CONHC_6H_5$ | $C_{10}H_{21}$ |
| 4-10 | $CONHC_6H_5$ | $C_{12}H_{25}$ |
| 4-11 | $CONHC_6H_5$ | $C_{16}H_{33}$ |
| 4-12 | $CONHC_6H_5$ | $CH_2C_6H_5$ |
| 4-13 | $CONHC_6H_5$ | $(CH_2)_2C_6H_5$ |
| 4-14 | $CONHC_6H_5$ | $(CH_2)_2NHSO_2CH_3$ |
| 4-15 | $CONHC_6H_5$ | $(CH_2)_2OCH_2CH_3$ |
| 4-16 | $CONHC_6H_5$ | $(CH_2)_2O(CH_2)_2OH$ |
| 4-17 | $CONHC_6H_5$ | $(CH_2)_2OCH_2CO_2H$ |
| 4-18 | $CONHC_6H_5$ | $C_8H_{17}$ |
| 4-19 | $CONHC_6H_5$ | $(CH_2)_2SO_2CH_3$ |
| 4-20 | $CONHC_6H_5$ | $(CH_2)_2SO_2CH_2CH_3$ |
| 4-21 | $CONHC_6H_5$ | $(CH_2)_2O(CH_2)_2OCH_2CH_3$ |

-continued
| | | |
|---|---|---|
| 4-22 | $CONHC_6H_5$ | 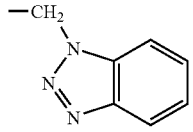 |
| 4-23 | $CONHC_6H_5$ | 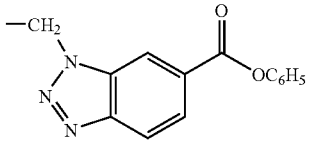 |
| 4-24 | $CONHC_6H_5$ | $C_6H_5$ |
| 4-25 | $CONHC_6H_5$ | p-$CH_3$—$C_6H_4$ |
| 4-26 | $CONHC_6H_5$ | p-Cl—$C_6H_4$ |
| 4-27 | $CONHC_6H_5$ | 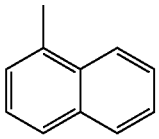 |
| 4-28 | $CONHC_6H_5$ | 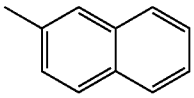 |
| 4-29 | CONH-2-Cl—$C_6H_4$ | $CH_3$ |
| 4-30 | CONH-2-Cl—$C_6H_4$ | $C_4H_9$ |
| 4-31 | CONH-2-Cl—$C_6H_4$ | $C_6H_{13}$ |
| 4-32 | CONH-2-Cl—$C_6H_4$ | $CH_2CH_2C_6H_5$ |
| 4-33 | CONH-2-Cl—$C_6H_4$ | $C_{12}H_{25}$ |
| 4-34 | CONH-4-Cl—$C_6H_4$ | $C_4H_9$ |
| 4-35 | CONH-4-Cl—$C_6H_4$ | $C_6H_{13}$ |
| 4-36 | CONH-4-Cl—$C_6H_4$ | $C_8H_{17}$ |
| 4-37 | CONH-4-Cl—$C_6H_4$ | $CH_2CH_2C_6H_5$ |
| 4-38 | CONH-4-Cl—$C_6H_4$ | $C_{12}H_{25}$ |
| 4-39 | 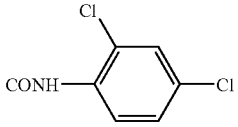 | $CH_3$ |
| 4-40 | 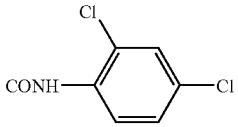 | $C_4H_9$ |
| 4-41 | 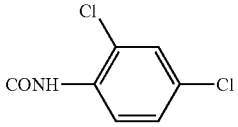 | $C_6H_{13}$ |
| 4-42 | 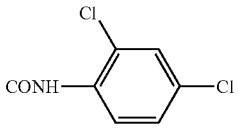 | $C_8H_{17}$ |
| 4-43 | 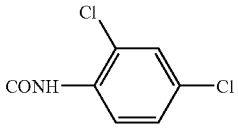 | $CH_2CH_2C_6H_5$ |

-continued
| | | |
|---|---|---|
| 4-44 | 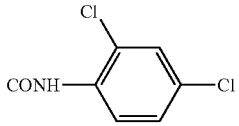 | $C_{10}H_{21}$ |
| 4-45 | 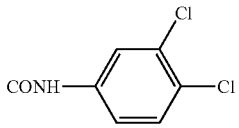 | $CH{=}CHCH_3$ |
| 4-46 | 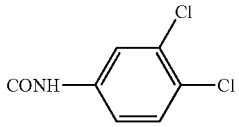 | $C_4H_9$ |
| 4-47 | 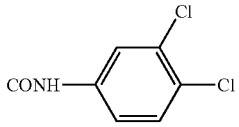 | $C_6H_{13}$ |
| 4-48 | 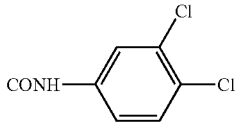 | $C{=}CH$ |
| 4-49 | 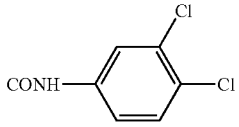 | $C_8H_{17}$ |
| 4-50 | 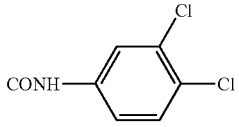 | $CH_2CH_2C_6H_5$ |
| 4-51 | 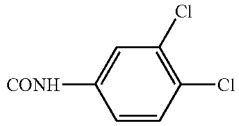 | $CH_2C_6H_5$ |
| 4-52 | 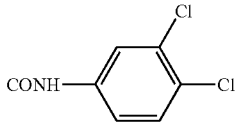 | $C_6H_5$ |
| 4-53 | 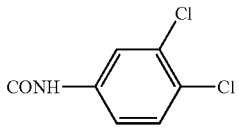 | $CH_2CH_2SO_2CH_3$ |
| 4-54 | 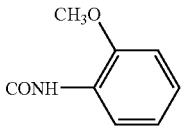 | $C_6H_{13}$ |

-continued
| | | |
|---|---|---|
| 4-55 | 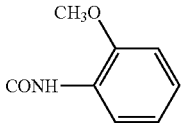 | $CH_2CH_2C_6H_5$ |
| 4-56 | 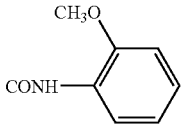 | $C_4H_9$ |
| 4-57 | $CONHCH_3$ | $C_6H_{13}$ |
| 4-58 | $CONHC_4H_9$ | $C_6H_{13}$ |
| 4-59 | $CONHC_6H_{13}$ | $C_6H_{13}$ |
| 4-60 | $CONHC_{10}H_{21}$ | $C_6H_{13}$ |
| 4-61 | $CONHC_{12}H_{25}$ | $C_6H_{13}$ |
| 4-62 | $CONHC_{16}H_{33}$ | $C_6H_{13}$ |
| 4-63 | 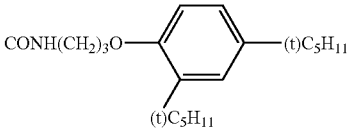 | $C_6H_{13}$ |
| 4-64 | $CONH(CH_2)_3OC_{12}H_{25}$ | $C_6H_{13}$ |
| 4-65 | 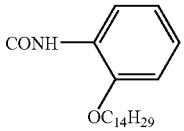 | $C_6H_{13}$ |
| 4-66 | $CONHCH_2C_6H_5$ | $C_6H_{13}$ |
| 4-67 | 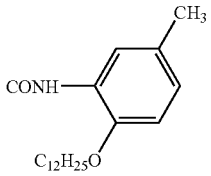 | $C_6H_{13}$ |
| 4-68 | 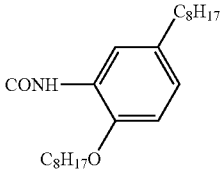 | $C_6H_{13}$ |
| 4-69 | $CONH—(t)C_4H_9$ | $C_6H_{13}$ |
| 4-70 | $CONH—(t)C_8H_{17}$ | $C_6H_{13}$ |
| 4-71 | $CON(C_2H_5)_2$ | $C_6H_{13}$ |
| 4-72 | 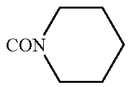 | $C_6H_{13}$ |
| 4-73 | 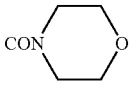 | $C_6H_{13}$ |
| 4-74 | 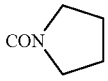 | $C_6H_{13}$ |
| 4-75 | $CONHC_4H_9$ | $(CH_2)_2C_6H_5$ |
| 4-76 | $CONHC_{10}H_{21}$ | $(CH_2)_2C_6H_5$ |
| 4-77 | $CONHC_{12}H_{25}$ | $(CH_2)_2C_6H_5$ |

-continued

| | | |
|---|---|---|
| 4-78 | CONH—(t)$C_4H_9$ | $(CH_2)_2C_6H_5$ |
| 4-79 | CONH—(t)$C_8H_{17}$ | $(CH_2)_2C_6H_5$ |
| 4-80 | $CONHCH_3$ | $(CH_2)_2C_6H_5$ |
| 4-81 | 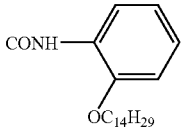 | $(CH_2)_2C_6H_5$ |
| 4-82 | $CON(C_2H_5)_2$ | $(CH_2)_2C_6H_5$ |
| 4-83 | 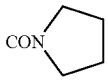 | $(CH_2)_2C_6H_5$ |
| 4-84 | $CONHCH_2C_6H_5$ | $(CH_2)_2C_6H_5$ |

4-85

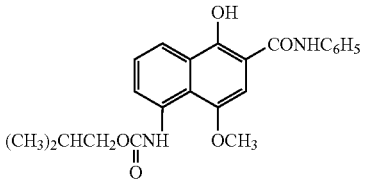

4-86

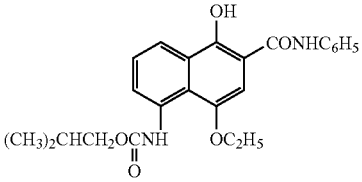

4-87

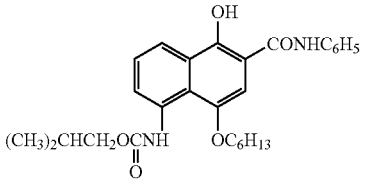

4-88

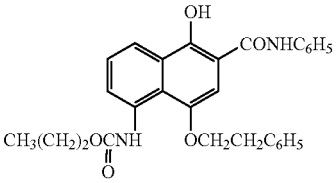

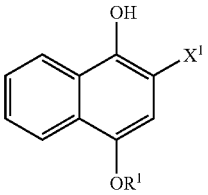

| Compound No. | $X^1$ | $R^1$ |
|---|---|---|
| 4-89 | $COCH_3$ | $C_6H_{13}$ |
| 4-90 | $COC_2H_5$ | $C_6H_{13}$ |
| 4-91 | $COC_7H_{15}$ | $C_6H_{13}$ |
| 4-92 | $COC_{11}H_{23}$ | $C_6H_{13}$ |
| 4-93 | $COCH_3$ | $(CH_2)_2C_6H_5$ |
| 4-94 | $COC_2H_5$ | $(CH_2)_2C_6H_5$ |
| 4-95 | $COC_7H_{15}$ | $(CH_2)_2C_6H_5$ |
| 4-96 | $COC_{11}H_{23}$ | $(CH_2)_2C_6H_5$ |
| 4-97 | $COCH_3$ | $CH_3$ |
| 4-98 | $COCH_3$ | $C_4H_9$ |
| 4-99 | $COCH_3$ | $C_6H_5$ |
| 4-100 | $COCH_3$ | $CH_2C_6H_5$ |
| 4-101 | $COCH_3$ | $C_{10}H_{21}$ |
| 4-102 | $COCH_3$ | $C_{12}H_{25}$ |
| 4-103 | $COCH_3$ | $C_{16}H_{33}$ |
| 4-104 | $CO_2C_6H_5$ | $C_6H_5$ |
| 4-105 | $CO_2C_6H_5$ | $CH_3$ |
| 4-106 | $CO_2C_6H_5$ | $C_2H_5$ |
| 4-107 | $CO_2C_6H_5$ | $C_4H_9$ |
| 4-108 | $CO_2C_6H_5$ | $C_6H_{13}$ |
| 4-109 | $CO_2C_6H_5$ | $C_{10}H_{21}$ |
| 4-110 | $CO_2C_6H_5$ | $CH_2C_6H_5$ |
| 4-111 | $CO_2C_6H_5$ | $(CH_2)_2C_6H_5$ |
| 4-112 | $CO_2C_6H_5$ | $C_{12}H_{25}$ |
| 4-113 | $CO_2C_6H_5$ | $C_{16}H_{33}$ |
| 4-114 | $CO_2C_6H_5$ | $(CH_2)_2SO_2CH_3$ |
| 4-115 | $CO_2C_6H_5$ | $(CH_2)_2SO_2NHCH_3$ |
| 4-116 | $CO_2C_6H_5$ | $(CH_2)_2NHSO_2C_2H_5$ |

-continued

| | | |
|---|---|---|
| 4-117 | $CO_2CH_3$ | $CH_3$ |
| 4-118 | $CO_2CH_3$ | $C_4H_9$ |
| 4-119 | $CO_2C_2H_5$ | $C_6H_{13}$ |
| 4-120 | $CO_2C_2H_5$ | $(CH_2)_2C_6H_5$ |
| 4-121 | $CO_2C_2H_5$ | $C_{12}H_{25}$ |
| 4-122 | $CO_2C_{12}H_{25}$ | $CH_3$ |
| 4-123 | $CO_2C_{12}H_{25}$ | $C_4H_9$ |
| 4-124 | $CO_2C_{12}H_{25}$ | $C_6H_{13}$ |
| 4-125 | $CO_2C_{12}H_{25}$ | $(CH_2)_2C_6H_5$ |
| 4-126 | $CO_2C_{12}H_{25}$ | $(CH_2)_2SO_2CH_3$ |
| 4-127 | $CO_2C_{12}H_{25}$ | $CH{=}CHCH_3$ |
| 4-128 | $CO_2C_{12}H_{25}$ | $CH_2CH{=}CH_2$ |
| 4-129 | $CO_2C_{12}H_{25}$ | $C{\equiv}CCH_3$ |
| 4-130 | $CO_2C_{12}H_{25}$ | c-$C_6H_{11}$ |
| 4-131 | $CO_2C_{12}H_{25}$ | $C_6H_5$ |
| 4-132 | $SO_2CH_3$ | $C_4H_9$ |
| 4-133 | $SO_2CH_3$ | $C_6H_{13}$ |
| 4-134 | $SO_2CH_3$ | $C_6H_5$ |
| 4-135 | $SO_2CH_3$ | $CH_3$ |
| 4-136 | $SO_2CH_3$ | $(CH_2)_2C_6H_5$ |
| 4-137 | $SO_2CH_3$ | $CH_2C_6H_5$ |
| 4-138 | $SO_2C_6H_5$ | $C_4H_9$ |
| 4-139 | $SO_2C_6H_5$ | $C_6H_{13}$ |
| 4-140 | $SO_2C_6H_5$ | $CH_3$ |
| 4-141 | $SO_2C_6H_5$ | $(CH_2)_2C_6H_5$ |
| 4-142 | $SO_2C_6H_5$ | $C_{12}H_{25}$ |
| 4-143 | $SO_2NHC_6H_5$ | $C_6H_5$ |
| 4-144 | $SO_2NHCH_3$ | $C_6H_5$ |
| 4-145 | $SO_2NHC_2H_5$ | $C_6H_5$ |
| 4-146 | $SO_2NHC_6H_{13}$ | $C_6H_5$ |
| 4-147 | $SO_2NHC_4H_9$ | $C_6H_5$ |
| 4-148 | $SO_2NH$—(t)$C_4H_9$ | $C_6H_5$ |
| 4-149 | $SO_2NH$—(t)$C_8H_{17}$ | $C_6H_5$ |
| 4-150 | $SO_2NHC_6H_5$ | $C_6H_{13}$ |
| 4-151 | $SO_2NHCH_3$ | $C_6H_{13}$ |
| 4-152 | $SO_2NHC_2H_5$ | $C_6H_{13}$ |
| 4-153 | $SO_2NHC_4H_9$ | $C_6H_{13}$ |
| 4-154 | $SO_2NH$—(t)$C_4H_9$ | $C_6H_{13}$ |
| 4-155 | $SO_2NH$—(t)$C_8H_{17}$ | $C_6H_{13}$ |
| 4-156 | $SO_2NHC_6H_{13}$ | $(CH_2)_2C_6H_5$ |
| 4-157 | $SO_2NHC_6H_5$ | $(CH_2)_2C_6H_5$ |
| 4-158 | $SO_2NHCH_3$ | $(CH_2)_2C_6H_5$ |
| 4-159 | $SO_2NH$—(t)$C_8H_{17}$ | $(CH_2)_2C_6H_5$ |

The compound represented by formula (II) for use in the present invention can be prepared by the methods well known in the photographic industry.

The compound represented by formula (II) according to the present invention can be used by being dissolved into water or a proper organic solvent, for example, alcohols (methanol, ethanol, propanol, or fluorocarbon alcohol), ketones (acetone or methyl ethyl ketone), dimethylformamide, dimethylsulfoxide, methyl cellosolve, or the like. The compound may be used in the form of an emulsified dispersion using a well-known method comprising dissolving the compound in an oil such as dibutyl phthalate, tricresyl phosphate, glyceryl triacetate, diethyl phthalate, or the like, and an auxiliary solvent such as ethyl acetate, cyclohexanone, or the like, followed by mechanically preparing an emulsified dispersion. Or the compound may be used in the form of a solid dispersion using a well-known method comprising dispersing the powder of the compound in water, by means of a ball mill, colloid mill, sand grinder mill, Manton-Gaulin, microfluidizer, or ultrasonics.

The compound represented by formula (II) according to the present invention may be added in any layer on the same side of the support as the photosensitive silver halide and reducible silver salt, but is preferably added in the layer containing the silver halide or a layer adjacent thereto.

The addition amount of the compound represented by formula (II) for use in the present invention is preferably from 0.2 mmol to 200 mmol per 1 mol of silver, more preferably from 0.3 mmol to 100 mmol, and even more preferably from 0.5 mmol to 30 mmol. The compound represented by formula (II) according to the present invention may be used alone, or two or more of them may be used in combination.

(Development Accelerator which can be used in Combination with the Development Accelerator Represented by Formula (II))

In the black and white photothermographic material of the present invention, a development accelerator represented by the following formula (A-1) may be used in combination with the development accelerator represented by formula (II).

$$Q_1\text{-NHNH-}Q_2 \qquad \text{Formula (A-1)}$$

In formula (A-1), $Q_1$ represents an aromatic group or heterocyclic group which bonds to —NHNH-$Q_2$ at a carbon atom, and $Q_2$ represents a carbamoyl group, an acyl group, an alkoxycarbonyl group, an aryloxycarbonyl group, a sulfonyl group, or a sulfamoyl group.

In formula (A-1), the aromatic group or heterocyclic group represented by $Q_1$ is preferably a 5- to 7-membered unsaturated ring. Preferred examples thereof include a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isooxazole ring, a thiophene ring, and the like. Condensed rings in which the rings described above are condensed to each other are also preferred.

The rings described above may have substituents, and in the case where they have two or more substituents, the substituents may be identical or different from each other. Examples of the substituent include a halogen atom, an alkyl group, an aryl group, a carbonamido group, an alkylsulfonamido group, an arylsulfonamido group, an alkoxy group, an aryloxy group, an alkylthio group, an arylthio group, a carbamoyl group, a sulfamoyl group, a cyano group, an alkylsulfonyl group, an arylsulfonyl group, an alkoxycarbonyl group, an aryloxycarbonyl group, and an acyl group. In the case where the substituents are groups capable of substitution, they may further have a substituent, and examples of preferred substituent include a halogen atom, an alkyl group, an aryl group, a carbonamido group, an alkylsulfonamido group, an arylsulfonamido group, an alkoxy group, an aryloxy group, an alkylthio group, an arylthio group, an acyl group, an alkoxycarbonyl group, an aryloxycarbonyl group, a carbamoyl group, a cyano group, a sulfamoyl group, an alkylsulfonyl group, an arylsulfonyl group, and an acyloxy group.

The carbamoyl group represented by $Q_2$ is a carbamoyl group preferably having 1 to 50 carbon atoms, and more preferably having 6 to 40 carbon atoms; and examples thereof include unsubstituted carbamoyl, methylcarbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N-(2-hexyldecyl)carbamoyl, N-phenylcarbamoyl, N-(4-dodecyloxyphenyl)carbamoyl, N-(2-chloro-5-dodecyloxycarbonylphenyl)carbamoyl, N-naphthylcarbamoyl, N-3-pyridylcarbamoyl, and N-benzylcarbamoyl.

The acyl group represented by $Q_2$ is an acyl group preferably having 1 to 50 carbon atoms, and more preferably having 6 to 40 carbon atoms; and examples thereof include formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, and 2-hydroxymethylbenzoyl. The alkoxycarbonyl group represented by $Q_2$ is an alkoxycarbonyl group preferably having 2 to 50 carbon atoms, and more preferably having 6 to 40 carbon atoms; and examples thereof include methoxycarbonyl, ethoxycarbonyl, isobutyloxycarbonyl, cyclohexyloxycarbonyl, dodecyloxycarbonyl, and benzyloxycarbonyl.

The aryloxycarbonyl group represented by $Q_2$ is an aryloxycarbonyl group preferably having 7 to 50 carbon atoms, and more preferably having 7 to 40 carbon atoms; and examples thereof include phenoxycarbonyl, 4-octyloxyphenoxycarbonyl, 2-hydroxymethylphenoxycarbonyl, and 4-dodecyloxyphenoxycarbonyl. The sulfonyl group represented by $Q_2$ is a sulfonyl group preferably having 1 to 50 carbon atoms, and more preferably having 6 to 40 carbon atoms; and examples thereof include methylsulfonyl, butylsulfonyl, octylsulfonyl, 2-hexadecylsulfonyl, 3-dodecyloxypropylsulfonyl, 2-octyloxy-5-tert-octylphenylsulfonyl, and 4-dodecyloxyphenylsulfonyl.

The sulfamoyl group represented by $Q_2$ is a sulfamoyl group preferably having 0 to 50 carbon atoms, and more preferably having 6 to 40 carbon atoms; and examples thereof include unsubstituted sulfamoyl, an N-ethylsulfamoyl group, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, and N-(2-tetradecyloxyphenyl)sulfamoyl. The group represented by $Q_2$ may further have a group mentioned as the example of the substituent of 5- to 7-membered unsaturated ring represented by $Q_1$ described above at the position capable of substitution. In the case where the group represented by $Q_2$ has two or more substituents, these substituents may be identical or different from one another. Preferable range for the compound represented by formula (A-1) is to be described. A 5- or 6-membered unsaturated ring is preferred for $Q_1$, and a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thiazole ring, an oxazole ring, an isothiazole ring, an isooxazole ring, and a ring in which the ring described above is condensed with a benzene ring or unsaturated heterocycle are more preferred. Further, $Q_2$ is preferably a carbamoyl group, and particularly preferably a carbamoyl group having a hydrogen atom on the nitrogen atom.

Preferred specific examples for the development accelerator represented by formula (A-1) according to the invention are to be described below. The invention is not restricted to these examples.

A-1

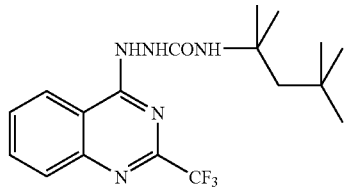

A-2

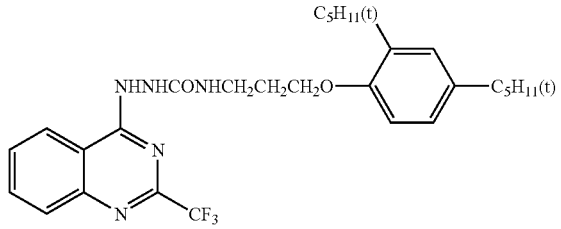

A-3

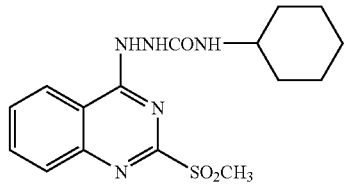

A-4

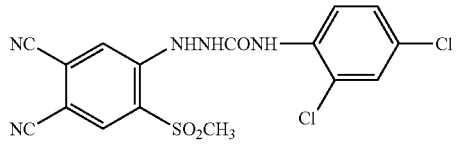

A-5

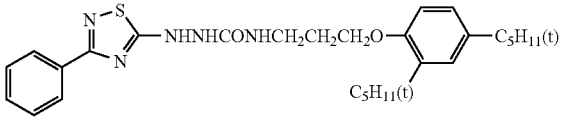

(Compound Represented by Formula (1))

Formula (1)

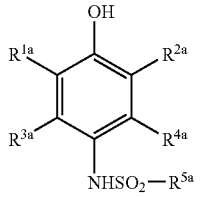

In formula (1), $R^{1a}$ and $R^{2a}$ each independently represent one selected from a hydrogen atom, a halogen atom, an alkyl group, an alkoxy group, an acyl group, an arylcarbonyl group, an alkylcarbonyl group, an aryloxycarbonyl group, an alkoxycarbonyl group, an arylcarbamoyl group, an alkylcarbamoyl group, a carbamoyl group, an arylsulfonyl group, an alkylsulfonyl group, an arylsulfamoyl group, an alkylsulfamoyl group, or a sulfamoyl group; $R^{3a}$ and $R^{4a}$ each independently represent a hydrogen atom or a substituent which substitutes for a hydrogen atom on a benzene ring; and $R^{5a}$ represents an alkyl group, an aryl group, or a heterocyclic group.

The compound represented by formula (1) used in the present invention is a compound which functions as a color developing agent. Herein, the color developing agent is a compound which reduces a silver ion to silver in a development process and forms an oxidation product of the compound, and the oxidation product of the compound reacts with a coupler to form a dye.

In formula (1), $R^{1a}$ and $R^{2a}$ each independently represent a hydrogen atom or a substituent which substitutes for a hydrogen atom on a benzene ring. Preferred examples thereof include a hydrogen atom, a halogen atom, an alkyl group (including a cycloalkyl group and a bicycloalkyl group), an alkenyl group (including a cycloalkenyl group and a bicycloalkenyl group), an alkynyl group, an aryl group, a heterocyclic group, a cyano group, a hydroxy group, a nitro group, a carboxy group, an alkoxy group, an aryloxy group, silyloxy group, a heterocyclic oxy group, an acyloxy group, a carbamoyloxy group, an alkoxycarbonyloxy group, an aryloxycarbonyloxy group, an amino group (including an anilino group), an acylamino group, an aminocarbonylamino group, an alkoxycarbonylamino group, an aryloxycarbonylamino group, a sulfamoylamino group, an alkylsulfonylamino group, an arylsulfonylamino group, a mercapto group, an alkylthio group, an arylthio group, a heterocyclic thio group, a sulfamoyl group, a sulfo group, an alkylsulfinyl group, an arylsulfinyl group, an alkylsulfonyl group, an arylsulfonyl group, an acyl group, an aryloxycarbonyl group, an alkoxycarbonyl group, a carbamoyl group, an arylazo group, a heterocyclic azo group, an imido group, a phosphino group, a phosphinyl group, a phosphinyloxy group, a phosphinylamino group, and a silyl group.

Further in detail, a halogen atom (for example, a chlorine atom, a bromine atom, or an iodine atom), an alkyl group [which represents a straight-chain, branched, or cyclic, substituted or unsubstituted alkyl group; an alkyl group (preferably, an alkyl group having 1 to 30 carbon atoms; for example, methyl, ethyl, n-propyl, isopropyl, t-butyl, n-octyl, eicosyl, 2-chloroethyl, 2-cyanoethyl, and 2-ethylhexyl), a cycloalkyl group (preferably, a substituted or unsubstituted cycloalkyl group having 3 to 30 carbon atoms; for example, cyclohexyl, cyclopentyl, and 4-n-dodecylcyclohexyl), a bicycloalkyl group (preferably, a substituted or unsubstituted bicycloalkyl group having 5 to 30 carbon atoms, namely, a monovalent group obtained by removing one hydrogen atom from bicycloalkane having 5 to 30 carbon atoms; for example, bicyclo[1,2,2]heptan-2-yl and bicyclo[2,2,2]octan-3-yl), and further a tricyclo structure having many cyclic structures, and the like are included; an alkyl group included in a substituent described below (for example, an alkyl group in an alkylthio group) also represents the alkyl group of this concept], an alkenyl group [which represents a straight-chain, branched, or cyclic, substituted or unsubstituted alkenyl group; an alkenyl group (preferably, an alkenyl group having 2 to 30 carbon atoms; for example, vinyl, allyl, prenyl, gelanyl, and oleyl), a cycloalkenyl group (preferably, a substituted or unsubstituted cycloalkenyl group having 3 to 30 carbon atoms, namely, a monovalent group obtained by removing one hydrogen atom from cycloalkene having 3 to 30 carbon atoms; for example, 2-cyclopenten-1-yl and 2-cyclohexen-1-yl), a bicycloalkenyl group (a substituted or unsubstituted bicycloalkenyl group, and preferably, a substituted or unsubstituted bicycloalkenyl group having 5 to 30 carbon atoms, namely, a monovalent group obtained by removing one hydrogen atom from bicycloalkene having one double bond; for example, bicyclo[2,2,1]hepto-2-en-1-yl and bicyclo[2,2,2]octo-2-en-4-yl) are described], an alkynyl group (preferably, a substituted or unsubstituted alkynyl group having 2 to 30 carbon atoms; for example, ethynyl, propargyl, and a trimethylsilylethynyl group), an aryl group (preferably, a substituted or unsubstituted aryl group having 6 to 30 carbon atoms; for example, phenyl, p-tolyl, naphthyl, m-chlorophenyl, and o-hexadecanoylaminophenyl), a heterocyclic group (preferably, a monovalent group obtained by removing one hydrogen atom from 5- or 6-membered, substituted or unsubstituted, aromatic or non-aromatic heterocyclic compound, more preferably, a 5- or 6-membered aromatic heterocyclic group having 3 to 30 carbon atoms; for example, 2-furyl, 2-thienyl, 2-pyrimidinyl, and 2-benzothiazolyl), a cyano group, a hydroxy group, a nitro group, a carboxy group, an alkoxy group (preferably, a substituted or unsubstituted alkoxy group having 1 to 30 carbon atoms; for example, methoxy, ethoxy, isopropoxy, t-butoxy, n-octyloxy, and 2-methoxyethoxy), an aryloxy group (preferably, a substituted or unsubstituted aryloxy group having 6 to 30 carbon atoms; for example, phenoxy, 2-methylphenoxy, 4-t-butylphenoxy, 3-nitrophenoxy, and 2-tetradecanoylaminophenoxy), a silyloxy group (preferably, a silyloxy group having 3 to 20 carbon atoms; for example, trimethylsilyloxy and t-butyldimethylsilyloxy), a heterocyclic oxy group (preferably, a substituted or unsubstituted heterocyclic oxy group having 2 to 30 carbon atoms; for example, 1-phenyltetrazole-5-oxy and 2-tetrahydropyranyloxy), an acyloxy group (preferably, a formyloxy group, a substituted or unsubstituted alkylcarbonyloxy group having 2 to 30 carbon atoms, or a substituted or unsubstituted arylcarbonyloxy group having 6 to 30 carbon atoms; for example, formyloxy, acetyloxy, pivaloyloxy, stearoyloxy, benzoyloxy, and p-methoxyphenylcarbonyloxy), a carbamoyloxy group (preferably, a substituted or unsubstituted carbamoyloxy group having 1 to 30 carbon atoms; for example, N,N-dimethylcarbamoyloxy, N,N-diethylcarbamoyloxy, morpholinocarbonyloxy, N,N-di-n-octylaminocarbonyloxy, and N-n-octylcarbamoyloxy), an alkoxycarbonyloxy group (preferably, a substituted or unsubstituted alkoxycarbonyloxy group having 2 to 30 carbon atoms; for example, methoxycarbonyloxy, ethoxycarbonyloxy, t-butoxycarbonyloxy, and n-octylcarbonyloxy), an aryloxycarbonyloxy group (preferably, a substituted or unsubstituted aryloxycarbonyloxy group having 7 to 30 carbon atoms; for example, phenoxycarbonyloxy, p-methoxyphenoxycarbonyloxy, and p-n-hexadecyloxyphenoxycarbonyloxy), an amino group (preferably, an amino group, a substituted or unsubstituted alkylamino group having 1 to 30 carbon atoms, or a substituted or unsubstituted anilino group having 6 to 30 carbon atoms; for example, amino, methylamino, dimethylamino, anilino, N-methyl-anilino, and diphenylamino), an acylamino group (preferably, a formylamino group, a substituted or unsubstituted alkylcarbonylamino group having 1 to 30 carbon atoms, or a substituted or unsubstituted arylcarbonylamino group having 6 to 30 carbon atoms; for example, formylamino, acetylamino, pivaloylamino, lauroylamino, benzoylamino, and 3,4,5-tri-n-octyloxyphenylcarbonylamino), an aminocarbonylamino group (preferably, a substituted or unsubstituted aminocarbonylamino group having 1 to 30 carbon atoms; for example, carbamoylamino, N,N-dimethylaminocarbonylamino, N,N-diethylaminocarbonylamino, and morpholinocarbonylamino), an alkyloxycarbonylamino group (preferably, a substituted or unsubstituted alkoxycarbonylamino group having 2 to 30 carbon atoms; for example, methoxycarbonylamino, ethoxycarbonylamino, t-butoxycarbonylamino, n-octadecyloxycarbonylamino, and N-methyl-methoxycarbonylamino), an aryloxycarbonylamino group (preferably, a substituted or unsubstituted aryloxycarbonylamino group having 7 to 30 carbon atoms; for example, phenoxycarbonylamino, p-chlorophenoxycarbonylamino, and m-n-octyloxyphenoxycarbonylamino), a sulfamoylamino group (preferably, a substituted or unsubstituted sulfamoylamino group having 0 to 30 carbon atoms; for example, sulfamoylamino, N,N-dimethylaminosulfonylamino, and N-n-octylaminosulfonylamino), an alkylsulfonylamino group and an arylsulfonylamino group (preferably, a substituted or unsubstituted alkylsulfonylamino group having 1 to 30 carbon atoms and a substituted or unsubstituted arylsulfonylamino group having 6 to 30 carbon atoms; for example, methylsulfonylamino, butylsulfonylamino, phenylsulfonylamino, 2,3,5-trichlorophenylsulfonylamino, and p-methylphenylsulfonylamino), a mercapto group, an alkylthio group (preferably, a substituted or unsubstituted alkylthio group having 1 to 30 carbon atoms; for example, methylthio, ethylthio and n-hexadecylthio), an arylthio group (preferably, a substituted or unsubstituted arylthio group having 6 to 30 carbon atoms; for example, phenylthio, p-chlorophenylthio, and m-methoxyphenylthio), a heterocyclic thio group (preferably, a substituted or unsubstituted heterocyclic thio group having 2 to 30 carbon atoms; for example, 2-benzothiazolylthio and 1-phenyltetrazol-5-ylthio), a sulfamoyl group (preferably, a substituted or unsubstituted sulfamoyl group having 0 to 30 carbon atoms; for example, N-ethylsulfamoyl, N-(3-dodecyloxypropyl)sulfamoyl, N,N-dimethylsulfamoyl, N-acetylsulfamoyl, N-benzoylsulfamoyl, and N-(N'-phenylcarbamoyl)sulfamoyl), a sulfo group, an alkylsulfinyl group and an arylsulfinyl group (preferably, a substituted or unsubstituted alkylsulfinyl group having 1 to 30 carbon atoms and a substituted or unsubstituted arylsulfinyl group having 6 to 30 carbon atoms; for example, methylsulfinyl, ethylsulfinyl, phenylsulfinyl, and p-methylphenylsulfinyl), an alkylsulfonyl group and an arylsulfonyl group (preferably, a substituted or unsubstituted alkylsulfonyl group having 1 to 30 carbon atoms and a substituted or unsubstituted arylsulfonyl group having 6 to 30 carbon atoms; for example, methylsulfonyl, ethylsulfonyl, phenylsulfonyl, and p-methylphenylsulfonyl), an acyl group (preferably, a formyl group, a substituted or unsubstituted alkylcarbonyl group having 2 to 30 carbon atoms, a substituted or unsubstituted arylcarbonyl group having 7 to 30 carbon atoms, or a substituted or unsubstituted heterocyclic carbonyl group having 4 to 30 carbon atoms in which the heterocycle bonds to the carbonyl group through a carbon atom; for example, acetyl, pivaloyl, 2-chloroacetyl, stearoyl, benzoyl, p-n-octyloxyphenylcarbonyl, 2-pyridylcarbonyl, and 2-furylcarbonyl), an aryloxycarbonyl group (preferably, a substituted or unsubstituted aryloxycarbonyl group having 7 to 30 carbon atoms; for example, phenoxycarbonyl, o-chlorophenoxycarbonyl, m-nitrophenoxycarbonyl, and p-t-butylphenoxycarbonyl), an alkoxycarbonyl group (preferably, a substituted or unsubstituted alkoxycarbonyl group having 2 to 30 carbon atoms; for example, methoxycarbonyl, ethoxycarbonyl, t-butoxycarbonyl, and n-octadecyloxycarbonyl), a carbamoyl group (preferably, a substituted or unsubstituted carbamoyl group having 1 to 30 carbon atoms; for example, carbamoyl, N-methylcarbamoyl, N,N-dimethylcarbamoyl, N,N-di-n-octylcarbamoyl, and N-(methylsulfonyl)carbamoyl), an arylazo group and a heterocyclic azo group (preferably, a substituted or unsubstituted arylazo group having 6 to 30 carbon atoms and a substituted or unsubstituted heterocyclic azo group having 3 to 30 carbon atoms; for example, phenylazo, p-chlorophenylazo, and 5-ethylthio-1,3,4-thiadiazol-2-ylazo), an imido group (for example, N-succinimide and N-phthalimide), a phosphino group (preferably, a substituted or unsubstituted phosphino group having 2 to 30 carbon atoms; for example, dimethylphosphino, diphenylphosphino, and methylphenoxyphosphino), a phosphinyl group (preferably, a substituted or unsubstituted phosphinyl group having 2 to 30 carbon atoms; for example, phosphinyl, dioctyloxyphosphinyl, and diethoxyphosphinyl), a phosphinyloxy group (preferably, a substituted or unsubstituted phosphinyloxy group having 2 to 30 carbon atoms; for example, diphenoxyphosphinyloxy and dioctyloxyphosphinyloxy), a phosphinylamino group (preferably, a substituted or unsubstituted phosphinylamino group having 2 to 30 carbon atoms; for example, dimethoxyphosphinylamino and dimethylaminophosphinylamino), a silyl group (preferably, a substituted or unsubstituted silyl group having 3 to 30 carbon atoms; for example, trimethylsilyl, t-butyldimethylsilyl, and phenyldimethylsilyl) are described.

Among the functional groups described above, the group which has a hydrogen atom may be further substituted by the above group after removing the hydrogen atom. Examples of such functional group include an alkylcarbonylaminosulfonyl group, an arylcarbonylaminosulfonyl group, an alkylsulfonylaminocarbonyl group, and an arylsulfonylaminocarbonyl group. Specific examples thereof include a methylsulfonylaminocarbonyl group, a p-methylphenylsulfonylaminocarbonyl group, an acetylaminosulfonyl group, and a benzoylaminosulfonyl group. In the case where the functional group is substituted by two or more substituents, these substituents may be identical or different from each other.

In the case where $R^{1a}$ and $R^{2a}$ are an alkyl group, at least one of $R^{1a}$ and $R^{2a}$ is preferably a secondary or a tertiary alkyl group, and more preferably a tertiary alkyl group. In the case where $R^{1a}$ and $R^{2a}$ are a halogen atom, $R^{1a}$ and $R^{2a}$ are preferably a chlorine atom or a bromine atom, and more preferably a chlorine atom. Each of $R^{1a}$ and $R^{2a}$ has preferably 16 or fewer carbon atoms, more preferably 12 or fewer carbon atoms, and even more preferably 8 or fewer carbon atoms.

$R^{3a}$ and $R^{4a}$ each independently represent a hydrogen atom or a group substituting for a hydrogen atom on a benzene ring. $R^{3a}$ and $R^{4a}$ are preferably a substituent which is selected from among the substituents described as the examples of $R^{1a}$ and $R^{2a}$ described above. Among the functional groups of $R^{3a}$ and $R^{4a}$, the group which has a hydrogen atom may be further substituted by the functional group after removing the hydrogen atom, similar to the example of $R^{1a}$ and $R^{2a}$.

$R^{5a}$ represents an alkyl group, an aryl group, or a heterocyclic group; and among the functional groups, the group which has a hydrogen atom may be further substituted, after removing the hydrogen atom, by the functional group described in the example of $R^{1a}$ and $R^{2a}$ described above. As examples of such substituent, among the substituents described in the example of $R^{1a}$ and $R^{2a}$ described above, a halogen atom, an alkyl group, an aryl group, a heterocyclic group, an alkoxy group, an aryloxy group, an acyloxy group, a sulfonyloxy group, an alkylthio group, an arylthio group, an amino group, an anilino group, an acylamino group, an aminocarbonylamino group, an alkoxycarbonylamino group, an aryloxycarbonylamino group, a sulfamoylamino group, an alkylsulfonylamino group, an arylsulfonylamino group, an acyl group, an alkoxycarbonyl group, a carbamoyl group, an arylsulfonyl group, an alkylsulfonyl group, an alkylsulfinyl group, an arylsulfinyl group, a sulfamoyl group, a cyano group, and a nitro group are preferred.

$R^{5a}$ is more preferably an aryl group or heterocyclic group, and particularly preferably an aryl group. As the heterocyclic group, preferred is a 5- or 6-membered ring containing at least one of a nitrogen atom and a sulfur atom, and more preferred is a 5- or 6-membered aromatic heterocycle containing a nitrogen atom.

As the aryl group, preferred is an aryl group substituted by an electron-attracting substituent or a substituent which is bulky in three dimensions. As the electron-attracting group, it is enough that the group is highly electron-attractive toward a hydrogen atom. The electron-attracting group is preferably a halogen atom, an acyl group, an oxycarbonyl group, a carbamoyl group, an arylsulfonyl group, an alkylsulfonyl group, an alkylsulfinyl group, an arylsulfinyl group, a sulfamoyl group, a cyano group, a nitro group, or a heterocyclic group, and more preferably a halogen atom, an acyl group, an oxycarbonyl group, a carbamoyl group, an arylsulfonyl group, an alkylsulfonyl group, a sulfamoyl group, or a cyano group. It is preferred that at least one of the electron-attracting groups is substituted at the ortho or para position with respect to the —$NHSO_2$— group. As the group which is bulky in three dimensions, it is enough that the group is just a bulky group rather than a methyl group. The group which is bulky in three dimensions is preferably an alkyl group having 2 or more carbon atoms, more preferably a secondary or tertiary alkyl group, and even more preferably a tertiary alkyl group. The group which is bulky in three dimensions preferably substitutes at at least one of the ortho positions with respect to the —$NHSO_2$— group, and more preferably at both of the ortho positions with respect to the —$NHSO_2$— group. An aryl group having both of the electron-attracting group and the group which is bulky in three dimensions is particularly preferable. $R^{5a}$ has preferably 30 or fewer carbon atoms, more preferably 20 or fewer carbon atoms, and even more preferably 16 or fewer carbon atoms.

As preferable structure of the compound represented by formula (1), $R_{1a}$ and $R^{2a}$ are each independently one selected from a halogen atom, an alkyl group, an alkoxy group, an acyl group, an oxycarbonyl group, a carbamoyl group, an arylsulfonyl group, an alkylsulfonyl group, or a sulfamoyl group; $R^{3a}$ and $R^{4a}$ are each independently a hydrogen atom, a halogen atom, or an alkyl group; and $R^{5a}$ is an aryl group or a heterocyclic group.

Among the above functional groups, the group which has a hydrogen atom may be further substituted, after removing the hydrogen atom, by the functional group described in the example of $R^{1a}$ and $R^{2a}$ described above.

As even more preferable structure of the compound represented by formula (1), $R^{1a}$ and $R^{2a}$ are each independently a halogen atom, an alkyl group, a carbamoyl group, or a sulfamoyl group; $R^{3a}$ and $R^{4a}$ are each independently a hydrogen atom or a halogen atom; and $R^{5a}$ is an aryl group. As the aryl group, more preferred is an aryl group substituted by an electron-attracting substituent or a substituent which is bulky in three dimensions, and particularly preferred is an aryl group having both of an electron-attracting group and a group which is bulky in three dimensions. Among the above functional groups, the group which has a hydrogen atom may be further substituted, after removing the hydrogen atom, by the functional group described in the example of $R^{1a}$ and $R^{2a}$ described above.

The molecular weight of the compound represented by formula (1) is preferably in a range of from 300 to 700, more preferably from 300 to 600, and even more preferably from 350 to 550.

Specific examples of the compound represented by formula (1) according to the present invention are shown below, but the invention is not limited thereto.

1-1

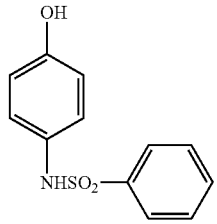

1-2

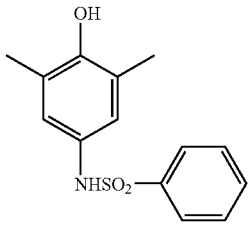

-continued
1-3
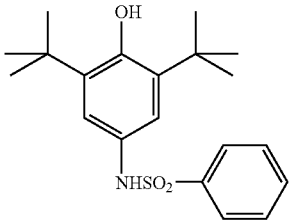
1-4
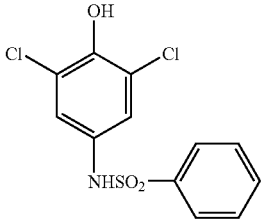
1-5
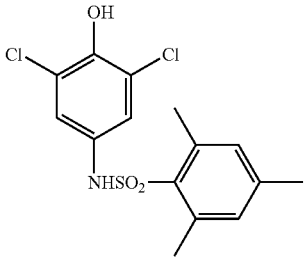
1-6
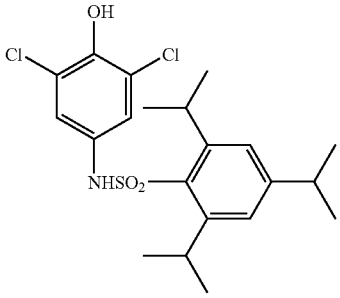
1-7
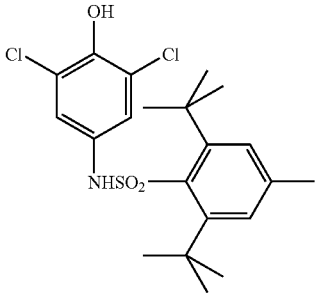
1-8
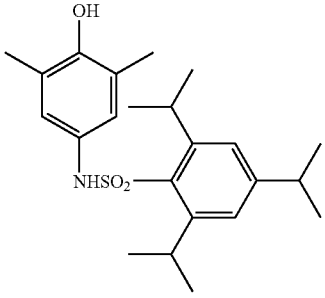
-continued
1-9
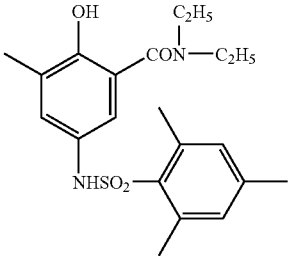
1-10
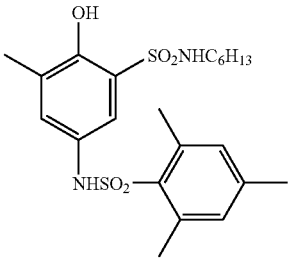
1-11
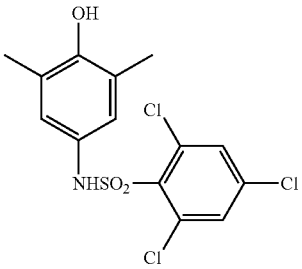
1-12
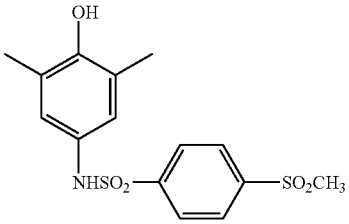
1-13
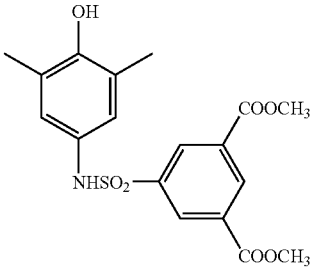
1-14
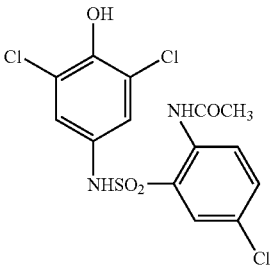

-continued
1-15
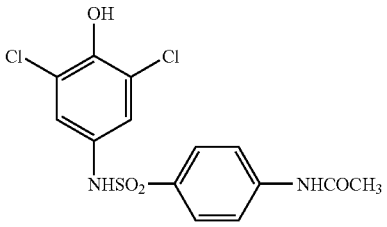
1-16
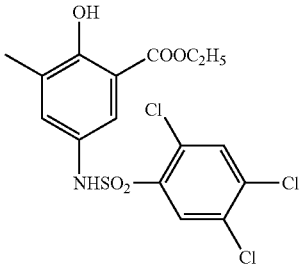
1-17
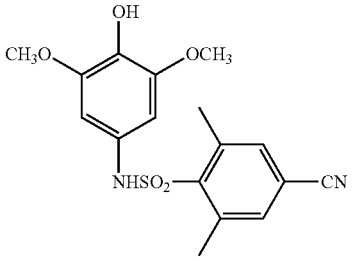
1-18
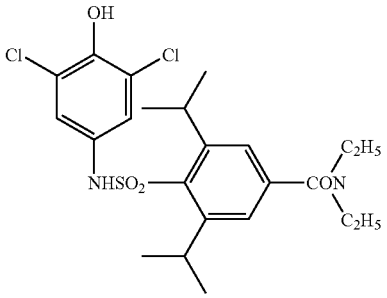
1-19
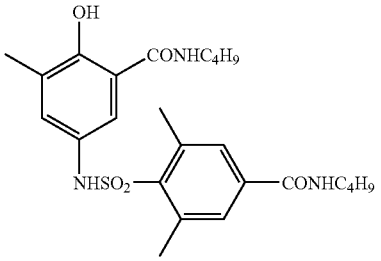
-continued
1-20
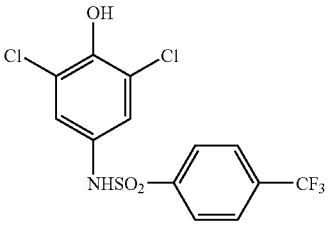
1-21
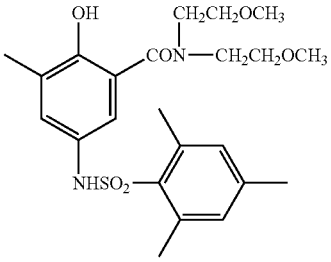
1-22
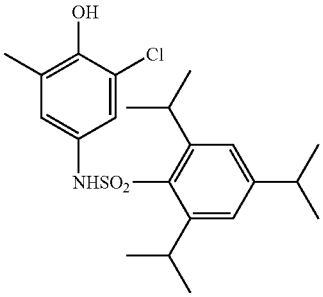
1-23
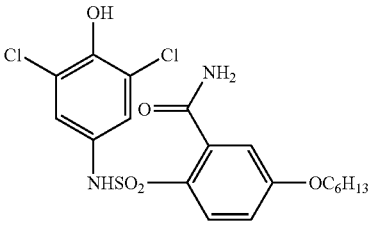
1-24
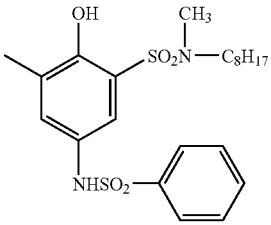

-continued
1-25
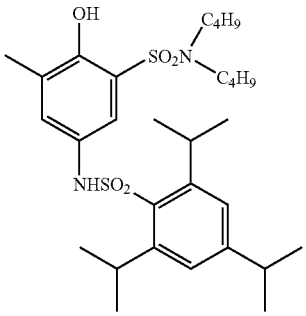
1-26
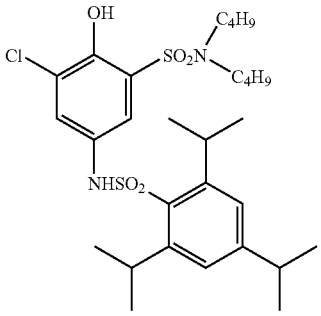
1-27
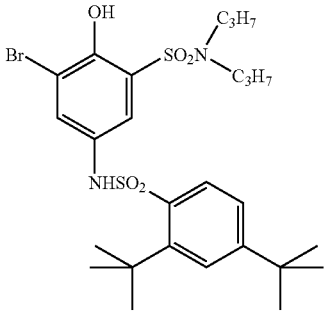
1-28
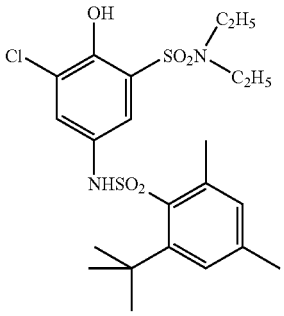
1-29
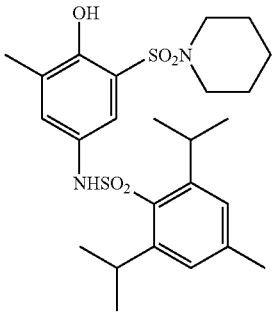
-continued
1-30
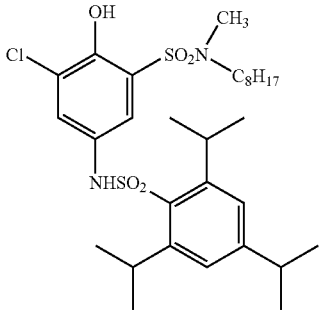
1-31
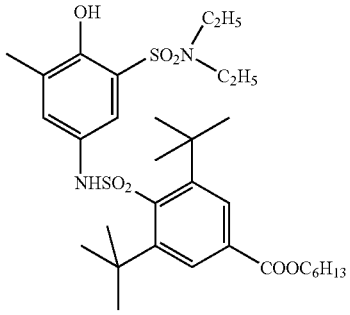
1-32
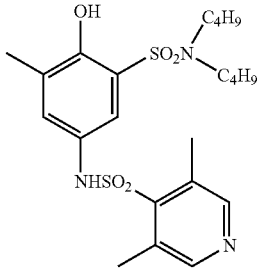
1-33
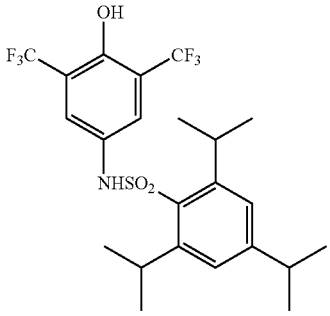
1-34
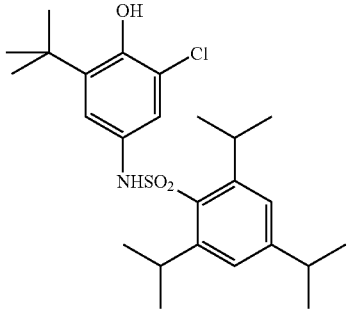

-continued 1-35

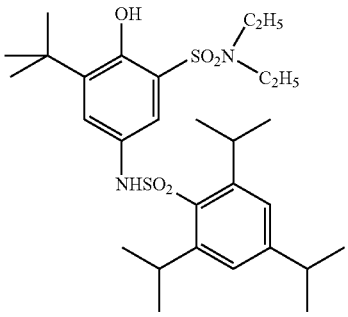

1-36

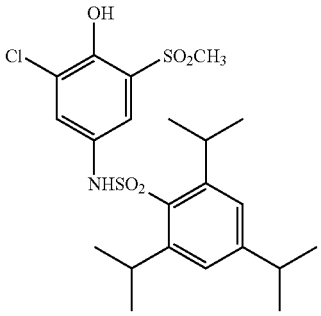

As specific examples of the compound represented by formula (1) other than those described above, compound Nos. D-1 to D-28 represented by formula (7) in the specification of JP-A No. 11-265044 are described.

The addition amount of the color developing agent according to the invention is preferably from 0.1 g/m$^2$ to 3.0 g/m$^2$, more preferably from 0.2 g/m$^2$ to 2.0 g/m$^2$, and even more preferably from 0.3 g/m$^2$ to 1.0 g/m$^2$.

The color developing agent according to the invention may be contained in either of the first image forming layer or the second image forming layer including a coupler, but it is preferably contained in the second image forming layer.

The color developing agent according to the present invention may be incorporated into the photothermographic material by being contained into the coating solution by any method such as in the form of a solution, an emulsified dispersion, a solid fine particle dispersion, or the like.

As an emulsion dispersion method that is well known in the technical field, there is mentioned a method comprising dissolving the color developing agent in an oil such as dibutyl phthalate, tricresyl phosphate, dioctyl sebacate, tri(2-ethylhexyl) phosphate, or the like, and an auxiliary solvent such as ethyl acetate, cyclohexanone, or the like, and then adding a surfactant such as sodium dodecylbenzenesulfonate, sodium oleoil-N-methyltaurinate, di(2-ethylhexyl) sodium sulfosuccinate or the like; from which an emulsified dispersion is mechanically produced. During the process, for the purpose of controlling viscosity of oil droplet and refractive index, the addition of polymer such as α-methylstyrene oligomer, poly (t-butylacrylamide), or the like is preferable.

As a solid fine particle dispersion method, there is mentioned a method comprising dispersing the powder of the color developing agent in a proper solvent such as water or the like, by means of ball mill, colloid mill, vibrating ball mill, sand mill, jet mill, roller mill, or ultrasonics, thereby obtaining a solid dispersion. In this process, there may be used a protective colloid (such as poly(vinyl alcohol)), or a surfactant (for instance, an anionic surfactant such as sodium triisopropylnaphthalenesulfonate (a mixture of compounds having the three isopropyl groups in different substitution sites)). In the mills enumerated above, generally used as the dispersion media are beads made of zirconia or the like, and Zr or the like eluting from the beads may be incorporated in the dispersion. Although depending on the dispersing conditions, the amount of Zr or the like incorporated in the dispersion is generally in a range of from 1 ppm to 1000 ppm. It is practically acceptable so long as Zr is incorporated in the photothermographic material in an amount of 0.5 mg or less per 1 g of silver.

Preferably, an antiseptic (for instance, benzisothiazolinone sodium salt) is added in an aqueous dispersion.

The color developing agent is particularly preferably used as a solid particle dispersion, and is added in the form of fine particles having a mean particle size of from 0.01 μm to 10 μm, preferably from 0.05 μm to 5 μm, and more preferably from 0.1 μm to 2 μm. In the invention, other solid dispersions are preferably used to be dispersed with this particle size range.

(Coupler)

The coupler according to the present invention is described in detail below.

The coupler according to the present invention may have any structure, as long as the coupler is a compound which forms a dye having an absorption in the visible light region by coupling with an oxidation product of the color developing agent according to the present invention. Such a compound is a compound that is well known for the color photographic system, and as representative examples, a pyrrolotriazole type coupler, a phenol type coupler, a naphthol type coupler, a pyrazolotriazole type coupler, a pyrazolone type coupler, an acylacetoanilide type coupler, and the like are described. In color photosensitive materials, it is required to fix a coupler in the photosensitive layer with a multi-layer structure, and a coupler having a large molecular weight with a large oil-soluble group in the above-mentioned coupler skeleton is used. In the present invention, it is not so important to fix a coupler and it is a characteristic that a lower molecular coupler has an advantage from the viewpoint of gaining image density. Particularly, when it is used in a solid dispersion state, the large oil-soluble group inhibits the reaction efficiency remarkably. It is especially preferable that the substituent of the skeleton is a small group in the range which can reduce water solubility.

As a cyan dye-forming coupler (simply, sometimes referred to as "cyan coupler") used for the present invention, a coupler represented by formula (I) or (II) of JP-A No. 5-313324, a pyrazoloazole coupler represented by formula (I) of JP-A No. 6-347960, and phenol and naphthol type cyan couplers represented by formula (ADF) described in JP-A No. 10-333297 are preferably used. Further, a pyrroloazole type cyan coupler described in the specifications of European Patent (EP) No. 0,488,248 and EP No. 0,491,197A1, a 2,5-diacylaminophenol coupler described in U.S. Pat. No. 5,888,716, and a pyrazoloazole type cyan coupler having an electron-attracting group and a hydrogen bonding group at the 6th position described in U.S. Pat. Nos. 4,873,183 and 4,916,051 are also preferably used, and a pyrazoloazole type cyan coupler having a carbamoyl group at the 6th position described in JP-A Nos. 8-171185, 8-311360, and 8-339060 is particularly preferably used. Furthermore, 3-hydroxypyridine type cyan couplers (among these, coupler (42), (6), and (9) enumerated as typical examples are preferable) described in the specification of EP No. 0,333,185A2, cyclic active methylene type cyan couplers (among these, coupler example 3, 8, and 34 enumerated as typical examples are preferable) described in JP-A No. 64-32260, pyrrolopyrazole type cyan couplers described in the specification of EP No. 0,456,226A1, and pyrroloimidazole type cyan couplers described in EP No. 0,484,909 are preferably used.

As a magenta dye-forming coupler (simply, sometimes referred to as "magenta coupler") used for the present invention, a 5-pyrazolone type magenta coupler and a pyrazoloazole type magenta coupler are used, and preferable examples include a pyrazolotriazole coupler in which a secondary or tertiary alkyl group bonds directly to a pyrazolotriazole ring at the 2nd, 3rd, or 6th position such as described in JP-A No. 61-65245, a pyrazoloazole coupler containing a sulfonamido group in a molecule such as described in JP-A No. 61-65246, a pyrazoloazole coupler having an alkoxyphenylsulfonamido ballast group such as described in JP-A No. 61-147254, and a pyrazoloazole coupler having an alkoxy group or an aryloxy group at the 6th position such as described in EP Nos. 226,849A and 294,785A. In addition to these, a pyrazoloazole coupler having steric hindrance groups at both of the 3rd and 6th positions described in EP Nos. 854,384 and 884,640, and a pyrazoloazole magenta coupler described in JP-A No. 2004-302306 are also described as preferable couplers.

As a yellow dye-forming coupler (in this specification, sometimes referred simply to as "yellow coupler"), the following compounds can be used if needed. Namely, an acylacetamide type yellow coupler in which the acyl group has a 3- to 5-membered cyclic structure described in the specification of EP No. 0,447,969A1, a malonedianilide type yellow coupler having a cyclic structure described in specification of EP No. 0,482,552A1, a pyrrole-2 or 3-yl carbonylacetanilide type coupler or an indole-2 or 3-yl carbonylacetanilide type coupler described in EP Nos. 953,870A1, 953,871A1, 953,872A1, 953,873A1, 953,874A1, and 953,875A1, and the like, and an acylacetamide type yellow coupler having a dioxan structure described in the specification of U.S. Pat. No. 5,118,599 are preferably used. Among these, an acylacetamide type yellow coupler, in which the acyl group is a 1-alkylcyclopropane-1-carbonyl group, and a malonedianilide type yellow coupler in which one of the anilides constitutes an indoline ring are preferably used.

The couplers described above are compounds which are well known for the color photographic system. In color photosensitive materials, it is required to fix a coupler in the photosensitive layer with a multi-layer structure, and a coupler having a large molecular weight with a large oil-soluble group in the above-mentioned coupler skeleton is used. In the present invention, it is not so important to fix a coupler and it is a characteristic that a lower molecular coupler has an advantage from the viewpoint of gaining image density. Particularly, when it is used in a solid dispersion state, the large oil-soluble group inhibits the reaction efficiency remarkably. It is especially preferable that the substituent of the skeleton is a small group in the range which can reduce water solubility.

In the present invention, preferable coupler is the coupler having the structure represented by formula (C-1), (C-2), (C-3), (M-1), (M-2), (M-3), (Y-1), (Y-2), or (Y-3):

Formula (C-1)

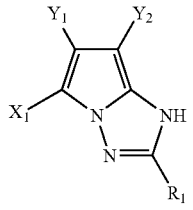

(wherein $X_1$ represents a hydrogen atom or a leaving group, $Y_1$ and $Y_2$ each independently represent an electron-attracting substituent, and $R_1$ represents an alkyl group, an aryl group, or a heterocyclic group.)

Formula (C-2)

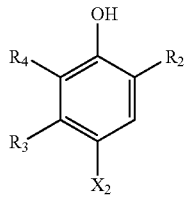

(wherein $X_2$ represents a hydrogen atom or a leaving group, $R_2$ represents an acylamino group, a ureido group, or a urethane group, $R_3$ represents a hydrogen atom, an alkyl group, or an acylamino group, $R_4$ represents a hydrogen atom or a substituent, and $R_3$ and $R_4$ may link together to form a ring.);

Formula (C-3)

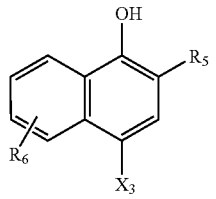

(wherein $X_3$ represents a hydrogen atom or a leaving group, $R_5$ represents a carbamoyl group or a sulfamoyl group, and $R_6$ represents a hydrogen atom or a substituent.);

Formula (M-1)

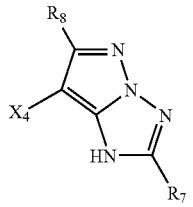

(wherein $X_4$ represents a hydrogen atom or a leaving group, $R_7$ represents an alkyl group, an aryl group, or a heterocyclic group, and $R_8$ represents a substituent.);

Formula (M-2)

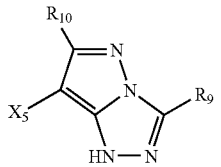

(wherein $X_5$ represents a hydrogen atom or a leaving group, $R_9$ represents an alkyl group, an aryl group, or a heterocyclic group, and $R_{10}$ represents a substituent.);

Formula (M-3)

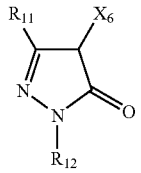

(wherein $X_6$ represents a hydrogen atom or a leaving group, $R_{11}$ represents an alkyl group, an aryl group, an acylamino group, or an anilino group, and $R_{12}$ represents an alkyl group, an aryl group, or a heterocyclic group.);

Formula (Y-1)

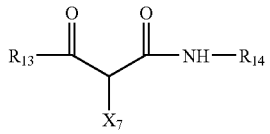

(wherein $X_7$ represents a hydrogen atom or a leaving group, $R_{13}$ represents an alkyl group, an aryl group, or an indolenyl group, and $R_{14}$ represents an aryl group or a heterocyclic group.);

Formula (Y-2)

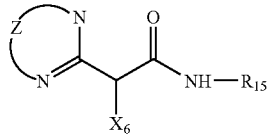

(wherein $X_8$ represents a hydrogen atom or a leaving group, Z represents a divalent group necessary for forming a 5- to 7-membered ring, and $R_{15}$ represents an aryl group or a heterocyclic group.);

Formula (Y-3)

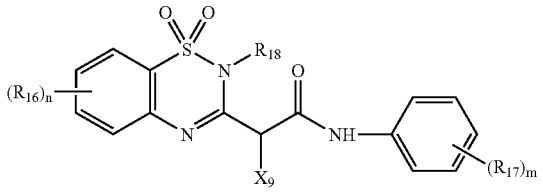

(wherein $X_9$ represents a hydrogen atom or a leaving group, $R_{16}$, $R_{17}$, and $R_{18}$ each independently represent a substituent, n represents an integer of from 0 to 4, and m represents an integer of from 0 to 5, when n represents 2 or more, a plurality of $R_{16}$ may be the same or different from one another, and when m represents 2 or more, a plurality of $R_{17}$ may be the same or different from one another.).

In formula (C-1), $X_1$ represents a hydrogen atom or a leaving group, and $Y_1$ and $Y_2$ each independently represent an electron-attracting substituent. $R_1$ represents an alkyl group, an aryl group, or a heterocyclic group, each of which may have a substituent. $X_1$ is preferably a hydrogen atom.

The leaving group in the present invention means the group which leaves from the skeleton at the formation of dye by coupling with an oxidation product of the color developing agent. As the leaving group, a halogen atom, an alkoxy group, an aryloxy group, an alkylthio group, an arylthio group, an acyloxy group, a carbamoyloxy group, an imido group, a methylol group, a heterocyclic group, and the like are described. $Y_1$ and $Y_2$ represent an electron-attracting group. Specifically, a cyano group, a nitro group, an acyl group, an oxycarbonyl group, a carbamoyl group, a sulfonyl group, a sulfoxide group, an oxysulfonyl group, a sulfamoyl group, a heterocyclic group, a trifluoromethyl group, and a halogen atom are described. Among these, a cyano group, an oxycarbonyl group, and a sulfonyl group are preferable, and a cyano group and an oxycarbonyl group are more preferable. Even more preferably, one of $Y_1$ or $Y_2$ is a cyano group, and particularly preferably, $Y_1$ is a cyano group. $Y_2$ is preferably an oxycarbonyl group, and particularly, $Y_2$ is preferably an oxycarbonyl group substituted by a bulky group (for example, 2,6-di-t-butyl-4-methylpiperazinyloxycarbonyl group). $R_1$ is preferably an alkyl group or an aryl group, each of which may have a substituent. As the alkyl group, a secondary or tertiary alkyl group is preferable, and a tertiary alkyl group is more preferable. The alkyl group preferably has 3 to 12 carbon atoms in total, and more preferably 4 to 8 carbon atoms. As the aryl group, preferable is a phenyl group, which may have a substituent, and the aryl group preferably has 6 to 16 carbon atoms in total, and more preferably 6 to 12 carbon atoms. Concerning the coupler of formula (C-1), the molecular weight is preferably 900 or less, more preferably 700 or less, and even more preferably 600 or less.

In formula (C-2), $X_2$ represents a hydrogen atom or a leaving group, $R_2$ represents an acylamino group, a ureido group, or a urethane group, $R_3$ represents a hydrogen atom, an alkyl group, or an acylamino group, and $R_4$ represents a hydrogen atom or a substituent. $R_3$ and $R_4$ may link together to form a ring. $X_2$ is preferably a hydrogen atom.

$R_2$ is preferably an acylamino group or a ureido group. $R_2$ preferably has 2 to 12 carbon atoms in total, and more preferably 2 to 8 carbon atoms in total. $R_3$ is preferably an alkyl group having 1 to 4 carbon atoms or an acylamino group having 2 to 12 carbon atoms, and more preferably an alkyl group having 2 to 4 carbon atoms or an acylamino group having 2 to 8 carbon atoms. $R_4$ is preferably a halogen atom, an alkoxy group, an acylamino group, or an alkyl group, more preferably a halogen atom or an acylamino group, and particularly preferably a chlorine atom. Concerning the coupler of formula (C-2), the molecular weight is preferably 600 or less, more preferably 500 or less, and even more preferably 400 or less.

In formula (C-3), $X_3$ is a hydrogen atom or a leaving group similar to $X_1$, however $X_3$ is preferably a hydrogen atom. $R_5$ is preferably an acyl group, an oxycarbonyl group, a carbamoyl group, or a sulfamoyl group, and more preferably a carbamoyl group or a sulfamoyl group. $R_5$ is preferably a group having 1 to 12 carbon atoms in total, and more preferably having 2 to 10 carbon atoms. $R_6$ is a hydrogen atom or a substituent, and the substituent is preferably an amido group, a sulfonamido group, a urethane group or a ureido group, and more preferably an amido group or a urethane group. As the substitution position, the 5th or 8th position of a naphthol ring is preferable and the 5th position is more preferable. $R_6$ is preferably a group having 2 to 10 carbon atoms in total, and more preferably having 2 to 6 carbon atoms. Concerning the coupler of formula (C-2), the molecular weight is preferably 550 or less, more preferably 500 or less, and even more preferably 450 or less.

In formula (M-1), $X_4$ is a hydrogen atom or a leaving group similar to $X_1$, however $X_4$ is preferably a hydrogen atom. As the heterocyclic group, an azole group such as a pyrazole group, an imidazole group, a triazole group, a tetrazole group, a benzimidazole group, and a benzotriazole group are preferable, and a pyrazole group is more preferable. $R_7$ is an alkyl group, an aryl group, or a heterocyclic group, each of which may have a substituent. Preferable are a secondary or tertiary alkyl group and an aryl group. As the alkyl group, an alkyl group having 2 to 14 carbon atoms is preferred, and more preferred is an alkyl group having 3 to 10 carbon atoms. As the aryl group, an aryl group having 6 to 18 carbon atoms is preferred, and more preferred is an aryl group having 6 to 14 carbon atoms. $R_8$ is preferably an alkyl group, an aryl group, an alkoxy group, an aryloxy group, an alkylthio group, an arylthio group or a heterocyclic group, each of which may have a substituent. The alkyl group is preferably a secondary or tertiary alkyl group, and more preferably a tertiary alkyl group. The alkyl group preferably has 3 to 12 carbon atoms in total, and more preferably 4 to 8 carbon atoms. The aryl group is preferably a phenyl group, which may have a substituent, and the aryl group preferably has 6 to 16 carbon atoms in total, and more preferably 6 to 12 carbon atoms. As the alkoxy group, an alkoxy group having 1 to 8 carbon atoms is preferable, and an alkoxy group having 1 to 4 carbon atoms is more preferable. As the aryloxy group, an aryloxy group having 6 to 14 carbon atoms is preferable, and an aryloxy group having 6 to 10 carbon atoms is more preferable. The alkylthio group and the arylthio group are preferably the groups having carbon atoms in a similar number to the alkoxy group and the aryloxy group, respectively. Concerning the coupler of formula (M-1), the molecular weight is preferably 700 or less, more preferably 600 or less, and even more preferably 500 or less.

The groups represented by $X_5$, $R_9$, and $R_{10}$ in the coupler of formula (M-2) are similar groups as those represented by $X_4$, $R_7$, and $R_8$ in the coupler of formula (M-1), respectively, and preferable range of each group of them is similar to that of the coupler of formula (M-1).

In formula (M-3), although $X_6$ is a hydrogen atom or a leaving group similar to $X_1$, $X_6$ is preferably a hydrogen atom. As $R_{11}$, an alkyl group, an aryl group, an acylamino group, and an anilino group are preferable, and an acylamino group and an anilino group are more preferable. An anilino group is most preferable. As the alkyl group, an alkyl group having 1 to 8 carbon atoms is preferable. As the aryl group, an aryl group having 6 to 14 carbon atoms is preferable. As the acylamino group, an acylamino group having 2 to 14 carbon atoms is preferable, and an acylamino group having 2 to 10 is more preferable. As the anilino group, an anilino group having 6 to 16 carbon atoms is preferable, and an anilino group having 6 to 12 carbon atoms is more preferable. As a substituent of the anilino group, a halogen atom and an acylamino group are preferable. Concerning the coupler of formula (M-3), the molecular weight is preferably 800 or less, more preferably 700 or less, and even more preferably 600 or less.

In formula (Y-1), although $X_7$ is a hydrogen atom or a leaving group similar to $X_1$, $X_7$ is preferably a hydrogen atom. $R_{13}$ is preferably a secondary or tertiary alkyl group, an aryl group, or a heterocyclic group. The alkyl group may be a cycloalkyl group or a bicycloalkyl group, and a tertiary alkyl group is preferable. A 1-alkylcyclopropyl group, a bicycloalkyl group, and an adamantyl group are particularly preferable. $R_{14}$ is preferably an aryl group or a heterocyclic group, and more preferably an aryl group. Among them, a phenyl group substituted by a halogen atom, an alkoxy group, an aryloxy group, an alkylthio group, or an arylthio group at the 2nd position is particularly preferable. $R_{14}$ preferably has 6 to 18 carbon atoms in total, more preferably 7 to 16 carbon atoms in total, and even more preferably 8 to 14 carbon atoms in total. Concerning the coupler of formula (Y-1), the molecular weight is preferably 700 or less, more preferably 650 or less, and even more preferably 600 or less.

The groups represented by $X_8$ and $R_{15}$ in the coupler of formula (Y-2) are similar to the groups represented by $X_7$ and $R_{14}$ in the coupler of formula (Y-1) respectively, and preferable range of each group of them is similar to that of the coupler of formula (Y-1). Z represents a divalent group necessary to form a 5- to 7-membered ring, and this ring may have a substituent or may be condensed by another ring.

Among the couplers of formula (Y-2), the coupler represented by formula (Y-3) is preferable.

In the coupler of formula (Y-3), $X_9$ has the same meaning as $X_7$ of formula (Y-1), and preferable range thereof is also the same as that of $X_7$ of formula (Y-1). $R_{16}$ is preferably a halogen atom, an alkyl group, an alkoxy group, an acyl group, an acyloxy group, an acylamino group, an alkoxycarbonyl group, a sulfonamido group, a cyano group, a sulfonyl group, a sulfamoyl group, a carbamoyl group, or an alkylthio group, and more preferably a substituent having 1 to 4 carbon atoms. n is preferably an integer of from 0 to 3, more preferably an integer of from 0 to 2, even more preferably 0 or 1, and most preferably 0. $R_{17}$ is preferably a group similar to $R_{16}$, and more preferably a halogen atom, an alkyl group, an alkoxy group, an acylamino group, a sulfonamido group, an alkoxycarbonyl group, a sulfamoyl group, or a sulfonyl group. $R_{17}$ is particularly preferably a halogen atom, an alkoxy group, or an alkylthio group which substitutes at the ortho-position with respect to the —NH— group. An alkylthio group is most preferable. The molecular weight of the coupler of formula (Y-3) is preferably 750 or less, more preferably 700 or less, and even more preferably 650 or less.

Specific examples of the coupler according to the present invention are described below, but the present invention is not limited to these examples.

CC-1

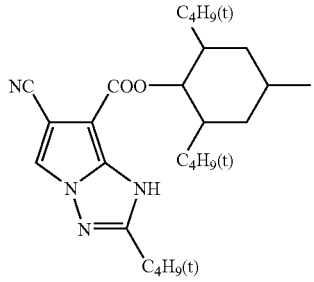

-continued
CC-2
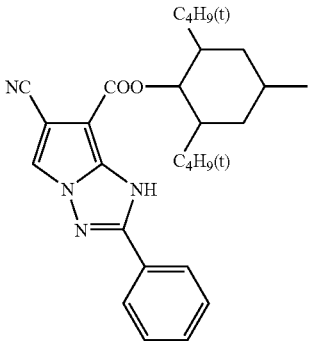
CC-3
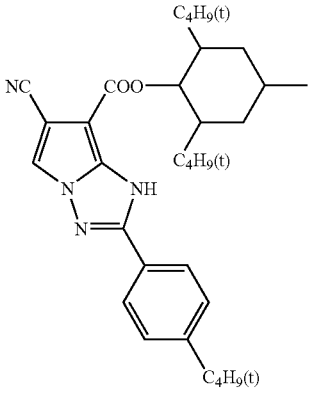
CC-4
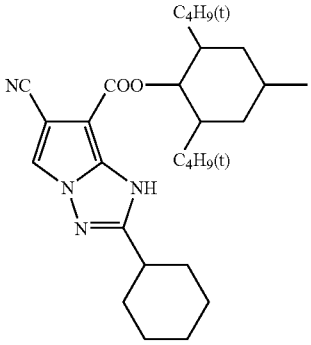
CC-5
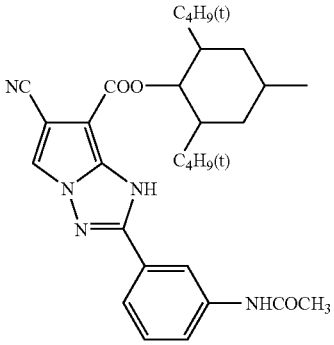
-continued
CC-6
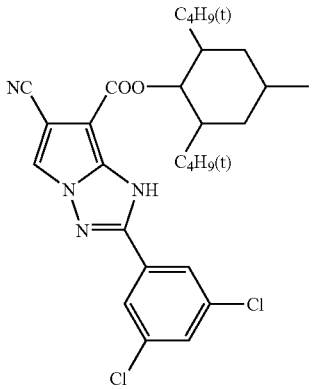
CC-7
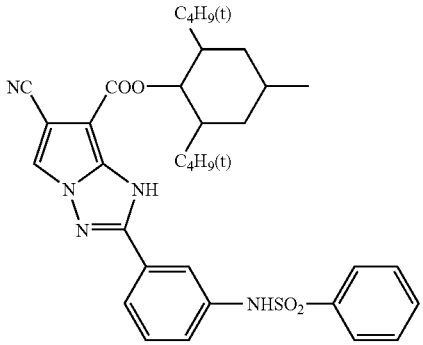
CC-8
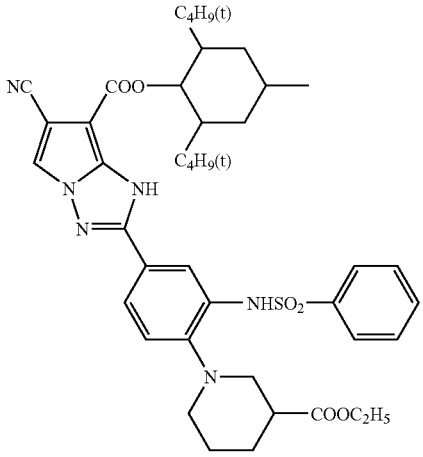
CC-9
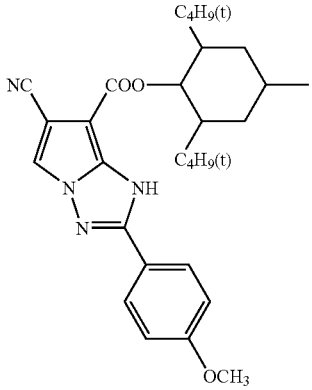

-continued
CC-10
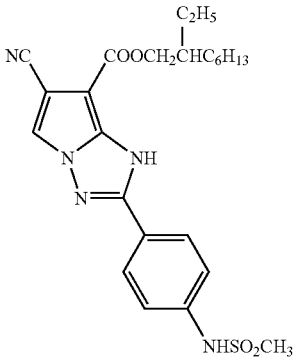
CC-11
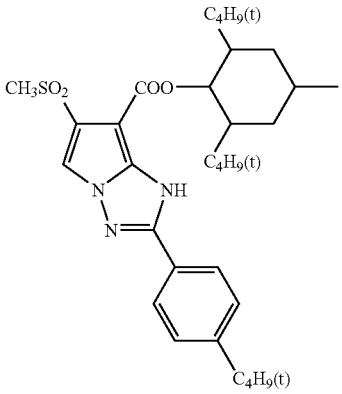
CC-12
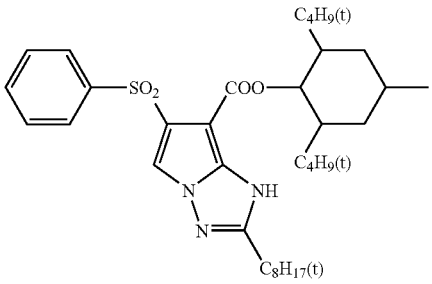
CC-13
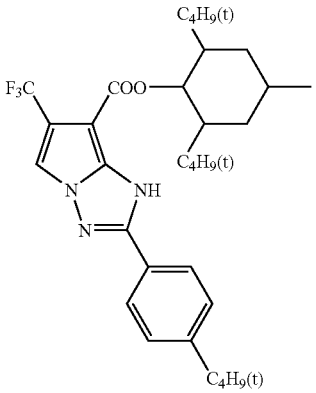
-continued
CC-14
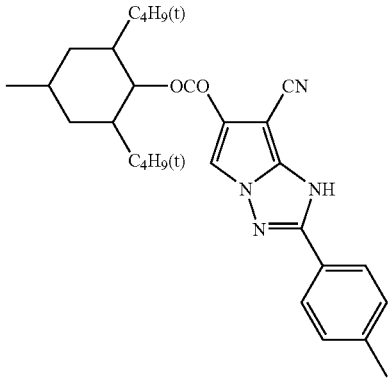
CC-15
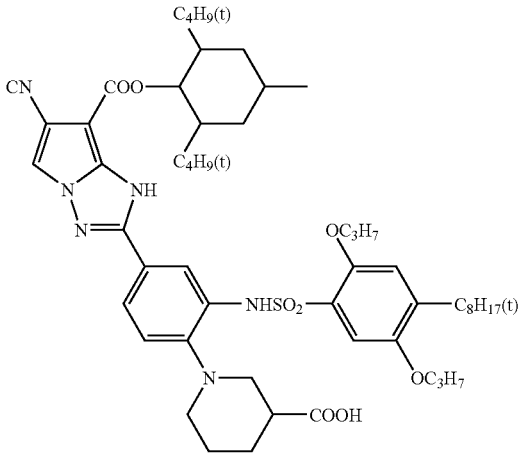
CC-16
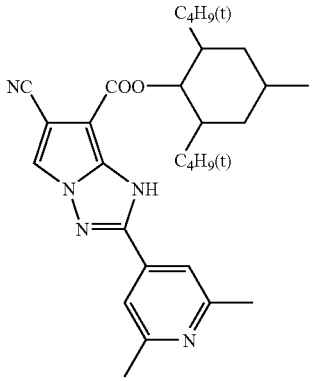

-continued
CC-17
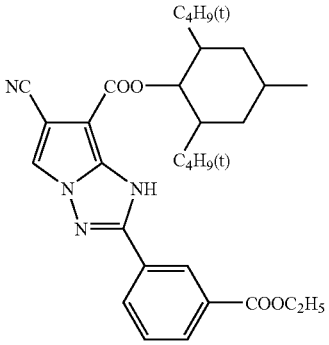
CC-18
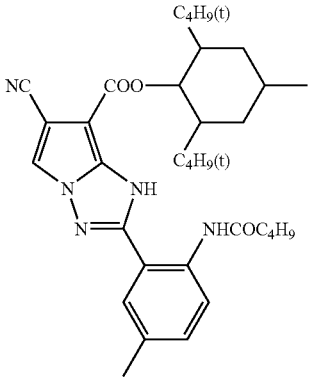
CC-19
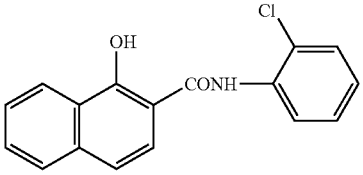
CC-20
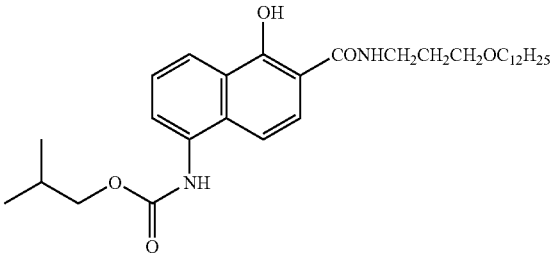
CC-21
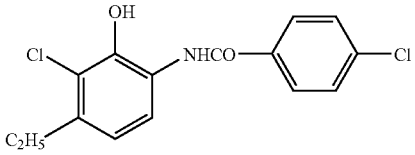
-continued
CC-22
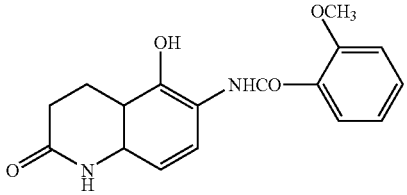
CC-23
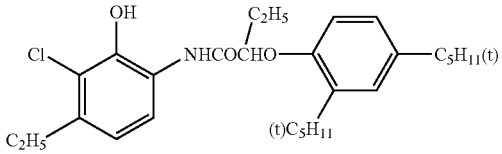
CC-24
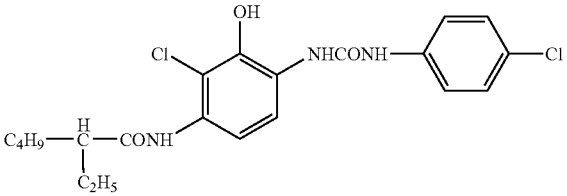
MC-1
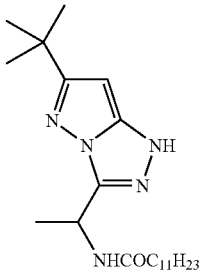
MC-2
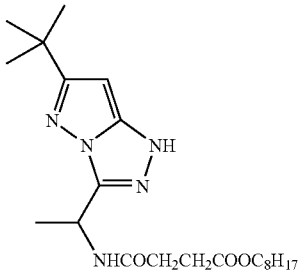

-continued
MC-3
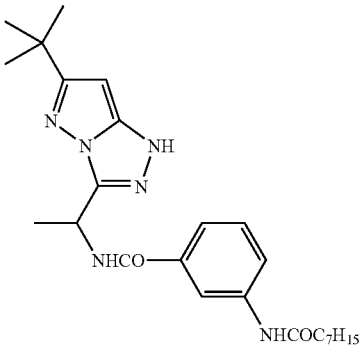
MC-4
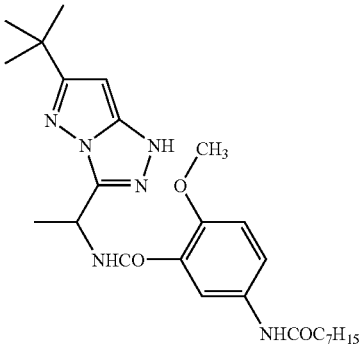
MC-5
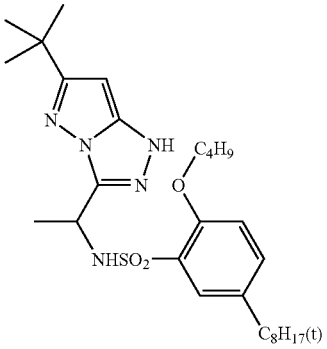
MC-6
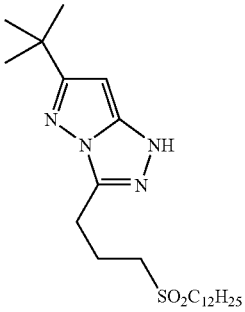
-continued
MC-7
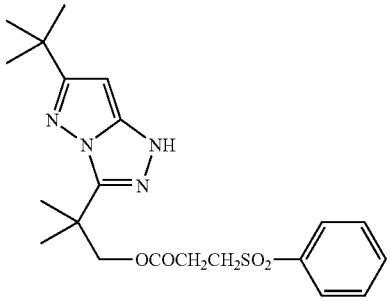
MC-8
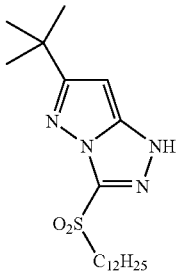
MC-9
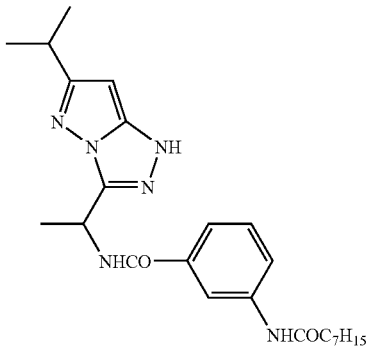
MC-10
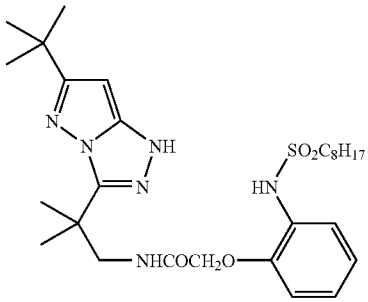

-continued
MC-11
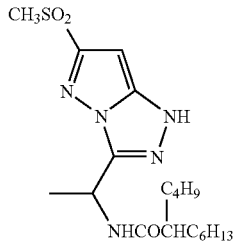
MC-12
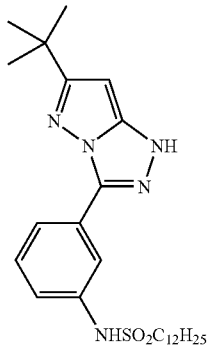
MC-13
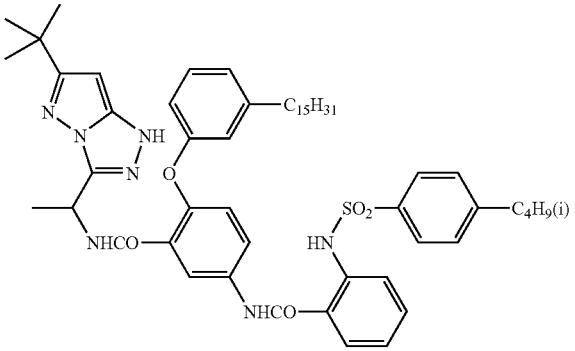
MC-14
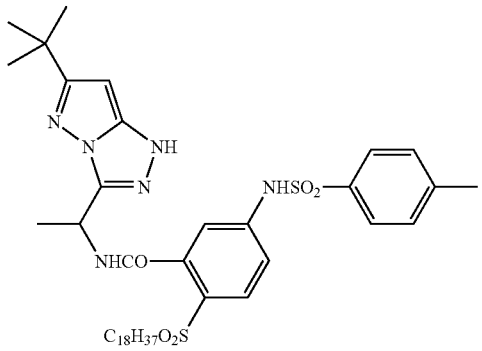
-continued
MC-15
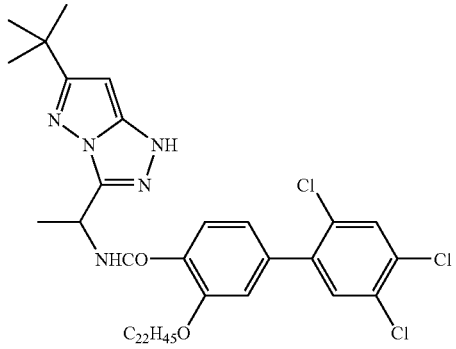
MC-16
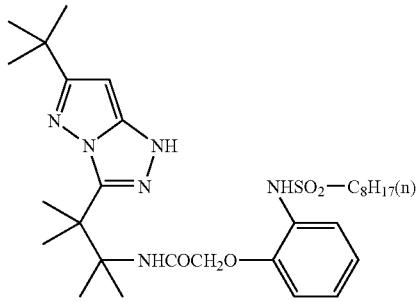
MC-17
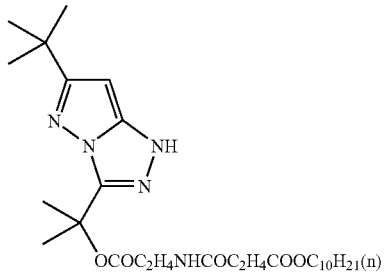
MC-18
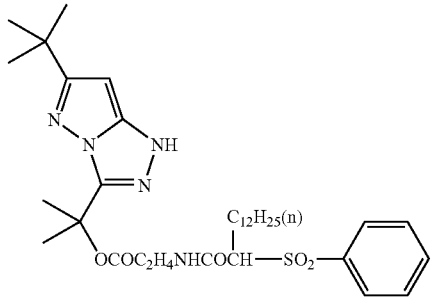

-continued
MC-19
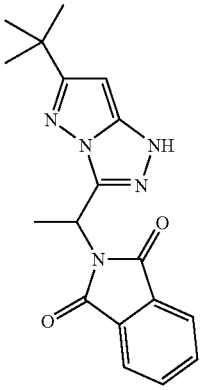
MC-20
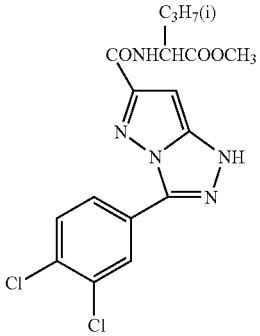
MC-21
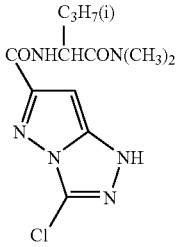
MC-22
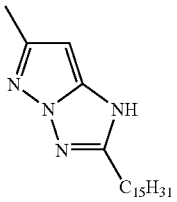
-continued
MC-23
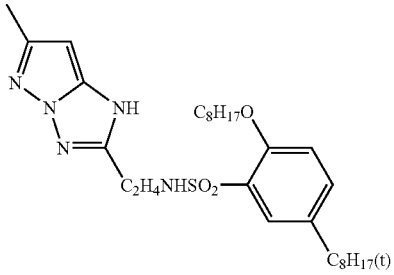
MC-24
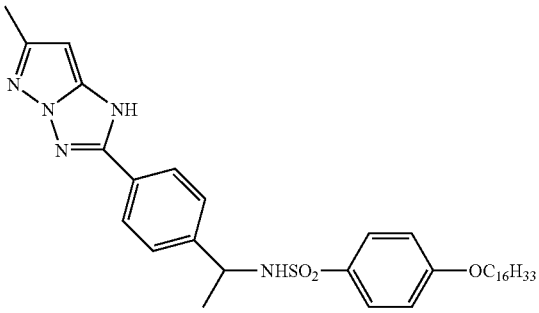
MC-25
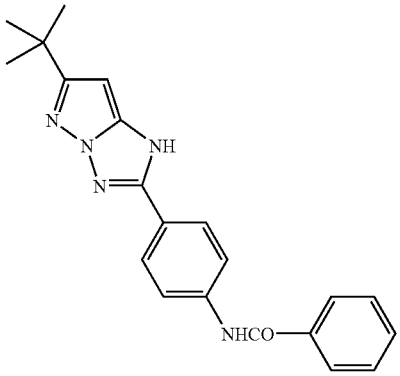
MC-26
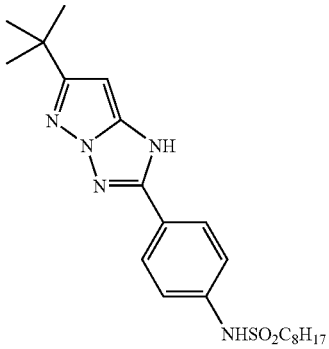

-continued
MC-27
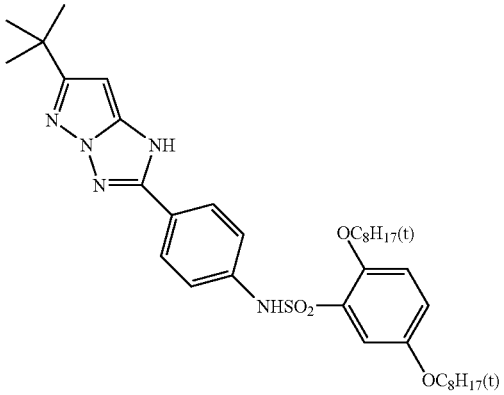
MC-28
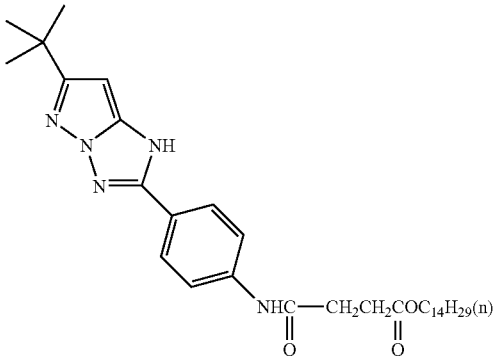
MC-29
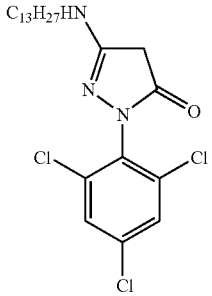
MC-30
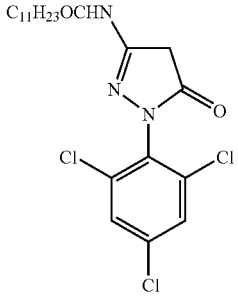
-continued
MC-31
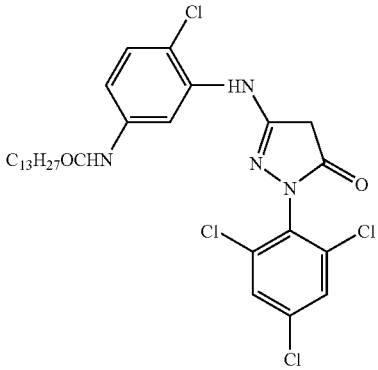
MC-32
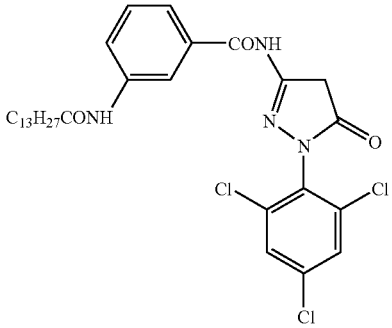
MC-33
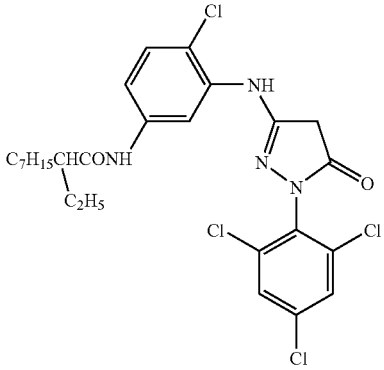
MC-34
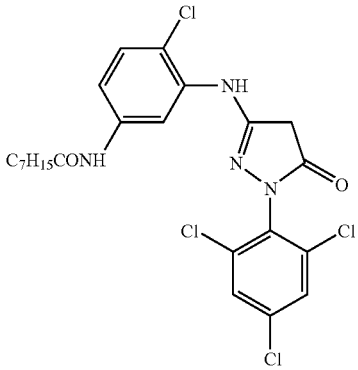

-continued
MC-35
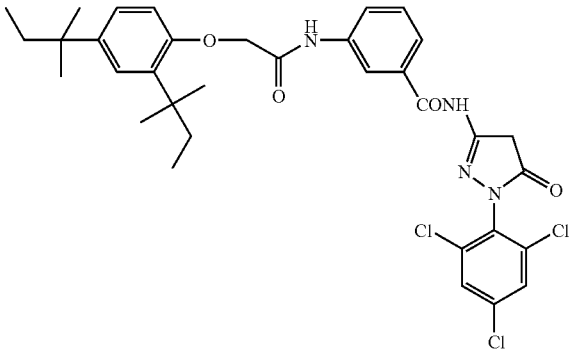
YC-1
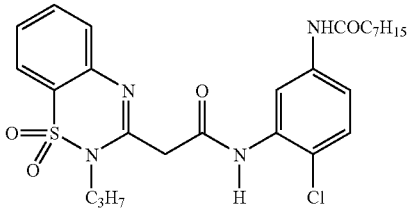
YC-2
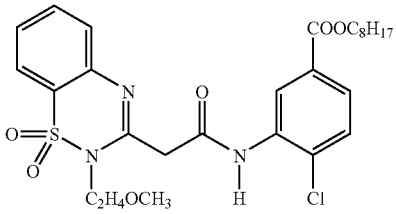
YC-3
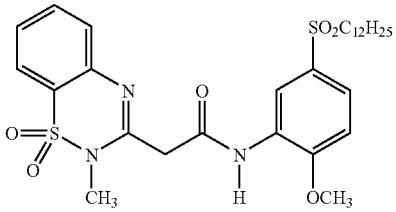
YC-4
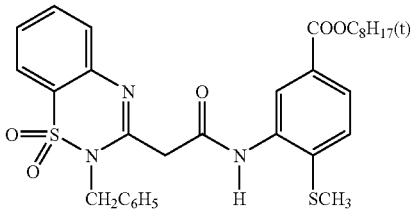
-continued
YC-5
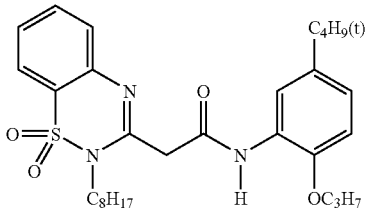
YC-6
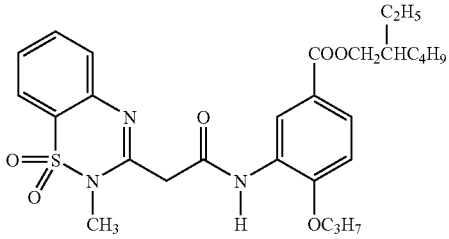
YC-7
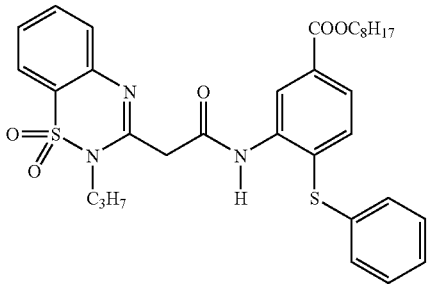
YC-8
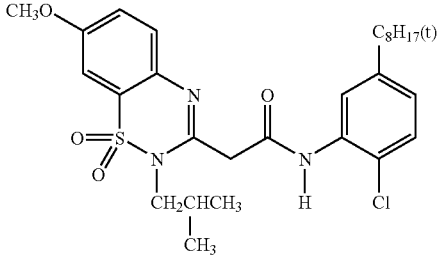
YC-9
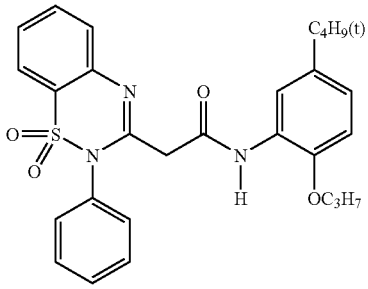
YC-10
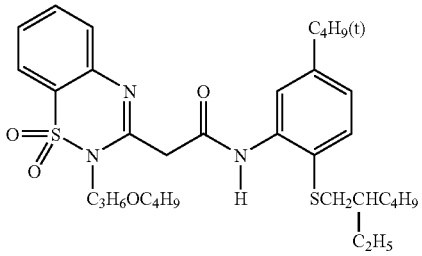

-continued
YC-11
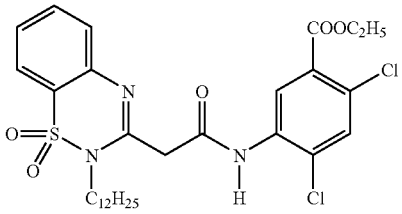
YC-12
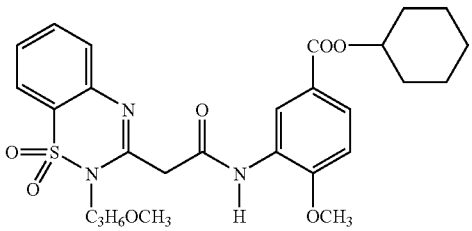
YC-13
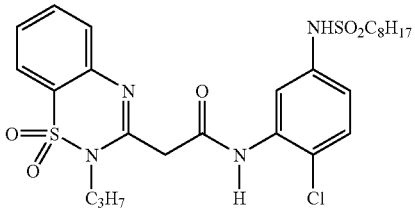
YC-14
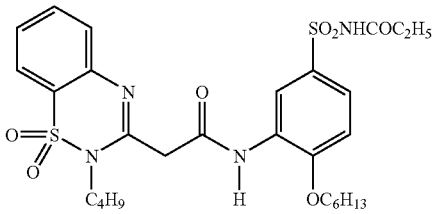
YC-15
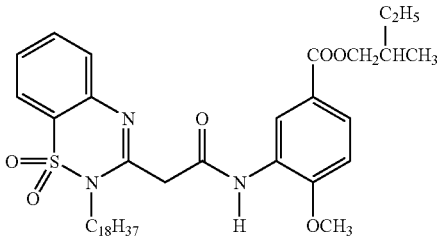
-continued
YC-16
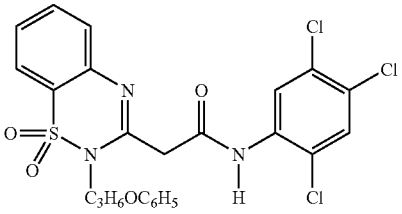
YC-17
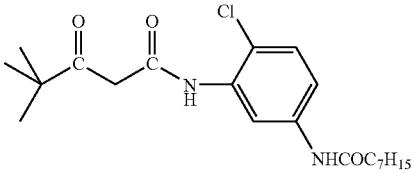
YC-18
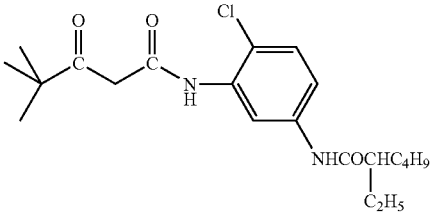
YC-19
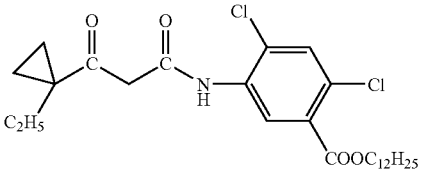
YC-20
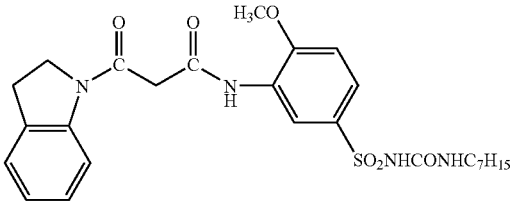
YC-21
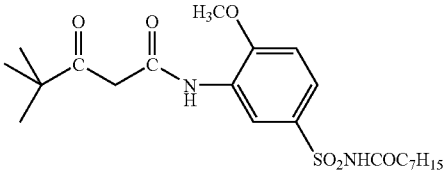
In the above specific examples, compounds in which the coupling position is a hydrogen atom are described, but compounds having the leaving group described above at the coupling position can also be used in the present invention. Specific examples of the coupler having a leaving group are described below.

C-I-1
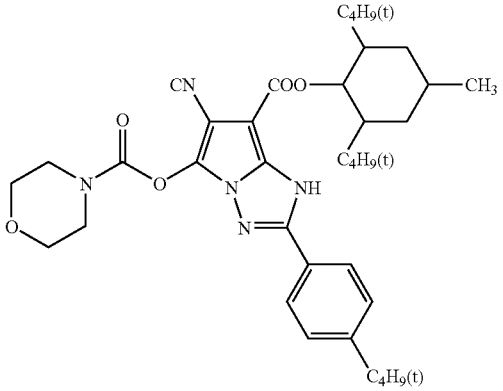
C-I-2
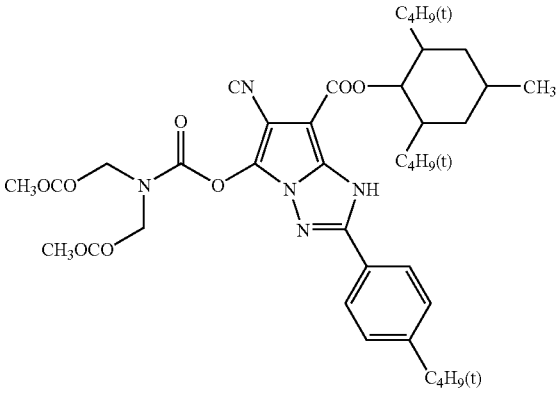
C-I-3
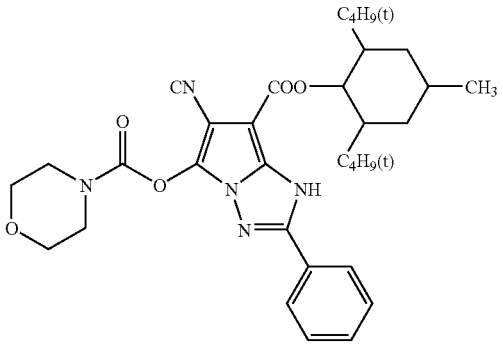
C-I-4
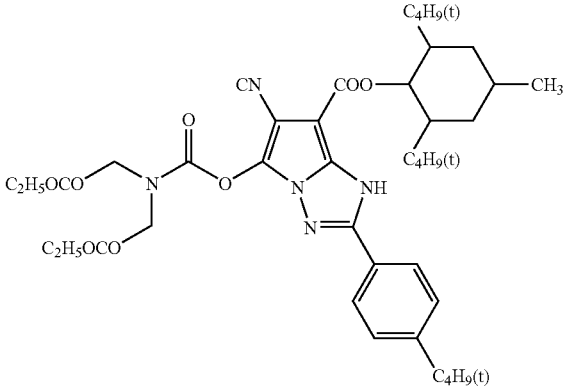
-continued
C-I-5
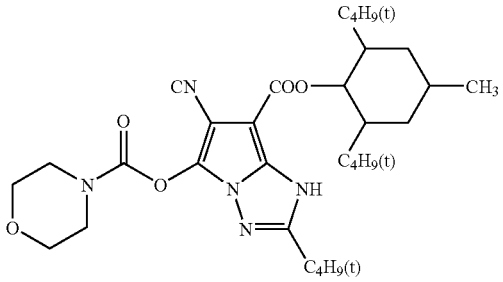
C-I-6
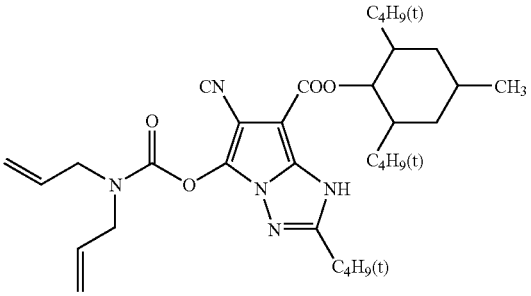
C-I-7
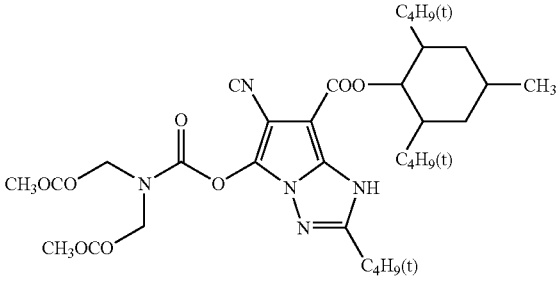
C-I-8
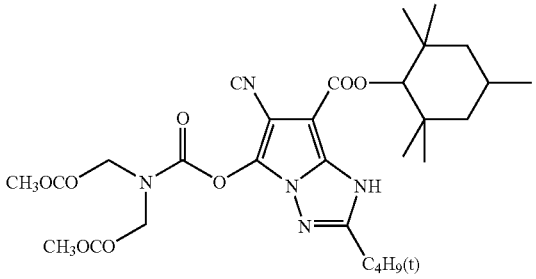
C-I-9
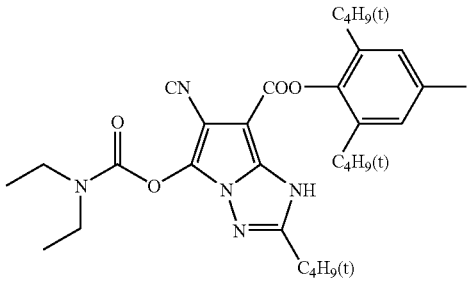

-continued
C-I-10
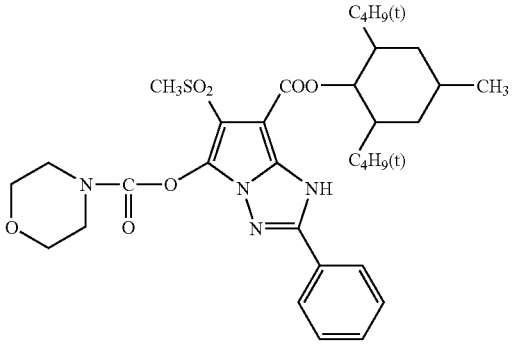
C-I-11
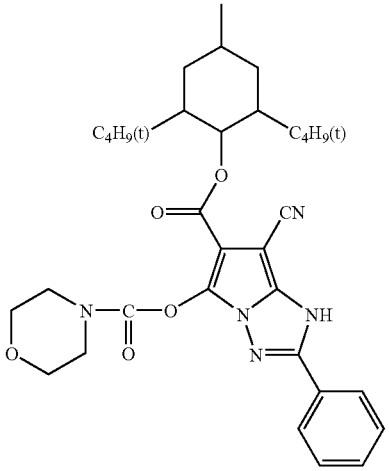
C-II-1
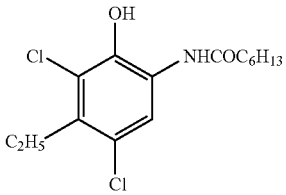
C-II-2
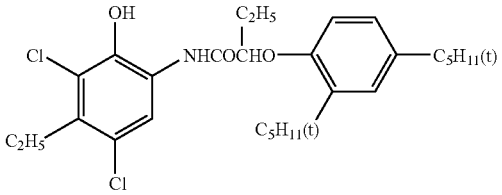
-continued
C-II-3
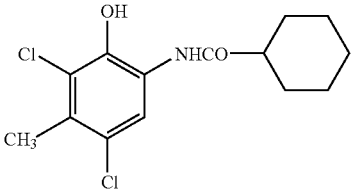
C-II-4
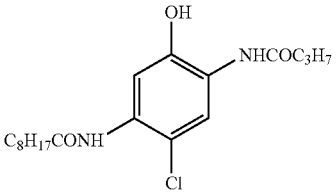
C-III-1
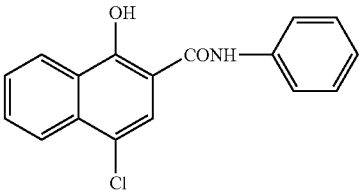
C-III-2
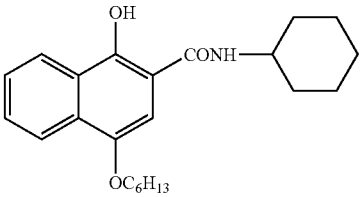
C-III-3
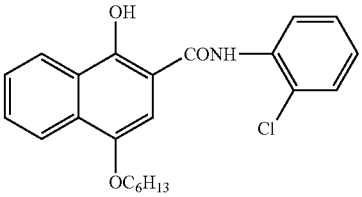
C-III-4
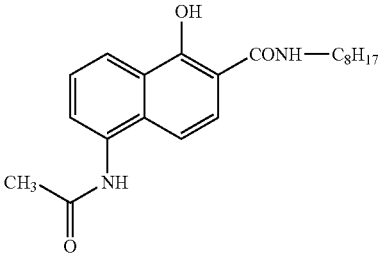

-continued
M-I-1
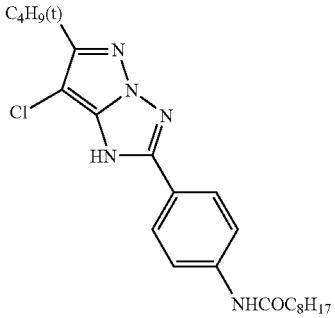
M-I-2
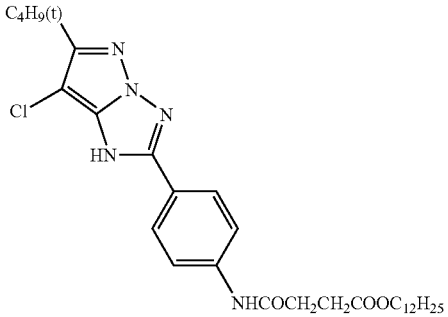
M-I-3
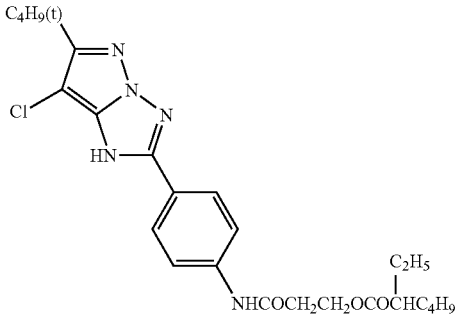
M-I-4
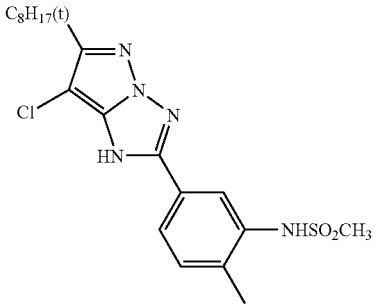
-continued
M-I-5
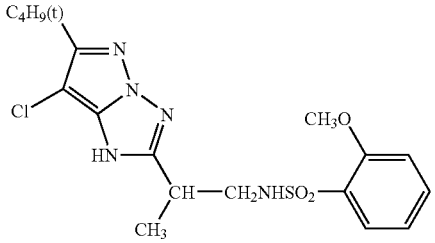
M-I-6
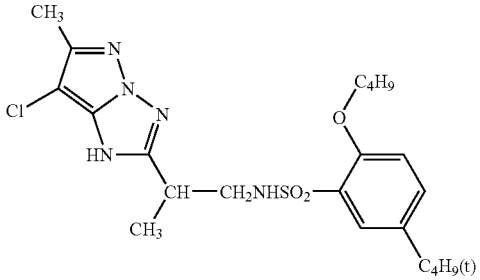
M-II-1
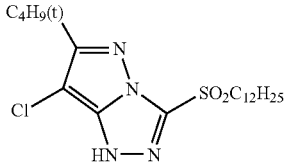
M-II-2
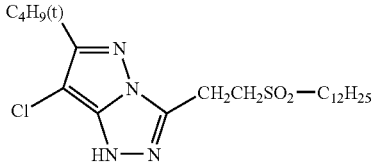
M-II-3
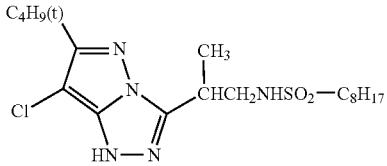
M-II-4
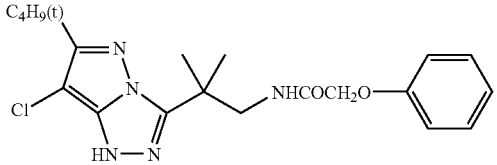

-continued
M-III-1
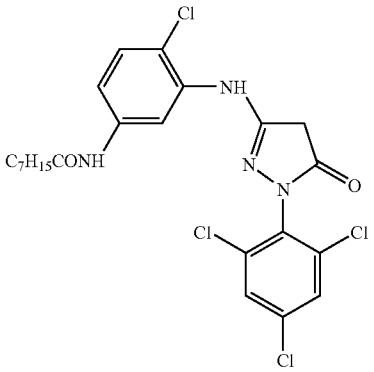
M-III-2
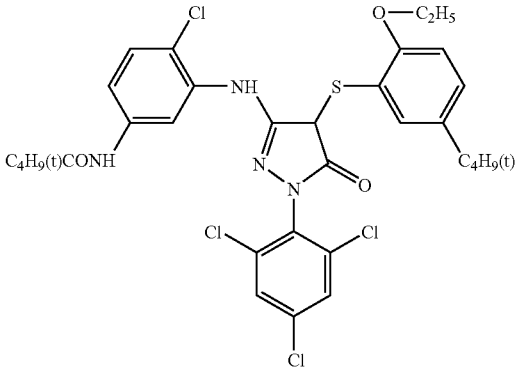
M-III-3
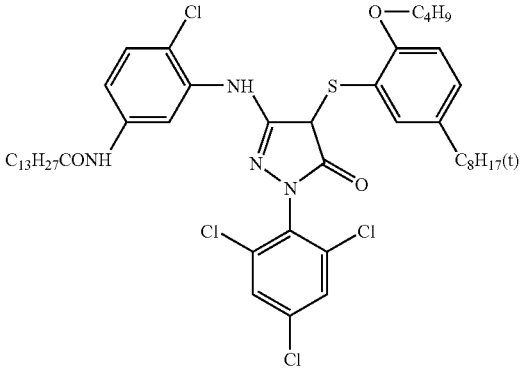
M-III-4
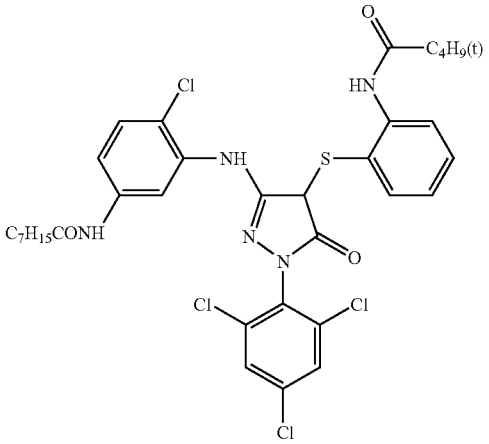
-continued
M-III-5
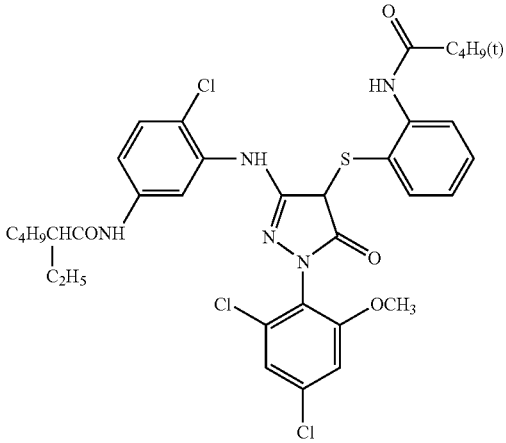
M-III-6
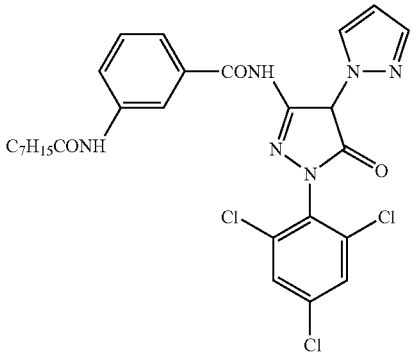
M-III-7
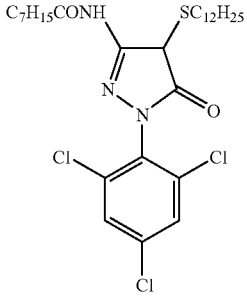
M-III-8
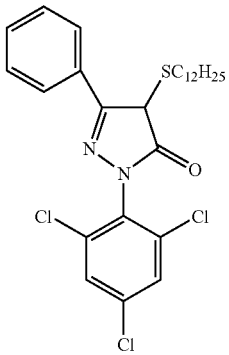

-continued
M-III-9
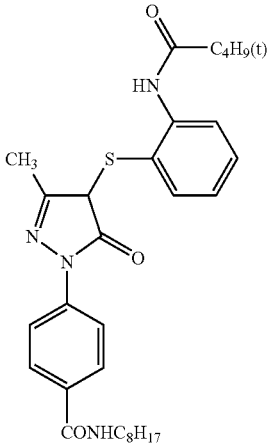
M-III-10
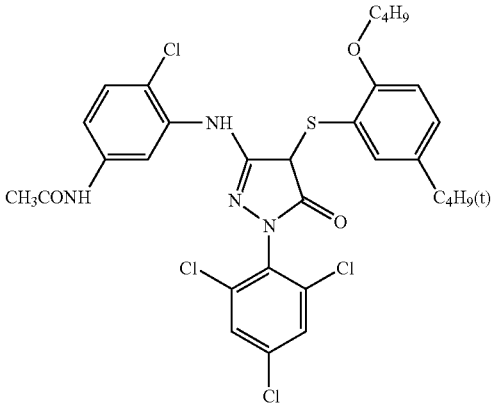
Y-I-1
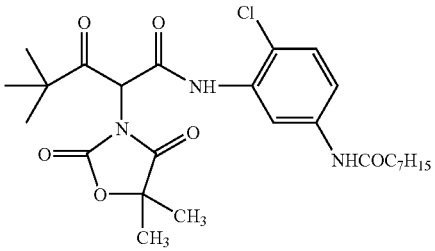
Y-I-2
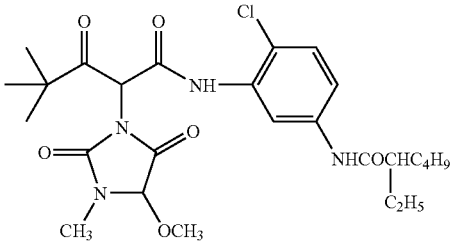
-continued
Y-I-3
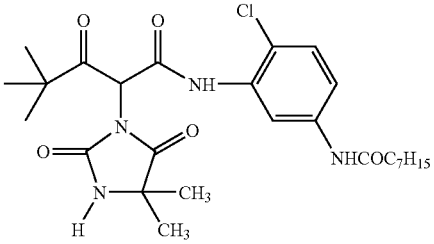
Y-I-7
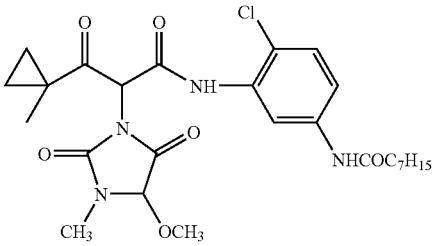
Y-I-8
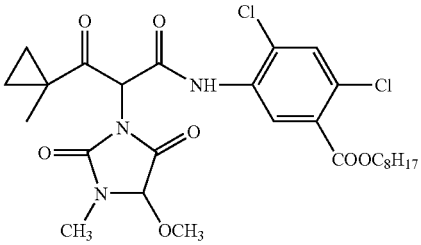
Y-I-9
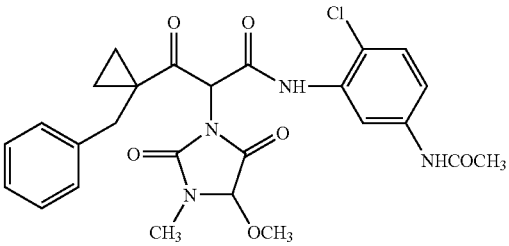
Y-II-1
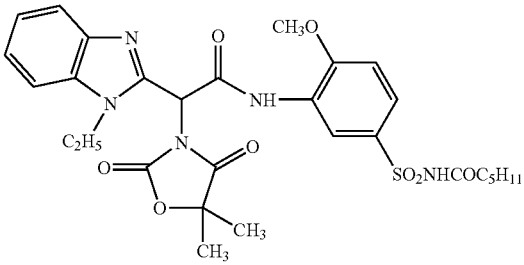

-continued
Y-II-2
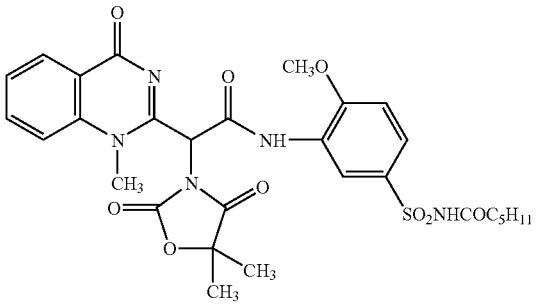
Y-II-3
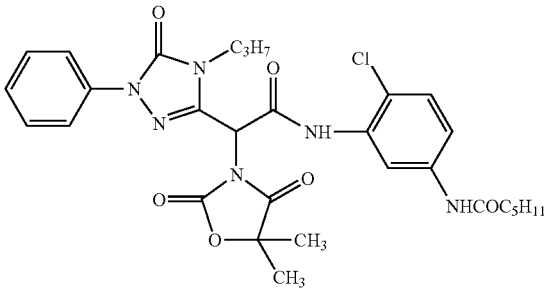
Y-III-1
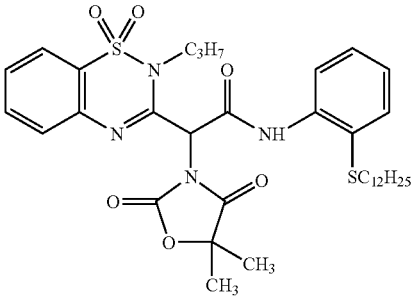
Y-III-2
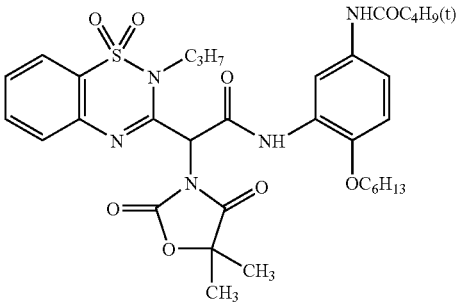
Y-III-3
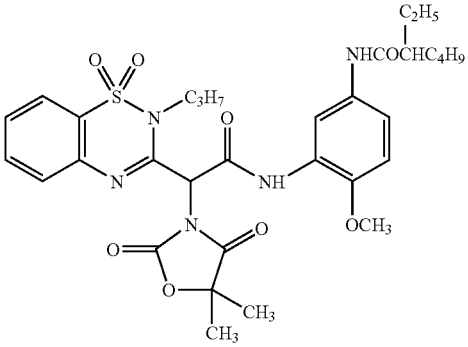
-continued
Y-III-4
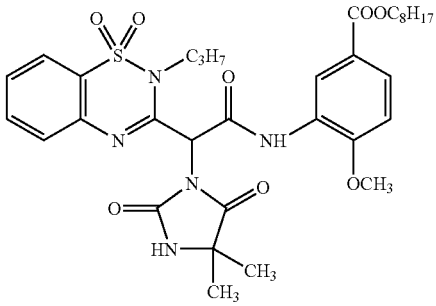
Y-III-5
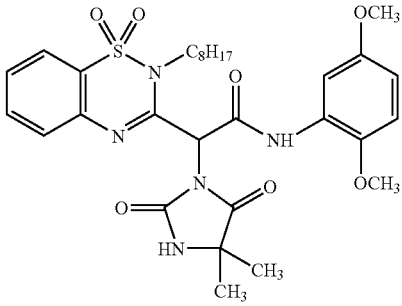
Y-III-6
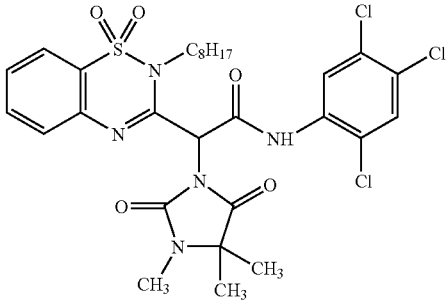
Y-III-7
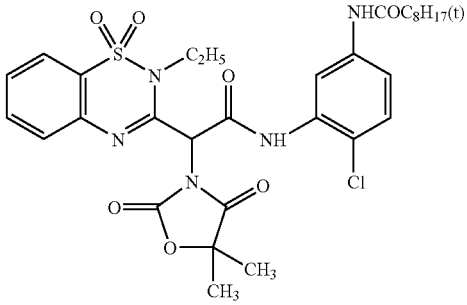
Y-III-8
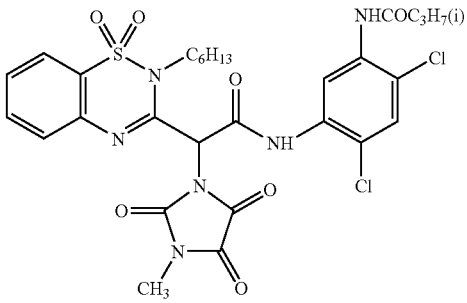

-continued

Y-III-9

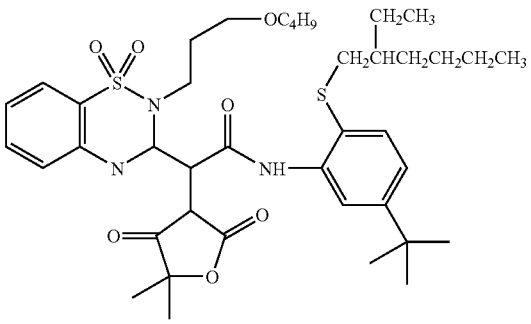

Y-III-10

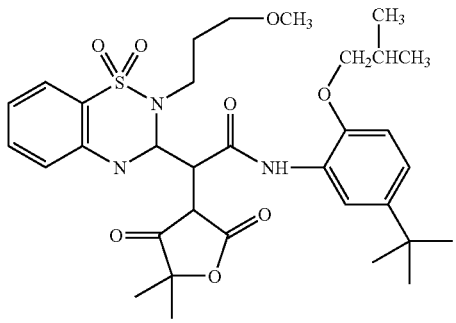

As specific examples other than these, cyan couplers described in U.S. Pat. Nos. 4,873,183 and 4,916,051, and JP-A Nos. 8-171185, 8-311360, and 8-339060, cyan couplers described in U.S. Pat. No. 5,888,716, couplers represented by formula (5), (10), (11), (12), (13), (14), (15), or (16) described in JP-A No. 2001-330923, and couplers which are exemplified for each of them are also preferable, and are applied to this application including these and are preferably used as a part of another specification.

Among the couplers having a leaving group or the couplers in which a hydrogen atom is a leaving group, when the particularly preferable sulfonamido phenol type developing agent is used among the color developing agents according to the present invention, it is more preferred to use the coupler in which the coupling position is a hydrogen atom because it has more excellent color forming property.

The coupler according to the present invention can be added as a solution dissolved in a proper solvent such as methanol or the like; as an emulsified dispersion which is emulsified dispersed by a homogenizer or the like using a surfactant, an auxiliary solvent, and a protective colloid; or as a solid dispersion. It is preferred to add the coupler in the form of a solid fine particle dispersion into the photosensitive emulsion layer (image forming layer) or a non-photosensitive layer which is adjacent to the image forming layer.

Solid fine particle dispersion methods include a method comprising dispersing the powder particles in an aqueous solution containing a dispersing agent or a surfactant under stirring, by means of a beads mill, ball mill, colloid mill, vibrating ball mill, sand mill, jet mill, roller mill, or ultrasonics, thereby obtaining a solid dispersion. As the dispersing agent, there can be used water-soluble polymer such as poly (vinyl alcohol), poly(vinyl pyrrolidone), polyacrylamide, gelatin, or the like; an anionic surfactant such as an alkaline metal salt or an ammonium salt of alkylbenzenesulfonic acid, alkylnaphthalene sulfonic acid, sulfosuccinic acid, oleoyl-N-methyltaurine sulfonic acid, or the like; and a nonionic surfactant such as alkylbenzene polyethoxylate, alkyl polyethoxylate, pluronics, alkyl glucoxylate, or the like. Among these, as the water-soluble polymer, alkylthio-modified poly (vinyl alcohol) and poly(vinyl pyrrolidone) are preferred; and as the anionic surfactant, dodecylbenzene sulfonate, triisopropylnaphthalene sulfonate, and alkyldiphenylether disulfonate are preferred. It is particularly preferred that the water-soluble polymer and the anionic surfactant described above are used in combination. An antiseptic is preferably added for a long-term preservation of the dispersion, and an isothiazolinone type antiseptic is preferable, and benzisothiazolinone sodium salt is particularly preferable. Moreover, an antifoaming agent is preferably used to prevent foaming during dispersion, and from the standpoint of the antifoaming effect, acetylene alcohols is particularly preferable.

A mean particle size of the solid fine particles is preferably in a range of from 0.05 μm to 5 μm, more preferably from 0.1 μm to 2 μm, and even more preferably from 0.2 μm to 1 μm. When the particle size is too large, problems such as filtration clogging, deterioration in coated surface state, or the like occur, and when the particle size is too small, stability of the dispersion is spoiled. From these problems, it is preferred to set the mean size in the above-described range and it is preferred to suppress the particle size distribution low.

In order to put the functions of the compound in a state of solid fine particles efficient at the time of thermal development, the melting point of the coupler according to the present invention is preferably 220° C. or lower, more preferably 200° C. or lower, and even more preferably 180° C. or lower. Moreover, in order to keep the storability of photothermographic material before use good, the melting point of the coupler according to the present invention is preferably 70° C. or higher, more preferably 90° C. or higher, and even more preferably 110° C. or higher. Further, in order to improve the long-term storability of photothermographic material after thermal development, the melting point of the coupler according to the present invention is preferably 100° C. or higher, more preferably 120° C. or higher, and even more preferably 140° C. or higher. In order to improve the stability of the fine solid particle dispersion, the solubility in water of the coupler according to the present invention is preferably 1000 ppm or less, more preferably 200 ppm or less, and even more preferably 50 ppm or less. When a dispersing agent or a surfactant is contained, it is preferred that the solubility of the coupler in the solution containing these is preferably in the above-mentioned range.

In the case where the coupler according to the present invention is used alone, the coupler can be used in a range of from 0.01 mmol/$m^2$ to 3.0 mmol/$m^2$, preferably in a range of from 0.03 mmol/$m^2$ to 2.0 mmol/$m^2$, and most preferably in a range of from 0.05 mmol/$m^2$ to 1.0 mmol/$m^2$. In the case where plural couplers are used, the total amount of the couplers is in a range of from 0.01 mmol/$m^2$ to 5.0 mmol/$m^2$, preferably in a range of from 0.0 3 mmol/$m^2$ to 3.0 mmol/$m^2$, and most preferably in a range of from 0.05 mmol/$m^2$ to 2.0 mmol/$m^2$.

In the present invention, it is preferred to use at least one selected from compounds represented by formula (C-1), (C-2), or (C-3), and it is most preferred to use one selected from compounds represented by formula (C-1) from the viewpoint of forming an image with excellent color tone.

Further, it is preferred to use one selected from compounds represented by formula (M-1), (M-2), or (M-3), or one selected from compounds represented by formula (Y-1), (Y-2), or (Y-3), if necessary.

(Other Coupler)

In the present invention, a coupler represented by formula (BC-1) or (BC-2) is also preferably used. The coupler represented by formula (BC-1) or (BC-2) is a compound which performs a coupling reaction with an oxidation product of the color developing agent according to the present invention by thermal development, and consequently forms a black dye.

Formula (BC-1)

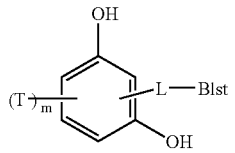

In formula (BC-1), L represents a divalent linking group, and B1st represents a ballast group which causes a coupler molecule to have diffusion resistance. T represents a hydrogen atom or a substituent which leaves upon coupling reaction, and m represents an integer of from 0 to 3.

Formula (BC-2)

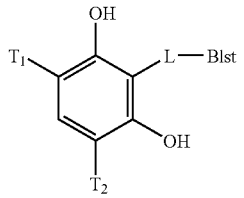

In formula (BC-2), L and B1st each have the same meaning as in formula (BC-1). $T_1$ and $T_2$ each independently represent a hydrogen atom or a substituent which leaves upon coupling reaction.

T, $T_1$, and $T_2$ are each independently a hydrogen atom or a leaving group, and preferably a hydrogen atom.

The term "leaving group" used herein has the same meaning as that described in the explanation of the coupler according to the invention.

The group represented by L-Blst is preferably one selected from the group consisting of —$COR_1$, —$SO_2R_2$, —$COOR_3$, —$NHCOR_4$, —$CONHR_5$, —$CON(R_6)(R_7)$, —$COSO_2R_8$, —$NHCONHR_9$, —$NHSO_2R_{10}$, and —$NHR_{11}$. $R_1$ to $R_{11}$ are a ballast group. The ballast group is the group which gives diffusion resistance for preventing a coupler molecule from moving to other layers from the layer in which the coupler is added. As preferable ballast group, the following groups can be used:

(a) a substituted or unsubstituted phenyl group or naphthyl group; as a substituent, a hydroxy group, a halogen atom (chlorine, bromine, iodine, or the like), an arylsulfonyl halide group, an alkylsulfonyl halide group, a nitro group, a cyano group, an amino group, an alkyl group having 1 to 20 carbon atoms, a substituted alkyl group (an alkyl halide group, an arylalkyl group, or the like), an alkoxy group having 1 to 20 carbon atoms, an alkylthio group having 1 to 20 carbon atoms, and an alkoxycarbonyl group having 1 to 20 carbon atoms are described;

(b) a substituted or unsubstituted alkyl group having 3 to 20 carbon atoms; and (c) a 5- to 10-membered heterocyclic group comprising oxygen, nitrogen, or sulfur; for example, a furyl group, a quinolyl group, a thienyl group, and the like are described.

In addition to the above, as preferable ballast group, there may be a polymer residue. Or, there may be a bis type in which resorcynol groups are bonded to a ballast group symmetrically or asymmetrically.

Particularly, the group represented by L-Blst is preferably —$CONHR_5$ group, wherein $R_5$ is an alkyl group having 3 to 20 carbon atoms, a phenyl group which is substituted by an alkyl group having 1 to 20 carbon atoms, or a phenyl group which is substituted by an alkylaryl group or alkoxy group having 1 to 20 carbon atoms.

The dispersion method of the solid fine particle dispersion using the coupler represented by formula (BC-1) or (BC-2), preferable melting point of the coupler, preferable addition amount thereof, and the like are similar to those of the coupler represented by formula (C-1), (C-2), (C-3), (M-1), (M-2), (M-3), (Y-1), (Y-2), or (Y-3) described above. Specific examples of the coupler represented by formula (BC-1) or (BC-2) used for the present invention are described below, however the present invention is not limited to these compounds.

BC-1

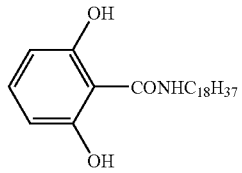

BC-2

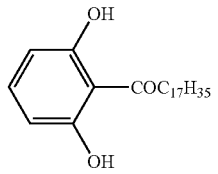

BC-3

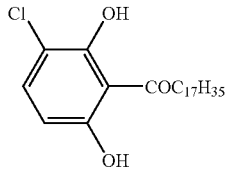

BC-4

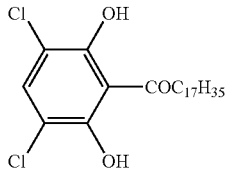

-continued

BC-5

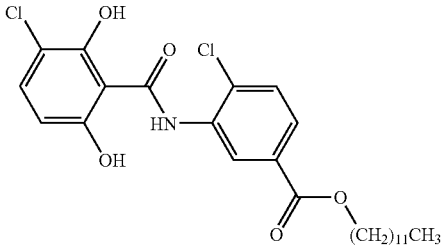

BC-6

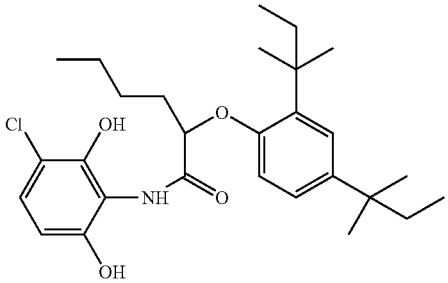

BC-7

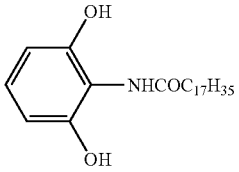

BC-8

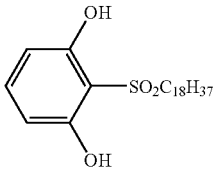

BC-9

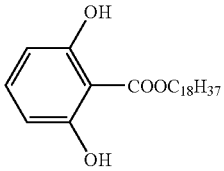

BC-10

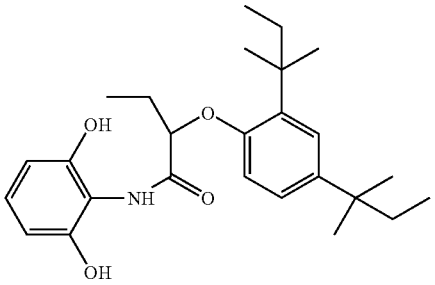

(Polymer Latex)

At least 50% by weight of the binder in the second image forming layer according to the present invention is preferably a polymer latex. More preferably, 65% by weight or more of the binder in the second image forming layer is a polymer latex, and even more preferably 80% by weight or more of the binder in the second image forming layer is a polymer latex. Concerning the polymer latex which can be used in the second image forming layer according to the present invention, descriptions can be found in "Gosei Jushi Emulsion (Synthetic resin emulsion)" (Taira Okuda and Hiroshi Inagaki, Eds., published by Kobunshi Kankokai (1978)), "Gosei Latex no Oyo (Application of synthetic latex)" (Takaaki Sugimura, Yasuo Kataoka, Soichi Suzuki, and Keiji Kasahara, Eds., published by Kobunshi Kankokai (1993)), "Gosei Latex no Kagaku (Chemistry of synthetic latex)" (Soichi Muroi, published by Kobunshi Kankokai (1970)), and the like. More specifically, there are mentioned a latex of methyl methacrylate (33.5% by weight)/ethyl acrylate (50% by weight)/methacrylic acid (16.5% by weight) copolymer, a latex of methyl methacrylate (47.5% by weight)/butadiene (47.5% by weight)/itaconic acid (5% by weight) copolymer, a latex of ethyl acrylate/methacrylic acid copolymer, a latex of methyl methacrylate (58.9% by weight)/2-ethylhexyl acrylate (25.4% by weight)/styrene (8.6% by weight)/2-hydroxyethyl methacrylate (5.1% by weight)/acrylic acid (2.0% by weight) copolymer, a latex of methyl methacrylate (64.0% by weight)/styrene (9.0% by weight)/butyl acrylate (20.0% by weight)/2-hydroxyethyl methacrylate (5.0% by weight)/acrylic acid (2.0% by weight) copolymer, and the like.

Preferred is a polymer latex obtained by copolymerizing a monomer component represented by the following formula (M) within a range of from 10% by weight to 70% by weight.

$$CH_2{=}CR^{01}{-}CR^{02}{=}CH_2 \qquad \text{Formula (M)}$$

In the formula, $R^{01}$ and $R^{02}$ each independently represent a hydrogen atom, a substituted or unsubstituted alkyl group having 1 to 6 carbon atoms, a halogen atom, or a cyano group. More preferably, both of $R^{01}$ and $R^{02}$ represent a hydrogen atom, or one of $R^{01}$ or $R^{02}$ represents a hydrogen atom and the other represents a methyl group.

More preferably, the polymer latex contains the monomer component represented by formula (M) within a range of from 20% by weight to 60% by weight.

<Specific Examples of Latex>

Specific examples of preferred polymer latexes are given below, which are expressed by the starting monomers with % by weight given in parenthesis. The molecular weight is given in number average molecular weight.

In the case where polyfunctional monomer is used, the concept of molecular weight is not applicable because they build a crosslinked structure. Hence, they are denoted as "crosslinking", and the description of the molecular weight is omitted. Tg represents glass transition temperature.

P-1; Latex of -MMA(70)-EA(27)-MAA(3)—(molecular weight 37000, Tg 61° C.)

P-2; Latex of -MMA(70)-2EHA(20)-St(5)-AA(5)—(molecular weight 40000, Tg 59° C.)

P-3; Latex of -St(50)-Bu(47)-MAA(3)—(crosslinking, Tg −17° C.)

P-4; Latex of -St(68)-Bu(29)-AA(3)—(crosslinking, Tg 17° C.)

P-5; Latex of -St(71)-Bu(26)-AA(3)—(crosslinking, Tg 24° C.)

P-6; Latex of -St(70)-Bu(27)-IA(3)—(crosslinking)

P-7; Latex of -St(75)-Bu(24)-AA(1)—(crosslinking, Tg 29° C.)

P-8; Latex of -St(60)-Bu(35)-DVB(3)-MAA(2)—(crosslinking)

P-9; Latex of -St(70)-Bu(25)-DVB(2)-AA(3)—(crosslinking)

P-10; Latex of -VC(50)-MMA(20)-EA(20)-AN(5)-AA(5)—(molecular weight 80000)

P-11; Latex of -VDC(85)-MMA(5)-EA(5)-MAA(5)—(molecular weight 67000)

P-12; Latex of -Et(90)-MAA(10)—(molecular weight 12000)

P-13; Latex of -St(70)-2EHA(27)-AA(3)—(molecular weight 130000, Tg 43° C.)

P-14; Latex of -MMA(63)-EA(35)-AA(2)—(molecular weight 33000, Tg 47° C.)

P-15; Latex of -St(70.5)-Bu(26.5)-AA(3)—(crosslinking, Tg 23° C.)

P-16; Latex of -St(69.5)-Bu(27.5)-AA(3)—(crosslinking, Tg 20.5° C.)

P-17; Latex of -St(61.3)-Isoprene(35.5)-AA(3)—(crosslinking, Tg 17° C.)

P-18; Latex of -St(67)-Isoprene(28)-Bu(2)-AA(3)—(crosslinking, Tg 27° C.)

In the structures above, abbreviations represent monomers as follows. MMA: methyl methacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, IA: itaconic acid.

The polymer latexes described above are also commercially available, and polymers below can be used. Examples of acrylic polymer include Cevian A-4635, 4718, and 4601 (all manufactured by Daicel Chemical Industries, Ltd.), Nipol Lx811, 814, 821, 820, and 857 (all manufactured by Nippon Zeon Co., Ltd.), and the like; examples of polyesters include FINETEX ES650, 611, 675, and 850 (all manufactured by Dainippon Ink and Chemicals, Inc.), WD-size and WMS (all manufactured by Eastman Chemical Co.), and the like; examples of polyurethanes include HYDRAN AP10, 20, 30, and 40 (all manufactured by Dainippon Ink and Chemicals, Inc.), and the like; examples of rubbers include LACSTAR 7310K, 3307B, 4700H, and 7132C (all manufactured by Dainippon Ink and Chemicals, Inc.), Nipol Lx416, 410, 438C, and 2507 (all manufactured by Nippon Zeon Co., Ltd.), and the like; examples of poly(vinyl chlorides) include G351 and G576 (all manufactured by Nippon Zeon Co., Ltd.), and the like; examples of poly(vinylidene chlorides) include L502 and L513 (all manufactured by Asahi Chemical Industry Co., Ltd.), and the like; and examples of polyolefins include Chemipearl S120 and SA100 (all manufactured by Mitsui Petrochemical Industries, Ltd.), and the like.

The polymer latex above may be used alone, or may be used by blending two or more of them depending on needs.

In the second image forming layer according to the invention, if necessary, there may be added hydrophilic polymers such as gelatin, poly(vinyl alcohol), methyl cellulose, hydroxypropyl cellulose, carboxymethyl cellulose, or the like. The hydrophilic polymer is preferably added in an amount of 30% by weight or less, and more preferably 20% by weight or less, with respect to the total weight of the binder incorporated in the second image forming layer.

The total amount of binder in the second image forming layer according to the invention is preferably in a range of from 0.2 g/m$^2$ to 10.0 g/m$^2$, and more preferably from 0.5 g/m$^2$ to 5.0 g/m$^2$. There may be added a crosslinking agent for crosslinking, a surfactant to improve coating ability, or the like into the second image forming layer according to the invention.

(Non-Photosensitive Organic Silver Salt)

1) Composition

The non-photosensitive organic silver salt which can be used in the present invention is relatively stable to light but serves to supply silver ions and forms silver images when heated to 80° C. or higher in the presence of an exposed photosensitive silver halide and a reducing agent. The non-photosensitive organic silver salt which can be used in the present invention is preferably a silver salt of a long-chained aliphatic carboxylic acid having 10 to 30 carbon atoms, and more preferably having 15 to 28 carbon atoms. Preferred examples of the silver salt of a fatty acid include silver lignocerate, silver behenate, silver arachidinate, silver stearate, silver oleate, silver laurate, silver capronate, silver myristate, silver palmitate, silver erucate, and mixtures thereof. In the invention, among these silver salts of a fatty acid, it is preferred to use a silver salt of a fatty acid with a silver behenate content of 50 mol % or higher, more preferably 85 mol % or higher, and even more preferably 95 mol % or higher. Further, it is preferred to use a silver salt of a fatty acid with a silver erucate content of 2 mol % or lower, more preferably, 1 mol % or lower, and even more preferably, 0.1 mol % or lower.

It is preferred that the content of silver stearate is 1 mol % or lower. When the content of silver stearate is 1 mol % or lower, a silver salt of an organic acid having low fog, high sensitivity and excellent image storability is obtained. The above-mentioned content of silver stearate is preferably 0.5 mol % or lower, and particularly preferably, silver stearate is not substantially contained.

Further, in the case where the silver salt of a fatty acid includes silver arachidinate, it is preferred that the content of silver arachidinate is 6 mol % or lower from the viewpoint of obtaining a silver salt having low fog and excellent image storability. The content of silver arachidinate is more preferably 3 mol % or lower.

2) Shape

There is no particular restriction on the shape of the organic silver salt that can be used in the invention, and it may be needle-like, rod-like, tabular, or flake shaped.

In the invention, a flake shaped organic silver salt is preferred. Short needle-like, rectangular, cubic, or potato-like indefinite shaped particles with a length ratio of major axis relative to minor axis being 5 or lower are also used preferably. Such organic silver salt particles suffer less from fogging during thermal development compared with long needle-like particles with the length ratio of major axis relative to minor axis being higher than 5. Particularly, a particle with the length ratio of major axis relative to minor axis being 3 or lower is preferred since it can improve mechanical stability of the coated film. In the present specification, the flake shaped organic silver salt is defined as described below. When an organic silver salt is observed under an electron microscope, calculation is made while approximating the shape of a particle of the organic silver salt to a rectangular body, designating respective sides of the rectangular body as a, b, c from the shortest side (c may be identical with b.), and determining x based on the numerical values a and b for the shorter sides as follows.

$$x=b/a$$

In this manner, x is determined for about 200 particles, and those satisfying the relationship of x (average)≧1.5 based on an average value x are defined as flake shaped. The relationship is preferably 30≧x (average)≧1.5, and more preferably, 15≧x (average)≧1.5. Incidentally, needle-like is expressed as 1≦x (average)<1.5.

In the flake shaped particle, a can be regarded as a thickness of a tabular particle having a major plane with b and c being as the sides. a in average is preferably from 0.01 μm to 0.3 μm and, more preferably from 0.1 μm to 0.23 μm. c/b in average is preferably from 1 to 9, more preferably from 1 to 6, even more preferably from 1 to 4 and, most preferably from 1 to 3.

By controlling the equivalent spherical diameter being from 0.05 μm to 1 μm, it causes less agglomeration in the photothermographic material and image storability is improved. The equivalent spherical diameter is preferably from 0.1 μm to 1 μm.

In the invention, an equivalent spherical diameter can be measured by a method of photographing a sample directly by using an electron microscope and then image processing the negative images.

In the flake shaped particle, the equivalent spherical diameter of the particle/a is defined as an aspect ratio. The aspect ratio of the flake shaped particle is preferably from 1.1 to 30, and more preferably from 1.1 to 15 with a viewpoint of causing less agglomeration in the photothermographic material and improving the image storability.

As the particle size distribution of the organic silver salt, mono-dispersion is preferred. In the mono-dispersion, the percentage for the value obtained by dividing the standard deviation for the lengths of the minor axis and the major axis by the minor axis and the major axis respectively is preferably 100% or less, more preferably 80% or less, and even more preferably 50% or less. The shape of the organic silver salt can be measured by analyzing a dispersion of an organic silver salt as transmission type electron microscopic images. Another method of measuring the mono-dispersion is a method of determining the standard deviation of the volume-weighted mean diameter of the organic silver salt in which the percentage for the value defined by the volume-weighted mean diameter (variation coefficient) is preferably 100% or less, more preferably 80% or less, and even more preferably 50% or less. The mono-dispersion can be determined from particle size (volume-weighted mean diameter) obtained, for example, by a measuring method of irradiating a laser beam to organic silver salts dispersed in a liquid, and determining a self correlation function of the fluctuation of scattered light with respect to the change in time.

3) Preparation

Methods known in the art can be applied to the method for producing the organic silver salt used in the invention and to the dispersion method thereof. For example, reference can be made to JP-A No. 10-62899, EP Nos. 803,763A1 and 962, 812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870, and 2002-107868, and the like.

When a photosensitive silver salt is present together during dispersion of the organic silver salt, fog increases and sensitivity becomes remarkably lower, so that it is more preferred that the photosensitive silver salt is not substantially contained during dispersion. In the invention, the amount of the photosensitive silver salt to be dispersed in the aqueous dispersion is preferably 1 mol % or less, more preferably 0.1 mol % or less, with respect to 1 mol of the organic silver salt in the solution, and even more preferably, positive addition of the photosensitive silver salt is not conducted.

In the invention, the photothermographic material can be manufactured by preparing each of an aqueous dispersion of the organic silver salt and an aqueous dispersion of a photosensitive silver salt independently, and thereafter mixing them. A method of mixing two or more aqueous dispersions of organic silver salts and two or more aqueous dispersions of photosensitive silver salts is preferably used for controlling photographic properties.

4) Addition Amount

While the non-photosensitive organic silver salt according to the invention can be used in a desired amount, a total amount of coated silver including also the silver halide is preferably in a range of from 0.05 g/m$^2$ to 3.0 g/m$^2$, more preferably from 0.1 g/m$^2$ to 1.8 g/m$^2$, and even more preferably from 0.2 g/m$^2$ to 1.2 g/m$^2$.

(Photosensitive Silver Halide)

1) Halogen Composition

For the photosensitive silver halide used in the invention, there is no particular restriction on the halogen composition, and silver chloride, silver bromochloride, silver bromide, silver iodobromide, silver iodochlorobromide, or silver iodide can be used. Among these, silver bromide, silver iodobromide, and silver iodide are preferred.

The distribution of the halogen composition in a grain may be uniform, the halogen composition may be changed stepwise, or it may be changed continuously.

Further, a silver halide grain having a core/shell structure can be used preferably. Preferred structure is a twofold to fivefold structure, and more preferably, a core/shell grain having a twofold to fourfold structure can be used. Further, a technique of localizing silver bromide or silver iodide at the surface of a silver chloride, silver bromide, or silver chlorobromide grain can also be used preferably.

2) Method of Grain Formation

The method of forming photosensitive silver halide is well known in the relevant art and, for example, methods described in Research Disclosure No. 17029, June 1978 and U.S. Pat. No. 3,700,458 can be used. Specifically, a method of preparing a photosensitive silver halide by adding a silver-supplying compound and a halogen-supplying compound in a gelatin or other polymer solution and then mixing them with an organic silver salt is used. Further, a method described in JP-A No. 11-119374 (paragraph Nos. 0217 to 0224) and methods described in JP-A Nos. 11-352627 and 2000-347335 are also preferred.

3) Grain Size

The grain size of the photosensitive silver halide is preferably small for the purpose of suppressing clouding after image formation, and specifically, it is 0.20 μm or less, more preferably in a range of from 0.01 μm to 0.15 μm, and even more preferably from 0.02 μm to 0.12 μm. The grain size as used herein means a diameter of a circle converted such that it has the same area as a projected area of the silver halide grain (projected area of a major plane in a case of a tabular grain).

4) Grain Shape

The shape of the silver halide grain includes, for example, cubic, octahedral, tabular, spherical, rod-like, and potato-like shape. A cubic grain is particularly preferred in the invention. A silver halide grain rounded at corners can also be used preferably. The surface indices (Miller indices) of the outer surface of a photosensitive silver halide grain are not particularly restricted, and it is preferable that the ratio occupied by the {100} face is large, because of showing high spectral sensitization efficiency when a spectral sensitizing dye is adsorbed. The ratio is preferably 50% or higher, more preferably 65% or higher, and even more preferably 80% or higher. The ratio of the {100} face, Miller indices, can be determined by a method utilizing adsorption dependency of the {111 } face and {100} face in adsorption of a sensitizing dye, which is described in T. Tani; J. Imaging Sci., vol. 29, page 165, (1985).

5) Heavy Metal

The photosensitive silver halide grain according to the invention can contain metals or complexes of metals belonging to groups 6 to 13 of the periodic table (showing groups 1 to 18). Preferably, the photosensitive silver halide grain can contain metals or complexes of metals belonging to groups 6 to 10. The metal or the center metal of the metal complex from groups 6 to 10 of the periodic table is preferably rhodium, ruthenium, iridium, or ferrum. The metal complex may be used alone, or two or more complexes comprising identical or different species of metals may be used in combination. A preferred content is in a range of from $1\times10^{-9}$ mol to $1\times10^{-3}$ mol with respect to 1 mol of silver. The heavy metals, metal complexes, and the addition method thereof are described in JP-A No. 7-225449, in paragraph Nos. 0018 to 0024 of JP-A No. 11-65021, and in paragraph Nos. 0227 to 0240 of JP-A No. 11-119374.

In the present invention, a silver halide grain having a hexacyano metal complex present on the outermost surface of the grain is preferred. The hexacyano metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, and $[Re(CN)_6]^{3-}$.

In the invention, hexacyano Fe complex is preferred.

Since the hexacyano metal complex exists in an ionic form in an aqueous solution, counter cation is not important, but an alkali metal ion such as sodium ion, potassium ion, rubidium ion, cesium ion, or lithium ion, ammonium ion, or an alkyl ammonium ion (for example, tetramethyl ammonium ion, tetraethyl ammonium ion, tetrapropyl ammonium ion, and tetra(n-butyl) ammonium ion), which are easily miscible with water and suitable to precipitation operation of silver halide emulsion, are preferably used.

The hexacyano metal complex can be added while being mixed with water, as well as a mixed solvent of water and an appropriate organic solvent miscible with water (for example, alcohols, ethers, glycols, ketones, esters, amides, or the like) or gelatin.

The addition amount of the hexacyano metal complex is preferably from $1\times10^{-5}$ mol to $1\times10^{-2}$ mol, and more preferably from $1\times10^{-4}$ mol to $1\times10^{-3}$ mol, per 1 mol of silver.

In order to allow the hexacyano metal complex to be present on the outermost surface of a silver halide grain, the hexacyano metal complex is directly added in any stage of: after completion of addition of an aqueous solution of silver nitrate used for grain formation; before completion of an emulsion formation step prior to a chemical sensitization step of conducting chalcogen sensitization such as sulfur sensitization, selenium sensitization, or tellurium sensitization, or noble metal sensitization such as gold sensitization; during a washing step; during a dispersion step; and before a chemical sensitization step. In order not to grow fine silver halide grains, the hexacyano metal complex is preferably added rapidly after the grain is formed, and it is preferably added before completion of the emulsion formation step.

Addition of the hexacyano metal complex may be started after addition of 96% by weight of an entire amount of silver nitrate to be added for grain formation, more preferably started after addition of 98% by weight, and particularly preferably, started after addition of 99% by weight.

When any of the hexacyano metal complexes is added after addition of an aqueous solution of silver nitrate just prior to completion of grain formation, it can be adsorbed to the outermost surface of the silver halide grain and most of the complexes form an insoluble salt with silver ions on the surface of the grain. Since silver hexacyanoferrate (II) is a salt less soluble than silver iodide, re-dissolution with fine grains can be prevented, and it becomes possible to prepare fine silver halide grains with smaller grain size.

Metal atoms that can be contained in the silver halide grain used in the invention (for example, $[Fe(CN)_6]^{4-}$), and the desalting method and chemical sensitizing method of silver halide emulsion are described in paragraph Nos. 0046 to 0050 of JP-A No. 11-84574, in paragraph Nos. 0025 to 0031 of JP-A No. 11-65021, and in paragraph Nos. 0242 to 0250 of JP-A No. 11-119374.

6) Gelatin

As the gelatin which is contained in the photosensitive silver halide emulsion used in the invention, various types of gelatin can be used. It is necessary to maintain an excellent dispersion state of a photosensitive silver halide emulsion in the coating solution containing an organic silver salt, and gelatin having a molecular weight of 10,000 to 1,000,000 is preferably used.

Phthalated gelatin is also preferably used. The gelatin may be used at the time of grain formation or at the time of dispersion after desalting treatment, and it is preferably used at the time of grain formation.

7) Sensitizing Dye

As the sensitizing dye which can be used in the invention, a sensitizing dye which spectrally sensitizes the silver halide grains in a desired wavelength region upon adsorption to the silver halide grains and has spectral sensitivity suitable to the spectral characteristic of an exposure light source can be advantageously selected. The sensitizing dyes and the addition method are described, for example, in paragraph Nos. 0103 to 0109 of JP-A No. 11-65021, as compounds represented by formula (II) in JP-A No. 10-186572, dyes represented by formula (I) and described in paragraph No. 0106 of JP-A No. 11-119374, dyes described in U.S. Pat. No. 5,510,236 and in the Example 5 of U.S. Pat. No. 3,871,887, dyes disclosed in JP-A Nos. 2-96131 and 59-48753, as well as in page 19, line 38 to page 20, line 35 of EP No. 803,764A1, and in JP-A Nos. 2001-272747, 2001-290238 and 2002-23306, and the like. The sensitizing dye may be used alone, or two or more of them may be used in combination. In the invention, the sensitizing dye is preferably added in the silver halide emulsion at the time after a desalting step and before coating, and more preferably at the time after desalting and before completion of chemical ripening.

In the invention, the sensitizing dye may be added at any amount according to the property of sensitivity or fogging, but it is preferably added in an amount of from $10^{-6}$ mol to 1 mol, and more preferably from $10^{-4}$ mol to $10^{-1}$ mol, per 1 mol of photosensitive silver halide.

In the invention, a super sensitizer can be used in order to improve the spectral sensitizing effect. The super sensitizer that can be used in the invention includes those compounds described in EP-A No. 587,338, U.S. Pat. Nos. 3,877,943 and 4,873,184, JP-A Nos. 5-341432, 11-109547, and 10-111543, and the like.

8) Chemical Sensitization

The photosensitive silver halide grain according to the invention is preferably chemically sensitized -by sulfur sensitizing method, selenium sensitizing method, or tellurium sensitizing method. As the compounds used preferably for sulfur sensitizing method, selenium sensitizing method, and tellurium sensitizing method, known compounds, for example, compounds described in JP-A No. 7-128768 and the like can be used. Particularly, tellurium sensitization is preferred in the invention, and compounds described in the literature cited in paragraph No. 0030 in JP-A No. 11-65021 and compounds represented by formula (II), (III), or (IV) in JP-A No. 5-313284 are more preferred.

The photosensitive silver halide grain in the invention is preferably chemically sensitized by gold sensitizing method alone or in combination with the chalcogen sensitization described above. As the gold sensitizer, those having an oxidation number of gold of either +1 or +3 are preferred, and those gold compounds usually used as the gold sensitizer are preferred.

As typical examples, chloroauric acid, bromoauric acid, potassium chloroaurate, potassium bromoaurate, auric trichloride, potassium auric thiocyanate, potassium iodoaurate, tetracyanoauric acid, ammonium aurothiocyanate, and pyridyl trichloro gold are preferred. Further, gold sensitizers described in U.S. Pat. No. 5,858,637 and JP-A No. 2002-278016 are also used preferably.

In the invention, chemical sensitization can be applied at any time so long as it is after grain formation and before coating, and it can be applied, after desalting, (1) before spectral sensitization, (2) simultaneously with spectral sensitization, (3) after spectral sensitization, (4) just prior to coating, or the like.

The amount of sulfur, selenium, or tellurium sensitizer used in the invention may vary depending on the silver halide grain used, the chemical ripening condition, and the like, and it is used in an amount of from $10^{-8}$ mol to $10^{-2}$ mol, and preferably from $10^{-7}$ mol to $10^{-3}$ mol, per 1 mol of silver halide.

The addition amount of the gold sensitizer may vary depending on various conditions, and it is generally from $10^{-7}$ mol to $10^{-3}$ mol, and preferably from $10^{-6}$ mol to $5\times10^{-4}$ mol, per 1 mol of silver halide.

There is no particular restriction on the conditions for the chemical sensitization in the invention, and appropriately, the pH is from 5 to 8, the pAg is from 6 to 11, and the temperature is from 40° C. to 95° C.

In the silver halide emulsion used in the invention, a thiosulfonic acid compound may be added by the method shown in EP-A No. 293,917.

A reduction sensitizer is preferably used for the photosensitive silver halide grain in the invention. As the specific compound for the reduction sensitizing method, ascorbic acid or aminoimino methane sulfinic acid is preferred, as well as the use of stannous chloride, a hydrazine derivative, a borane compound, a silane compound, or a polyamine compound is preferred. The reduction sensitizer may be added at any stage in the photosensitive emulsion production process from crystal growth to the preparation step just prior to coating. Further, it is preferred to apply reduction sensitization by ripening while keeping the pH to 7 or higher or the pAg to 8.3 or lower for the emulsion, and it is also preferred to apply reduction sensitization by introducing a single addition portion of silver ions during grain formation.

9) Compound that is One-Electron-Oxidized to Provide a One-electron Oxidation Product Which Releases One or More Electrons The black and white photothermographic material of the present invention preferably contains a compound that is one-electron-oxidized to provide a one-electron oxidation product which releases one or more electrons. The said compound can be used alone or in combination with various chemical sensitizers described above to increase the sensitivity of silver halide.

The compound that is one-electron-oxidized to provide a one-electron oxidation product which releases one or more electrons, which is contained in the black and white photothermographic material of the invention, is a compound selected from the following Groups 1 or 2.

(Group 1) a compound that is one-electron-oxidized to provide a one-electron oxidation product which further releases one or more electrons due to being subjected to a subsequent bond cleavage reaction;

(Group 2) a compound that is one-electron-oxidized to provide a one-electron oxidation product which further releases one or more electrons after being subjected to a subsequent bond formation reaction.

The compound of Group 1 will be explained below.

In the compound of Group 1, as a compound that is one-electron-oxidized to provide a one-electron oxidation product which further releases one electron due to being subjected to a subsequent bond cleavage reaction, specific examples include examples of compound referred to as "one photon two electrons sensitizer" or "deprotonating electron-donating sensitizer" described in JP-A No. 9-211769 (specific examples: Compound PMT-1 to S-37 in Tables E and F, pages 28 to 32); JP-A No. 9-211774; JP-A No. 11-95355 (specific examples: Compound INV 1 to 36); JP-W No. 2001-500996 (specific examples: Compound 1to 74, 80 to 87, and 92 to 122); U.S. Pat. Nos. 5,747,235 and 5,747,236; EP No. 786,692A1 (specific examples: Compound INV 1 to 35); EP No. 893,732A1; U.S. Pat. Nos. 6,054,260 and 5,994,051; etc.

Preferred ranges of these compounds are the same as the preferred ranges described in the quoted specifications.

In the compound of Group 1, as a compound that is one-electron-oxidized to provide a one-electron oxidation product which further releases one or more electrons due to being subjected to a subsequent bond cleavage reaction, specific examples include the compounds represented by formula (1) (same as formula (1) described in JP-A No. 2003-114487), formula (2) (same as formula (2) described in JP-A No. 2003-114487), formula (3) (same as formula (1) described in JP-A No. 2003-114488), formula (4) (same as formula (2) described in JP-A No. 2003-114488), formula (5) (same as formula (3) described in JP-A No. 2003-114488), formula (6) (same as formula (1) described in JP-A No. 2003-75950), formula (7) (same as formula (2) described in JP-A No. 2003-75950), and formula (8) (same as formula (1) described in JP-A No. 2004-239943), and the compound represented by formula (9) (same as formula (3) described in JP-A No. 2004-245929) among the compounds which can undergo the reaction represented by chemical reaction formula (1) (same as chemical reaction formula (1) described in JP-A No. 2004-245929). Preferable ranges of these compounds are the same as the preferable ranges described in the quoted specifications.

Formula (1)

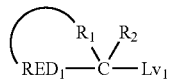

Formula (2)

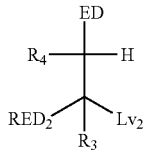

In formulae (1) and (2), $RED_1$ and $RED_2$ each independently represent a reducing group. $R_1$ represents a nonmetallic atomic group forming a cyclic structure equivalent to a tetrahydro derivative or hexahydro derivative of a 5- or 6-membered aromatic ring (including an aromatic heterocycle) with the carbon atom (C) and $RED_1$. $R_2$, $R_3$, and $R_4$ each independently represent a hydrogen atom or a substituent. $Lv_1$ and $Lv_2$ each independently represent a leaving group. ED represents an electron-donating group.

Formula (3)

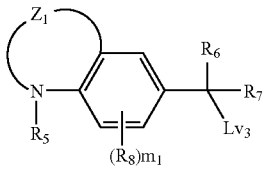

Formula (4)

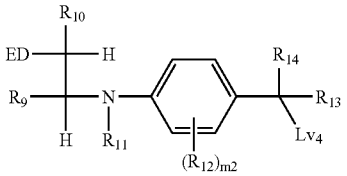

Formula (5)

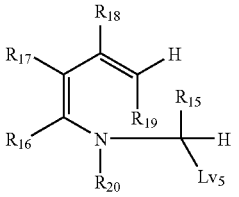

In formulae (3), (4), and (5), $Z_1$ represents an atomic group forming a 6-membered ring with a nitrogen atom and two carbon atoms of the benzene ring. $R_5$, $R_6$, $R_7$, $R_9$, $R_{10}$, $R_{11}$, $R_{13}$, $R_{14}$, $R_{15}$, $R_{16}$, $R_{17}$, $R_{18}$, and $R_{19}$ each independently represent a hydrogen atom or a substituent. $R_{20}$ represents a hydrogen atom or a substituent; however, in the case where $R_{20}$ represents a group other than an aryl group, $R_{16}$ and $R_{17}$ bond to each other to form an aromatic ring or an aromatic heterocycle. $R_8$ and $R_{12}$ represent a substituent which substitutes for a hydrogen atom on a benzene ring. $m_1$ represents an integer of from 0 to 3, and m2 represents an integer of from 0 to 4. $Lv_3$, $Lv_4$, and $Lv_5$ each independently represent a leaving group.

Formula (6)

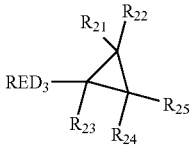

Formula (7)

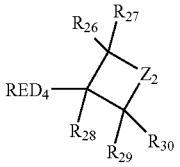

In formulae (6) and (7), $RED_3$ and $RED_4$ each independently represent a reducing group. $R_{21}$ to $R_{30}$ each independently represent a hydrogen atom or a substituent. $Z_2$ represents —$CR_{111}R_{112}$—, —$NR_{113}$—, or —O—. $R_{111}$ and $R_{112}$ each independently represent a hydrogen atom or a substituent. $R_{113}$ represents a hydrogen atom, an alkyl group, an aryl group, or a heterocyclic group.

Formula (8)

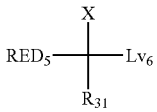

In formula (8), $RED_5$ is a reducing group and represents an arylamino group or a heterocyclic amino group. $R_{31}$ represents a hydrogen atom or a substituent. X represents one selected from an alkoxy group, an aryloxy group, a heterocyclic oxy group, an alkylthio group, an arylthio group, a heterocyclic thio group, an alkylamino group, an arylamino group, or a heterocyclic amino group. $Lv_6$ is a leaving group and represents a carboxy group or a salt thereof, or a hydrogen atom.

Chemical reaction formula (1)

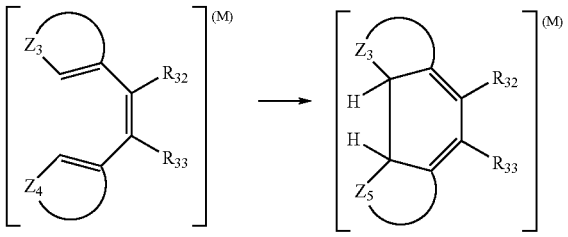

Formula (9)

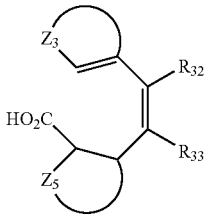

The compound represented by formula (9) is a compound that undergoes a bond formation reaction represented by chemical reaction formula (1) after undergoing two-electrons-oxidation accompanied by decarboxylation and further oxidized. In chemical reaction formula (1), $R_{32}$ and $R_{33}$ represent a hydrogen atom or a substituent. $Z_3$ represents a group which forms a 5- or 6-membered heterocycle with C═C. $Z_4$ represents a group which forms a 5- or 6-membered aryl group or heterocyclic group with C═C. M represents a radical, a radical cation, or a cation. In formula (9), $R_{32}$, $R_{33}$, and $Z_3$ each have the same meaning as in chemical reaction formula (1). $Z_5$ represents a group which forms a 5- or 6-membered cyclic aliphatic hydrocarbon group or heterocyclic group with C-C.

Next, the compound of Group 2 is explained.

In the compound of Group 2, as a compound that is one-electron-oxidized to provide a one-electron oxidation product which further releases one or more electrons after being subjected to a subsequent bond formation reaction, specific examples can include the compound represented by formula (10) (same as formula (1) described in JP-A No. 2003-140287), and the compound represented by formula (11) (same as formula (2) described in JP-A No. 2004-245929)

which can undergo the reaction represented by chemical reaction formula (1) (same as chemical reaction formula (1) described in JP-A No. 2004-245929). The preferable ranges of these compounds are the same as the preferable ranges described in the quoted specifications.

$RED_6$-Q-Y Formula (10)

In formula (10), $RED_6$ represents a reducing group which is to be one-electron-oxidized. Y represents a reactive group containing a carbon-carbon double bond part, a carbon-carbon triple bond part, an aromatic group part, or a benzo-condensed non-aromatic heterocycle part, which reacts with one-electron-oxidized product formed by one-electron-oxidation of $RED_6$ to form a new bond. Q represents a linking group which links $RED_6$ and Y.

Chemical reaction formula (1)

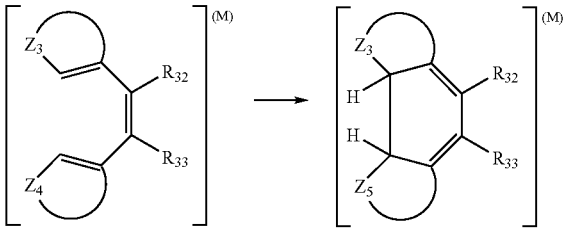

Formula (11)

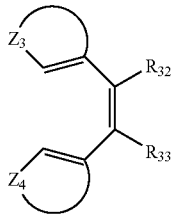

The compound represented by formula (11) is a compound that undergoes a bond formation reaction represented by chemical reaction formula (1) by being oxidized. In chemical reaction formula (1), $R_{32}$ and $R_{33}$ each independently represent a hydrogen atom or a substituent. $Z_3$ represents a group which forms a 5- or 6-membered heterocycle with C═C. $Z_4$ represents a group which forms a 5- or 6-membered aryl group or heterocyclic group with C═C. $Z_5$ represents a group which forms a 5- or 6-membered cyclic aliphatic hydrocarbon group or heterocyclic group with C-C. M represents a radical, a radical cation, or a cation. In formula (11), $R_{32}$, $R_{33}$, $Z_3$, and $Z_4$ each have the same meaning as in chemical reaction formula (1).

The compounds of Groups 1 or 2 are preferably "the compound having an adsorptive group to silver halide in the molecule" or "the compound having a partial structure of a spectral sensitizing dye in the molecule". The representative adsorptive group to silver halide is the group described in JP-A No. 2003-156823, page 16 right, line 1 to page 17 right, line 12. The partial structure of a spectral sensitizing dye is the structure described in the same specification, page 17 right, line 34 to page 18 right, line 6.

As the compound of Groups 1 or 2, "the compound having at least one adsorptive group to silver halide in the molecule" is more preferred, and "the compound having two or more adsorptive groups to silver halide in the same molecule" is even more preferred. In the case where two or more adsorptive groups exist in a single molecule, those adsorptive groups may be identical or different from one another.

As preferable adsorptive group, a mercapto-substituted nitrogen-containing heterocyclic group (e.g., a 2-mercaptothiadiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzothiazole group, a 1,5-dimethyl-1,2,4-triazolium-3-thiolate group, or the like) or a nitrogen-containing heterocyclic group having an —NH— group, which forms silver iminate (—N(Ag)—), as a partial structure of heterocycle (e.g., a benzotriazole group, a benzimidazole group, an indazole group, or the like) are described. A 5-mercaptotetrazole group, a 3-mercapto-1,2,4-triazole group, and a benzotriazole group are particularly preferable, and a 3-mercapto-1,2,4-triazole group and a 5-mercaptotetrazole group are most preferable.

The case where the adsorptive group has two or more mercapto groups as a partial structure in the molecule is also particularly preferable. Herein, the mercapto group (—SH) may become a thione group in the case where it can tautomerize. Preferred examples of the adsorptive group having two or more mercapto groups as a partial structure (dimercapto-substituted nitrogen-containing heterocyclic group and the like) include a 2,4-dimercaptopyrimidine group, a 2,4-dimercaptotriazine group, and a 3,5-dimercapto-1,2,4-triazole group.

Further, a quaternary salt structure of nitrogen or phosphorus is also preferably used as the adsorptive group. Specific examples of the quaternary salt structure of nitrogen include an ammonio group (a trialkylammonio group, a dialkylarylammonio group, a dialkylheteroarylammonio group, an alkyldiarylammonio group, an alkyldiheteroarylammonio group, or the like) and a nitrogen-containing heterocyclic group containing a quaternary nitrogen atom. Specific examples of the quaternary salt structure of phosphorus include a phosphonio group (a trialkylphosphonio group, a dialkylarylphosphonio group, a dialkylheteroarylphosphonio group, an alkyldiarylphosphonio group, an alkyldiheteroarylphosphonio group, a triarylphosphonio group, a triheteroarylphosphonio group, or the like).

A quaternary salt structure of nitrogen is more preferably used, and a 5- or 6-membered nitrogen-containing aromatic heterocyclic group containing a quaternary nitrogen atom is even more preferably used. Particularly preferably, a pyridinio group, a quinolinio group, or an isoquinolinio group is used. These nitrogen-containing heterocyclic groups containing a quaternary nitrogen atom may have any substituent.

Examples of a counter anion of the quaternary salt include a halogen ion, carboxylate ion, sulfonate ion, sulfate ion, perchlorate ion, carbonate ion, nitrate ion, $BF_4^-$, $PF_6^-$, $Ph_4B^-$, and the like. In the case where the group having negative charge at carboxylate group or the like exists in the molecule, an inner salt may be formed with it. As a counter anion outside of the molecule, chloro ion, bromo ion, or methanesulfonate ion is particularly preferable.

Preferred structure of the compound represented by Groups 1 or 2 having a quaternary salt structure of nitrogen or phosphorus as the adsorptive group is represented by formula (X).

Formula (X)

$$(P—Q_1)_i—R—(Q_2—S)_j$$

In formula (X), P and R each independently represent a quaternary salt structure of nitrogen or phosphorus, which is not a partial structure of a spectral sensitizing dye. $Q_1$ and $Q_2$ each independently represent a linking group and typically represent a single bond, an alkylene group, an arylene group, a heterocyclic group, —O—, —S—, —$NR_N$, —C(=O)—, —$SO_2$—, —SO—, —P(=O)— or combinations of these groups. Herein, $R_N$ represents a hydrogen atom, an alkyl group, an aryl group, or a heterocyclic group. S represents a residue which is obtained by removing one atom from the compound represented by Group 1 or 2. i and j are an integer of one or more and are selected from within a range satisfying i+j=2 to 6. The case where i is 1 to 3 and j is 1 to 2 is preferable, the case where i is 1 or 2 and j is 1 is more preferable, and the case where i is 1 and j is 1 is particularly preferable. The compound represented by formula (X) preferably has 10 to 100 carbon atoms in total, more preferably 10 to 70 carbon atoms, even more preferably 11 to 60 carbon atoms, and particularly preferably 12 to 50 carbon atoms in total.

The compounds of Groups 1 or 2 may be used at any time during preparation of the photosensitive silver halide emulsion and production of the photothermographic material. For example, the compound may be used in a photosensitive silver halide grain formation step, in a desalting step, in a chemical sensitization step, before coating, or the like.

The compound may be added several times during these steps. The compound is preferably added after completion of the photosensitive silver halide grain formation step and before the desalting step; in the chemical sensitization step (just before initiation of the chemical sensitization to immediately after completion of the chemical sensitization); or before coating. The compound is more preferably added at the time from the chemical sensitization step to before being mixed with the non-photosensitive organic silver salt.

It is preferred that the compound of Groups 1 or 2 according to the invention is added by being dissolved in water, a water-soluble solvent such as methanol or ethanol, or a mixed solvent thereof. In the case where the compound is dissolved in water and solubility of the compound is increased by increasing or decreasing a pH value of the solvent, the pH value may be increased or decreased to dissolve and add the compound.

The compound of Groups 1 or 2 according to the invention is preferably used in the image forming layer which contains the photosensitive silver halide and the non-photosensitive organic silver salt. The compound may be added to a protective layer or intermediate layer, as well as the image forming layer containing the photosensitive silver halide and the non-photosensitive organic silver salt, to be diffused in the coating step. The compound may be added before or after addition of a sensitizing dye. The compound is contained in the silver halide emulsion layer (image forming layer) preferably in an amount of from $1\times10^{-9}$ mol to $5\times10^{-1}$ mol, and more preferably from $1\times10^{-8}$ mol to $5\times10^{-2}$ mol, per 1 mol of silver halide.

10) Compound Having Adsorptive Group and Reducing Group

The black and white photothermographic material of the present invention preferably contains a compound having an adsorptive group to silver halide and a reducing group in the molecule. It is preferred that the compound is represented by the following formula (I).

A-(W)n-B Formula (I)

In formula (I), A represents a group which adsorbs to a silver halide (hereafter, it is called an adsorptive group.); W represents a divalent linking group; n represents 0 or 1; and B represents a reducing group.

In formula (I), the adsorptive group represented by A is a group to adsorb directly to a silver halide or a group to promote adsorption to a silver halide. As typical examples, a mercapto group (or a salt thereof), a thione group (—C(=S)—), a heterocyclic group comprising at least one atom selected from among nitrogen, sulfur, selenium, and tellurium, a sulfide group, a disulfide group, a cationic group, an ethynyl group, and the like are described.

The mercapto group (or the salt thereof) as the adsorptive group means a mercapto group (or a salt thereof) itself and simultaneously more preferably represents a heterocyclic group, aryl group, or alkyl group substituted by at least one mercapto group (or a salt thereof).

Herein, the heterocyclic group is at least a 5- to 7-membered, monocyclic or condensed, aromatic or non-aromatic heterocyclic group; and examples thereof include an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline ring group, a pyrimidine ring group, a triazine ring group, and the like.

A heterocyclic group having a quaternary nitrogen atom may also be adopted, wherein the mercapto group as a substituent may dissociate to form a mesoion. When the mercapto group forms a salt, a counter ion of the salt may be a cation of an alkaline metal, alkaline earth metal, heavy metal, or the like, such as $Li^+$, $Na^+$, $K^+$, $Mg^{2+}$, $Ag^+$, or $Zn^{2+}$; an ammonium ion; a heterocyclic group containing a quaternary nitrogen atom; a phosphonium ion, or the like.

Further, the mercapto group as the adsorptive group may become a thione group by tautomerization.

The thione group used as the adsorptive group also includes a chain or cyclic thioamido group, thioureido group, thiourethane group, and dithiocarbamic acid ester group.

The heterocyclic group, as the adsorptive group, which comprises at least one atom selected from among nitrogen, sulfur, selenium, and tellurium, represents a nitrogen-containing heterocyclic group having an —NH— group, which forms silver iminate (—N(Ag)—), as a partial structure of the heterocycle, or a heterocyclic group having an —S— group, —Se— group, —Te— group, or =N— group, which coordinates to a silver ion by a coordination bond, as a partial structure of the heterocycle. As the former examples, a benzotriazole group, a triazole group, an indazole group, a pyrazole group, a tetrazole group, a benzimidazole group, an imidazole group, a purine group, and the like are described. As the latter examples, a thiophene group, a thiazole group, an oxazole group, a benzothiophene group, a benzothiazole group, a benzoxazole group, a thiadiazole group, an oxadiazole group, a triazine group, a selenoazole group, a benzoselenoazole group, a tellurazole group, a benzotellurazole group, and the like are described.

The sulfide group or disulfide group as the adsorptive group contains all groups having "—S—" or "—S—S—" as a partial structure.

The cationic group as the adsorptive group means a group containing a quaternary nitrogen atom, such as an ammonio group or a nitrogen-containing heterocyclic group containing a quaternary nitrogen atom. As examples of the nitrogen-containing heterocyclic group containing a quaternary nitrogen atom, a pyridinio group, a quinolinio group, an isoquinolinio group, an imidazolio group, and the like are described.

The ethynyl group as the adsorptive group means —C≡CH group and the said hydrogen atom may be substituted.

The adsorptive group described above may have any substituent.

Further, as typical examples of the adsorptive group, the groups described in pages 4 to 7 in the specification of JP-A No. 11-95355 are described.

As the adsorptive group represented by A in formula (I), a mercapto-substituted heterocyclic group (for example, a 2-mercaptothiadiazole group, a 2-mercapto-5-aminothiadiazole group, a 3-mercapto-1,2,4-triazole group, a 5-mercaptotetrazole group, a 2-mercapto-1,3,4-oxadiazole group, a 2-mercaptobenzimidazole group, a 1,5-dimethyl-1,2,4-triazolium-3-thiolate group, a 2,4-dimercaptopyrimidine group, a 2,4-dimercaptotriazine group, a 3,5-dimercapto-1,2,4-triazole group, a 2,5-dimercapto-1,3-thiazole group, or the like) and a nitrogen-containing heterocyclic group having an —NH— group, which forms silver iminate (—N(Ag)—), as a partial structure of the heterocycle (for example, a benzotriazole group, a benzimidazole group, an indazole group, or the like) are preferable, and more preferable as the adsorptive group are a 2-mercaptobenzimidazole group and a 3,5-dimercapto-1,2,4-triazole group.

In formula (I), W represents a divalent linking group. The said linking group may be any divalent linking group as long as it does not exert adverse influences on photographic performance. For example, a divalent linking group which is formed from carbon, hydrogen, oxygen, nitrogen, or sulfur can be used.

Specific examples thereof include an alkylene group having 1 to 20 carbon atoms (for example, a methylene group, an ethylene group, a trimethylene group, a tetramethylene group, a hexamethylene group, or the like), an alkenylene group having 2 to 20 carbon atoms, an alkynylene group having 2 to 20 carbon atoms, an arylene group having 6 to 20 carbon atoms (for example, a phenylene group, a naphthylene group, or the like), —CO—, —$SO_2$—, —O—, —S—, —$NR_1$—, and combinations of these linking groups. Herein, $R_1$ represents a hydrogen atom, an alkyl group, a heterocyclic group, or an aryl group.

The linking group represented by W may have any substituent.

In formula (I), the reducing group represented by B represents a group which reduces a silver ion. Examples thereof include a formyl group; an a m i n o group; a triple bond group such as an acetylene group, a propargyl group, or the like; a mercapto group; and residues which are obtained by removing one hydrogen atom from hydroxyamines, hydroxamic acids, hydroxyureas, hydroxyurethanes, hydroxysemicarbazides, reductones (reductone derivatives are contained.), anilines, phenols (chroman-6-ols, 2,3-dihydrobenzofuran-5-ols, aminophenols, sulfonamidophenols, and polyphenols such as hydroquinones, catechols, resorcinols, benzenetriols, bisphenols are included.), acylhydrazines, carbamoylhydrazines, 3-pyrazolidones, and the like. They may have any substituent.

The oxidation potential of the reducing group represented by B in formula (I) can be measured by using the measuring method described in Akira Fujishima, "DENKIKAGAKU SOKUTEIHO", pages 150 to 208, GIHODO SHUPPAN and The Chemical Society of Japan, "JIKKEN KAGAKU KOZA", 4th ed., vol. 9, pages 282 to 344, MARUZEN. For example, the method of rotating disc voltammetry can be used; namely the sample is dissolved in the solution (methanol: pH 6.5 Britton-Robinson buffer=10%: 90% (% by volume)) and after bubbling with nitrogen gas for 10 minutes, the voltamograph can be measured under conditions of 1000 rotations/minute, sweep rate of 20 mV/second, at 25° C. by using a rotating disc electrode (RDE) made by glassy carbon as a working electrode, a platinum electrode as a counter electrode, and a saturated calomel electrode as a reference electrode. The half wave potential (E½) can be calculated by that obtained voltamograph.

When the reducing group represented by B in the present invention is measured by the method described above, the oxidation potential is preferably in a range of from about −0.3 V to about 1.0 V, more preferably from about −0.1 V to about 0.8 V, and particularly preferably from about 0 V to about 0.7 V.

In formula (I), the reducing group represented by B is preferably a residue which is obtained by removing one hydrogen atom from hydroxyamines, hydroxamic acids, hydroxyureas, hydroxysemicarbazides, reductones, phenols, acylhydrazines, carbamoylhydrazines, or 3-pyrazolidones.

The compound of formula (I) according to the present invention may have a ballast group or polymer chain, which are generally used in the non-moving photographic additives such as a coupler or the like, in it. And as the polymer, for example, the polymer described in JP-A No. 1-100530 is described.

The compound of formula (I) according to the present invention may be bis or tris type of compound. The molecular weight of the compound represented by formula (I) according to the present invention is preferably within a range of from 100 to 10000, more preferably from 120 to 1000, and particularly preferably from 150 to 500.

Specific examples of the compound represented by formula (I) according to the present invention are shown below, but the present invention is not limited to these examples.

(1)

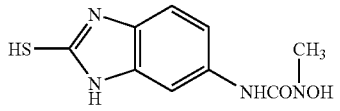

(2)

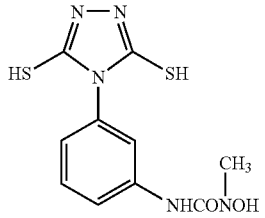

-continued
(3)
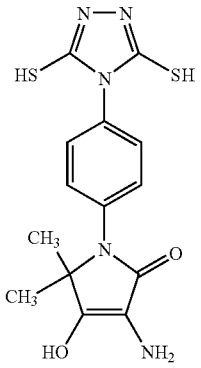
(4)
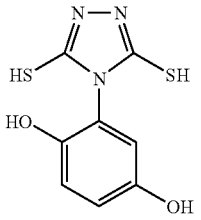
(5)
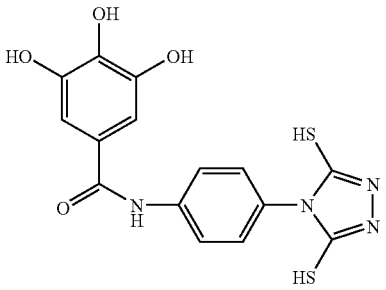
(6)
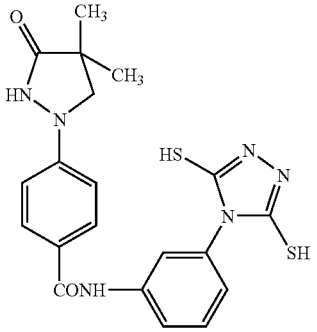
(7)
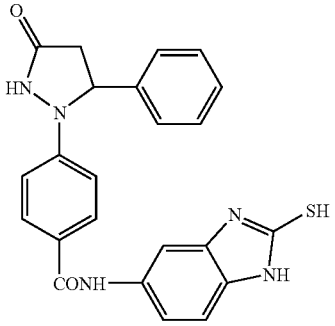
-continued
(8)
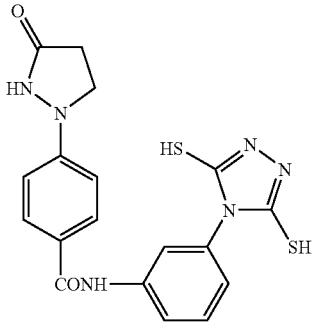
(9)
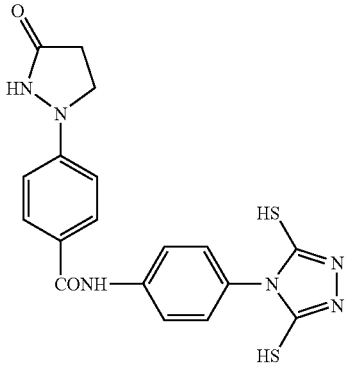
(10)
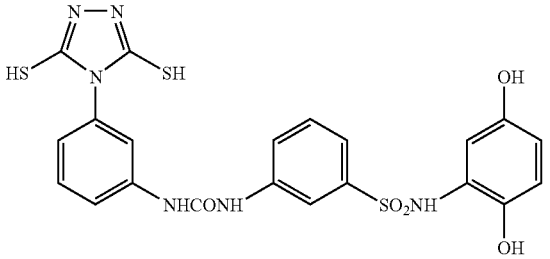
(11)
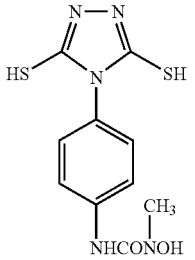
(12)
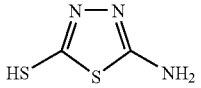
(13)
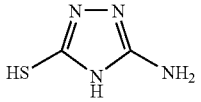

Further, specific compounds 1 to 30 and 1"-1 to 1"-77 shown in EP No. 1,308,776A2, pages 73 to 87 are also described as preferable examples of the compound having an adsorptive group and a reducing group according to the invention.

These compounds can be easily synthesized by a known method in the technical field. The compound of formula (I) according to the present invention may be used alone, but it is preferred to use two or more of the compounds simultaneously. When two or more of the compounds are used, those compounds may be added to the same layer or different layers, whereby addition methods may be different from each other.

The compound represented by formula (I) according to the present invention is preferably added to the silver halide emulsion layer (image forming layer) and more preferably, the compound represented by formula (I) is added in an emulsion preparation process. In the case where the compound is added in an emulsion preparation process, the compound can be added at any stage in the process. For example, the compound can be added during the silver halide grain formation step; before starting of desalting step; during the desalting step; before starting of chemical ripening; during the chemical ripening step; in the step before preparing a final emulsion, or the like. The compound can be added several times during these steps. It is preferred to use the compound in the image forming layer. But the compound may be added to a protective layer or intermediate layer adjacent to the image forming layer, in combination with its addition to the image forming layer, to be diffused in the coating step.

The preferred addition amount is largely dependent on the addition method described above or the type of the compound, but is generally from $1\times10^{-6}$ mol to 1 mol, preferably from $1\times10^{-5}$ mol to $5\times10^{-1}$ mol, and more preferably from $1\times10^{-4}$ mol to $1\times10^{-1}$ mol, per 1 mol of photosensitive silver halide.

The compound represented by formula (I) according to the present invention can be added by being dissolved in water, a water-soluble solvent such as methanol, ethanol and the like, or a mixed solution thereof. In this process, the pH may be arranged suitably by an acid or a base, and a surfactant may coexist. Further, these compounds can be added as an emulsified dispersion by dissolving them in an organic solvent having a high boiling point, and also can be added as a solid dispersion.

11) Combined Use of Silver Halides

The photosensitive silver halide emulsion in the black and white photothermographic material of the invention may be used alone, or two or more of them (for example, those having different mean grain sizes, different halogen compositions, different crystal habits, or different conditions for chemical sensitization) may be used together. Gradation can be controlled by using plural photosensitive silver halides each having different sensitivity. The relevant techniques include those described, for example, in JP-A Nos. 57-119341, 53-106125, 47-3929, 48-55730, 46-5187, 50-73627, and 57-150841.

It is preferred to provide a sensitivity difference of 0.2 or more in terms of log E between each of the emulsions.

12) Coating Amount

The addition amount of the photosensitive silver halide, when expressed by the amount of coated silver per 1 $m^2$ of the photothermographic material, is preferably from 0.03 $g/m^2$ to 0.6 $g/m^2$, more preferably from 0.05 $g/m^2$ to 0.4 $g/m^2$ and, most preferably from 0.07 $g/m^2$ to 0.3 $g/m^2$. The photosensitive silver halide is used in an amount of from 0.01 mol to 0.5 mol, preferably from 0.02 mol to 0.3 mol, and even more preferably from 0.03 mol to 0.2 mol, with respect to 1 mol of the organic silver salt.

13) Mixing Photosensitive Silver Halide and Organic Silver Salt

The mixing method and mixing conditions of the separately prepared photosensitive silver halide and organic silver salt include a method of mixing respectively prepared photosensitive silver halide grains and organic silver salt by a high speed stirrer, ball mill, sand mill, colloid mill, vibration mill, homogenizer, or the like; a method of mixing a photosensitive silver halide completed for preparation at any timing during the preparation of the organic silver salt and preparing the organic silver salt; and the like. However, so long as the effects of the invention are sufficiently realized, there is no particular restriction on the method. Further, a method of mixing two or more aqueous dispersions of organic silver salts and two or more aqueous dispersions of photosensitive silver salts while carrying out mixing is used preferably for controlling photographic properties.

14) Mixing Silver Halide into Coating Solution

In the invention, the time of adding silver halide to the coating solution for the image forming layer is preferably in a range of from 180 minutes before coating to just prior to coating, and more preferably 60 minutes before coating to 10 seconds before coating. However, so long as the effects of the invention are sufficiently realized, there is no particular restriction concerning the mixing method and the conditions of mixing. As a specific mixing method, there is a method of mixing in a tank and controlling an average residence time. The average residence time herein is calculated from addition flux and the amount of solution transferred to the coater. And another mixing method is a method using a static mixer, which is described in 8th chapter or the like of "Ekitai Kongo Gijutu" by N. Harnby, M. F. Edwards, and A. W. Nienow, translated by Koji Takahashi (Nikkan Kogyo Shinbunsha, 1989).

(Hydrogen Bonding Compound)

In the case where the reducing agent according to the invention has an aromatic hydroxy group (—OH) or an amino group (—NHR, R represents a hydrogen atom or a substituted or unsubstituted alkyl group), particularly in the case where the reducing agent is a bisphenol described above, it is preferred to use in combination a non-reducing compound having a group which forms a hydrogen bond with these groups of the reducing agent.

Examples of the group forming a hydrogen bond with the hydroxy group or amino group include a phosphoryl group, an alkylsulfinyl group, an arylsulfinyl group, an arylsulfonyl group, an alkylsulfonyl group, a carbonyl group, an amido group, an ester group, an aminocarbonylamino group, an alkoxycarbonylamino group, an aryloxycarbonylamino group, a sulfamoylamino group, an alkylsulfonylamino group, an arylsulfonylamino group, a tertiary amino group, a nitrogen-containing aromatic group, and the like. Preferred among them are a phosphoryl group, an alkylsulfinyl group, an arylsulfinyl group, an amido group (not having —N(H)— group but being blocked in the form of —N(Ra)— (where Ra represents a substituent other than H)), an aminocarbonylamino group, an alkoxycarbonylamino group, an aryloxycarbonylamino group, a sulfamoylamino group, an alkylsulfonylamino group (not having —N(H)— group but being blocked in the form of —N(Ra)— (where Ra represents a substituent other than H)), and an arylsulfonylamino group (not having —N(H)— group but being blocked in the form of —N(Ra)— (where Ra represents a substituent other than H)).

In the invention, particularly preferable hydrogen bonding compound is the compound represented by the following formula (D).

Formula (D)

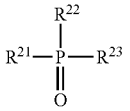

In formula (D), $R^{21}$ to $R^{23}$ each independently represent one selected from an alkyl group, an aryl group, an alkoxy group, an aryloxy group, an amino group, or a heterocyclic group, which may be substituted or unsubstituted.

In the case where $R^{21}$ to $R^{23}$ has a substituent, examples of the substituent include a halogen atom, an alkyl group, an aryl group, an alkoxy group, an amino group, an acyl group, an acylamino group, an alkylthio group, an arylthio group, an alkylsulfonylamino group, an arylsulfonylamino group, an acyloxy group, an oxycarbonyl group, a carbamoyl group, a sulfamoyl group, an arylsulfonyl group, an alkylsulfonyl group, a phosphoryl group, and the like, in which preferred as the substituent are an alkyl group and an aryl group, e.g., a methyl group, an ethyl group, an isopropyl group, a t-butyl group, a t-octyl group, a phenyl group, a 4-alkoxyphenyl group, a 4-acyloxyphenyl group, and the like.

Specific examples of the alkyl group represented by $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenethyl group, a 2-phenoxypropyl group, and the like.

Examples of the aryl group include a phenyl group, a cresyl group, a xylyl group, a naphthyl group, a 4-t-butylphenyl group, a 4-t-octylphenyl group, a 4-anisidyl group, a 3,5-dichlorophenyl group, and the like.

Examples of the alkoxy group include a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group, a benzyloxy group, and the like.

Examples of the aryloxy group include a phenoxy group, a cresyloxy group, an isopropylphenoxy group, a 4-t-butylphenoxy group, a naphthoxy group, a biphenyloxy group, and the like.

Examples of the amino group include a dimethylamino group, a diethylamino group, a dibutylamino group, a dioctylamino group, an N-methyl-N-hexylamino group, a dicyclohexylamino group, a diphenylamino group, an N-methyl-N-phenylamino group, and the like.

Preferred as $R^{21}$ to $R^{23}$ are an alkyl group, an aryl group, an alkoxy group, and an aryloxy group. From the viewpoint of the effect of the invention, it is preferred that at least one of $R^{21}$ to $R^{23}$ is an alkyl group or an aryl group, and it is more preferred that two or more of them are an alkyl group or an aryl group. Further, from the viewpoint of low cost availability, it is preferred that $R^{21}$ to $R^{23}$ are of the same group.

Specific examples of the hydrogen bonding compound represented by formula (D) according to the invention and others are shown below, but the invention is not limited thereto.

D-1

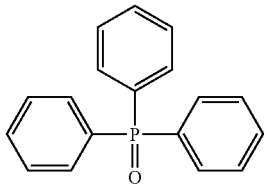

D-2

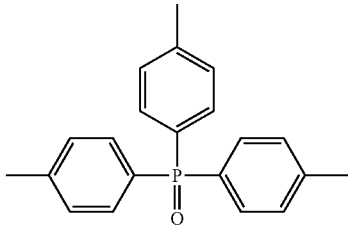

D-3

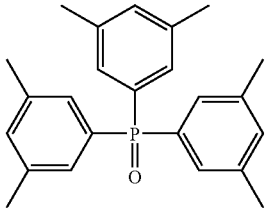

D-4

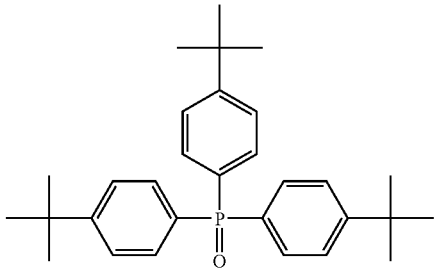

D-5

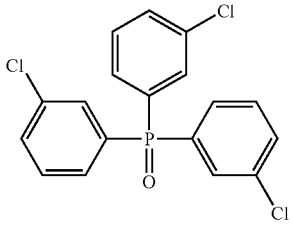

D-6

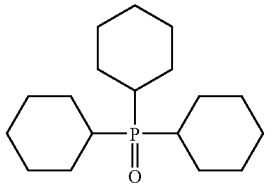

D-7

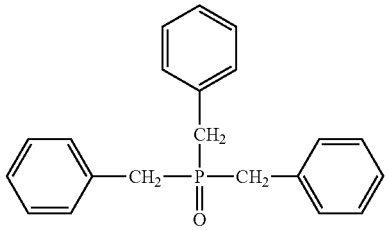

-continued

D-8

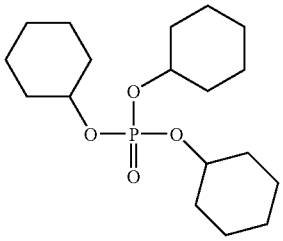

D-9

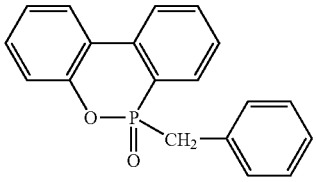

D-10

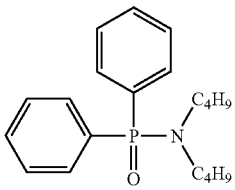

D-11

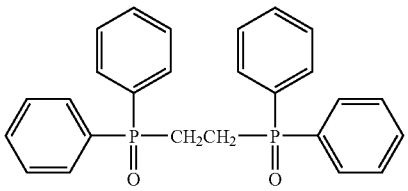

D-12

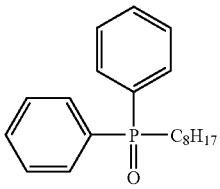

D-13

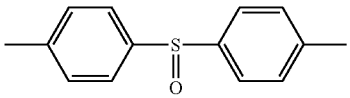

D-14

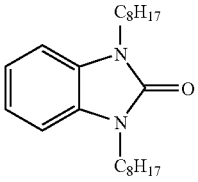

D-15

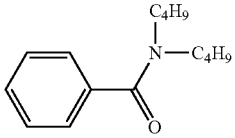

Specific examples of hydrogen bonding compounds other than those enumerated above can be found in those described in EP No. 1,096,310 and in JP-A Nos. 2002-156727 and 2002-318431.

The compound represented by formula (D) according to the invention can be used in the photothermographic material by being incorporated into the coating solution in the form of a solution, an emulsified dispersion, or a solid fine particle dispersion, similar to the case of reducing agent. However, it is preferably used in the form of a solid dispersion. In a solution state, the compound according to the invention forms a hydrogen-bonded complex with a compound having a phenolic hydroxy group or an amino group, and can be isolated as a complex in crystalline state depending on the combination of the reducing agent and the compound represented by formula (D) according to the invention.

It is particularly preferred to use the crystal powder thus isolated in the form of a solid fine particle dispersion, because it provides stable performance. Further, it is also preferred to use a method of leading to form complex during dispersion by mixing the reducing agent and the compound represented by formula (D) according to the invention in the form of powder, and dispersing them with a proper dispersing agent using sand grinder mill or the like.

The compound represented by formula (D) according to the invention is preferably used in a range of from 1 mol % to 200 mol %, more preferably from 10 mol % to 150 mol %, and even more preferably, from 20 mol % to 100 mol %, with respect to the reducing agent.

(Binder for First Image Forming Layer)

Any polymer having a film-forming property may be used as the binder for the first image forming layer according to the invention. Suitable as the binder are those that are transparent or translucent, and that are generally colorless, such as natural resin or polymer and their copolymers; synthetic resin or polymer and their copolymer; or media forming a film; for example, included are rubbers, cellulose acetates, cellulose acetate butyrates, poly(vinyl chlorides), poly(methacrylic acids), styrene-maleic anhydride copolymers, styrene-acrylonitrile copolymers, styrene-butadiene copolymers, poly(vinyl acetals) (e.g., poly(vinyl formal) and poly(vinyl butyral)), polyesters, polyurethanes, phenoxy resin, poly(vinylidene chlorides), polyepoxides, polycarbonates, poly(vinyl acetates), polyolefins, cellulose esters, and polyamides.

Particularly preferably, 50% by weight or more of the binder for the first image forming layer according to the invention is a polymer latex.

In the present invention, the glass transition temperature (Tg) of the binder for the first image forming layer is preferably in a range of from 0° C. to 80° C. (hereinafter, sometimes referred to as "high-Tg binder"), more preferably from 10° C. to 70° C., and even more preferably from 15° C. to 60° C.

In the specification, Tg is calculated according to the following equation:

$$1/Tg=\Sigma(Xi/Tgi)$$

where the polymer is obtained by copolymerization of n monomer components (from i=1 to i=n); Xi represents the weight fraction of the ith monomer (ΣXi=1), and Tgi is the glass transition temperature (absolute temperature) of the homopolymer obtained with the ith monomer. The symbol Σ stands for the summation from i=1 to i=n. Values for the glass transition temperature (Tgi) of the homopolymers derived from each of the monomers were obtained from the values of J. Brandrup and E. H. Immergut, Polymer Handbook (3rd Edition) (Wiley-Interscience, 1989).

The binder may be of two or more polymers depending on needs. And, the polymer having Tg of 20° C. or higher and the polymer having Tg of lower than 20° C. may be used in combination. In the case where two or more polymers differing in Tg are blended for use, it is preferred that the weight-average Tg is within the range mentioned above.

In the invention, the first image forming layer is preferably formed by applying a coating solution using an aqueous solvent which contains 30% by weight or more of water in the solvent and by then drying.

The aqueous solvent signifies water or water containing mixed therein 70% by weight or less of a water-miscible organic solvent. Examples of the water-miscible organic solvent include alcohols such as methyl alcohol, ethyl alcohol, propyl alcohol, or the like; cellosolves such as methyl cellosolve, ethyl cellosolve, butyl cellosolve, or the like; ethyl acetate, dimethylformamide, and the like.

The equilibrium moisture content at 25° C. and 60% RH is preferably 2% by weight or lower, more preferably in a range of from 0.01% by weight to 1.5% by weight, and even more preferably from 0.02% by weight to 1% by weight.

As the hydrophobic polymer latex, hydrophobic polymer such as acrylic polymer, polyesters, rubbers (e.g., SBR resin), polyurethanes, poly(vinyl chlorides), poly(vinyl acetates), poly(vinylidene chlorides), polyolefins, or the like can be used preferably. As the polymers above, usable are straight-chain polymers, branched polymers, or crosslinked polymers; also usable are the so-called homopolymers in which one type of monomer is polymerized, or copolymers in which two or more types of monomers are polymerized. In the case of a copolymer, it may be a random copolymer or a block copolymer. The molecular weight of the polymer is, in number average molecular weight, in a range of from 5,000 to 1,000,000, preferably from 10,000 to 200,000. Those having too small molecular weight exhibit insufficient mechanical strength on forming the image forming layer, and those having too large molecular weight are also not preferred because the resulting film-forming properties are poor. Further, crosslinking polymer latexes are particularly preferred for use.

Preferably, 50% by weight or more of the binder described above is occupied by polymer latex having a monomer component represented by the above-described formula (M), which is explained as polymer latex used for the second image forming layer described above.

Specific polymer latex used for the first image forming layer and the polymer latex used for the second image forming layer may be the same as or different from each other.

<Preferable Latex>

Particularly preferable as the polymer latex for use in the invention is that of styrene-butadiene copolymer or that of styrene-isoprene copolymer. The weight ratio of the monomer unit of styrene relative to that of butadiene or isoprene constituting the styrene-butadiene copolymer or the styrene-isoprene copolymer is preferably in a range of from 40:60 to 95:5. Further, the monomer unit of styrene and that of butadiene or isoprene preferably account for 60% by weight to 99% by weight with respect to the copolymer. Further, the polymer latex according to the invention preferably contains acrylic acid or methacrylic acid in a range of from 1% by weight to 6% by weight with respect to the sum of styrene and butadiene or isoprene, and more preferably from 2% by weight to 5% by weight.

The polymer latex according to the invention preferably contains acrylic acid. Preferable range of molecular weight is similar to that described above.

As the latex of styrene-butadiene copolymer preferably used in the invention, there are mentioned P-3 to P-9, P-15, and P-16 described above, and commercially available LACSTAR-3307B, 7132C, Nipol Lx416, and the like. And as preferred examples of the latex of styrene-isoprene copolymer, there are mentioned P-17 and P-18 described above.

In the first image forming layer of the black and white photothermographic material of the invention, if necessary, there may be added hydrophilic polymer such as gelatin, poly(vinyl alcohol), methyl cellulose, hydroxypropyl cellulose, carboxymethyl cellulose, or the like. The hydrophilic polymer is preferably added in an amount of 30% by weight or less, and more preferably 20% by weight or less, with respect to the total weight of the binder incorporated in the first image forming layer.

The total amount of binder in the first image forming layer according to the invention is preferably in a range of from 0.2 $g/m^2$ to 30 $g/m^2$, more preferably from 1 $g/m^2$ to 15 $g/m^2$, and even more preferably from 2 $g/m^2$ to 10 $g/m^2$. To the first image forming layer according the invention, there may be added a crosslinking agent for crosslinking, a surfactant to improve coating ability, or the like.

Concerning the amount of the binder for the first image forming layer, the weight ratio of total binder to organic silver salt is preferably in a range of from 1/10 to 10/1, more preferably from 1/3 to 5/1, and even more preferably from 1/1 to 3/1. Further, the weight ratio of total binder to silver halide is in a range of from 5 to 400, and more preferably from 10 to 200.

(Antifoggant)

1) Organic Polyhalogen Compound

Preferable organic polyhalogen compound that can be used in the invention is explained specifically below. In the invention, preferred organic polyhalogen compound is a compound represented by the following formula (H).

$$Q\text{-}(Y)n\text{-}C(Z_1)(Z_2)X \qquad \text{Formula (H)}$$

In formula (H), Q represents an alkyl group, an aryl group, or a substituted or unsubstituted heterocyclic group; Y represents a divalent linking group; n represents 0 or 1; $Z_1$ and $Z_2$ each represent a halogen atom; and X represents a hydrogen atom or an electron-attracting group.

In formula (H), Q is preferably a substituted or unsubstituted alkyl group having 1 to 6 carbon atoms, a substituted or unsubstituted aryl group having 6 to 12 carbon atoms, or a heterocyclic group comprising at least one nitrogen atom (pyridine, quinoline, or the like).

In the case where Q is an aryl group in formula (H), Q is preferably a phenyl group substituted by an electron-attracting group whose Hammett substituent constant σp yields a positive value. For the details of Hammett substituent constant, reference can be made to Journal of Medicinal Chemistry, vol. 16, No. 11 (1973), p. 1207 to 1216, and the like. Examples of the electron-attracting group include a halogen atom, an alkyl group substituted by an electron-attracting group, an aryl group substituted by an electron-attracting group, a heterocyclic group, an arylsulfonyl group, an alkylsulfonyl group, an acyl group, an alkoxycarbonyl group, a carbamoyl group, a sulfamoyl group, and the like. Preferable as the electron-attracting group is a halogen atom, a carbamoyl group, an arylsulfonyl group, or an alkylsulfonyl group, and a carbamoyl group is particularly preferable.

X is preferably an electron-attracting group. As the electron-attracting group, preferable are a halogen atom, an aliphatic arylsulfonyl group, a heterocyclic sulfonyl group, an alkylsulfonyl group, an aliphatic arylacyl group, a heterocyclic acyl group, an aliphatic aryloxycarbonyl group, a heterocyclic oxycarbonyl group, a carbamoyl group, and a sulfamoyl group; more preferable are a halogen atom and a carbamoyl group; and particularly preferable is a bromine atom.

$Z_1$ and $Z_2$ each are preferably a bromine atom or an iodine atom, and more preferably, a bromine atom.

Y preferably represents —C(=O)—, —SO—, —$SO_2$—, —C(=O)N(R)—, or —$SO_2$N(R)—; more preferably, —C(=O)—, —$SO_2$—, or —C(=O)N(R)—; and particularly preferably, —$SO_2$— or —C(=O)N(R)—. Herein, R represents a hydrogen atom, a substituted or unsubstituted aryl group, or a substituted or unsubstituted alkyl group. R is preferably a hydrogen atom or a substituted or unsubstituted alkyl group, and particularly preferably a hydrogen atom.

n represents 0 or 1, and is preferably 1.

In formula (H), in the case where Q is an alkyl group, Y is preferably —C(=O)N(R)—. And, in the case where Q is an aryl group or a heterocyclic group, Y is preferably —$SO_2$—.

In formula (H), the embodiment where the residues, which are obtained by removing a hydrogen atom from the compound, bond to each other (generally called bis type, tris type, or tetrakis type) is also preferably used.

In formula (H), the embodiment having, as a substituent, a dissociative group (for example, a COOH group or a salt thereof, an $SO_3H$ group or a salt thereof, a $PO_3H$ group or a salt thereof, or the like), a group containing a quaternary nitrogen cation (for example, an ammonio group, a pyridinio group, or the like), a polyethyleneoxy group, a hydroxy group, or the like is also preferable.

Specific examples of the compound represented by formula (H) according to the invention are shown below.

H-1

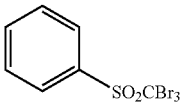

H-2

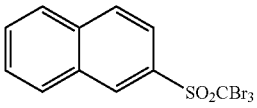

H-3

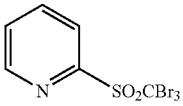

H-4

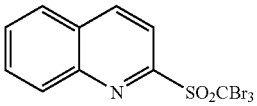

H-5

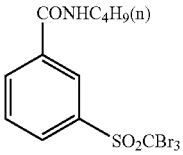

H-6

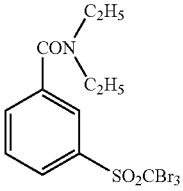

-continued

H-7

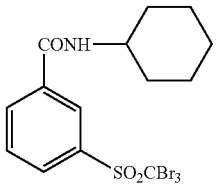

H-8

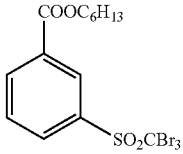

H-9

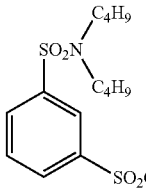

H-10

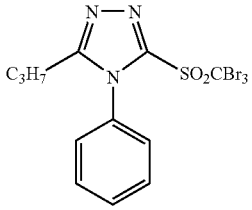

H-11

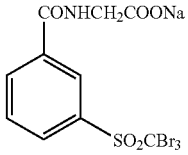

H-12

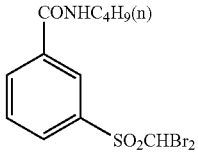

H-13

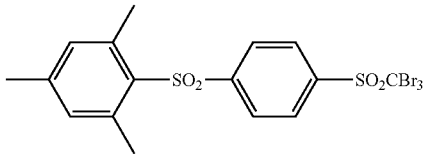

H-14

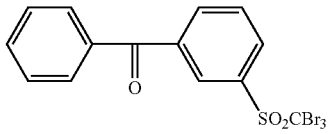

H-15

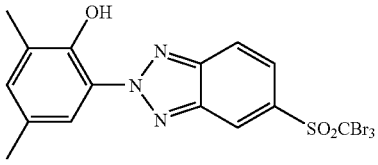

-continued

H-16

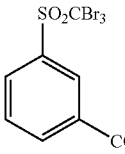

H-17

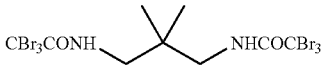

H-18

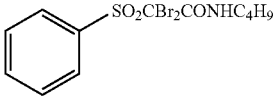

H-19

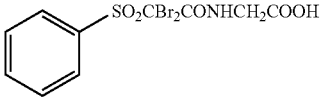

As preferred organic polyhalogen compounds which can be used in the present invention other than those above, there are mentioned compounds described as illustrated compounds of the relevant invention in the specification of U.S. Pat. Nos. 3,874,946, 4,756,999, 5,340,712, 5,369,000, 5,464,737, and 6,506,548, and JP-A Nos. 50-137126, 50-89020, 50-119624, 59-57234, 7-2781, 7-5621, 9-160164, 9-244177, 9-244178, 9-160167, 9-319022, 9-258367, 9-265150, 10-197988, 10-197989, 11-242304, 2000-2963, 2000-112070, 2000-284410, 2000-284412, 2001-33911, 2001-31644, 2001-312027, and 2003-50441. Particularly, the compounds specifically illustrated in JP-A Nos. 7-2781, 2001-33911, and 2001-312027 are preferable.

The compound represented by formula (H) according to the invention is preferably used in an amount of from $10^{-4}$ mol to 1 mol, more preferably from $10^{-3}$ mol to 0.5 mol, and even more preferably from $1\times10^{-2}$ mol to 0.2 mol, per 1 mol of non-photosensitive silver salt incorporated in the image forming layer.

In the invention, methods which can be used for incorporating the antifoggant into the photothermographic material are those described above in the method for incorporating the reducing agent, and also for the organic polyhalogen compound, it is preferably added in the form of a solid fine particle dispersion. 2) Other Antifoggants As other antifoggants, there are mentioned a mercury (II) salt described in paragraph number 0113 of JP-A No. 11-65021, benzoic acids described in paragraph number 0114 of the same literature, a salicylic acid derivative described in JP-A No. 2000-206642, a formalin scavenger compound represented by formula (S) in JP-A No. 2000-221634, a triazine compound related to claim 9 of JP-A No. 11-352624, a compound represented by formula (III), 4-hydroxy-6-methyl-1,3,3a,7-tetrazaindene, described in JP-A No. 6-11791, and the like.

The black and white photothermographic material of the invention may further contain an azolium salt in order to prevent fogging. Azolium salts useful in the present invention include a compound represented by formula (XI) described in JP-A No. 59-193447, a compound described in Japanese Patent Application Publication (JP-B) No. 55-12581, and a compound represented by formula (II) described in JP-A No. 60-153039. The azolium salt may be added to any part of the photothermographic material, but as the layer to be added, it is preferred to select a layer on the side having the image forming layer, and more preferred is to select the image forming layer itself. The azolium salt may be added at any time of the process of preparing the coating solution; in the case where the azolium salt is added into the image forming layer, any time of the process may be selected from the preparation of the organic silver salt to the preparation of the coating solution, but preferred is to add the azolium salt at the time after preparation of the organic silver salt and just prior to coating. As the method for adding the azolium salt, any method such as in the form of powder, a solution, a fine particle dispersion, or the like may be used. Furthermore, the azolium salt may be added as a solution having mixed therein other additives such as a sensitizing agent, reducing agent, toner, or the like.

In the invention, the azolium salt may be added in any amount, but preferably, it is added in an amount of from $1\times10^{-6}$ mol to 2 mol, and more preferably from $1\times10^{-3}$ mol to 0.5 mol, per 1 mol of silver.

(Other Additives)

1) Mercapto Compounds, Disulfides, and Thiones

In the invention, mercapto compounds, disulfide compounds, and thione compounds can be added in order to control the development by suppressing or enhancing development, to improve spectral sensitization efficiency, and to improve storability before development and storability after development. Descriptions can be found in paragraph numbers 0067 to 0069 of JP-A No. 10-62899, as compounds represented by formula (I) and specific examples thereof shown in paragraph numbers 0033 to 0052 of JP-A No. 10-186572, and in lines 36 to 56 in page 20 of EP No. 803,764A1. Among them, mercapto-substituted heterocyclic aromatic compounds described in JP-A Nos. 9-297367, 9-304875, 2001-100358, 2002-303954, 2002-303951, and the like are preferred.

2) Toner

In the black and white photothermographic material of the present invention, addition of a toner is preferred. Description on the toner can be found in JP-A No. 10-62899 (paragraph numbers 0054 and 0055), EP No. 803,764A1 (page 21, lines 23 to 48), JP-A Nos. 2000-356317 and 2000-187298. Preferred are phthalazinones (phthalazinone, phthalazinone derivatives, or metal salts thereof; for example, 4-(1-naphthyl)phthalazinone, 6-chlorophthalazinone, 5,7-dimethoxyphthalazinone, and 2,3-dihydro-1,4-phthalazinedione); combinations of phthalazinones and phthalic acids (e.g., phthalic acid, 4-methylphthalic acid, 4-nitrophthalic acid, diammonium phthalate, sodium phthalate, potassium phthalate, and tetrachlorophthalic anhydride); phthalazines (phthalazine, phthalazine derivatives, or metal salts thereof; for example, 4-(1-naphthyl)phthalazine, 6-isopropylphthalazine, 6-tert-butylphthalazine, 6-chlorophthalazine, 5,7-dimethoxyphthalazine, and 2,3-dihydrophthalazine); and combinations of phthalazines and phthalic acids. Particularly preferred are combinations of phthalazines and phthalic acids. Among them, particularly preferable are the combination of 6-isopropylphthalazine and phthalic acid, and the combination of 6-isopropylphthalazine and 4-methylphthalic acid.

3) Plasticizer and Lubricant

Plasticizers and lubricants which can be used in the image forming layer according to the invention are described in paragraph No. 0117 of JP-A No. 11-65021. Lubricants are described in paragraph Nos. 0061 to 0064 of JP-A No. 11-84573.

4) Dyes and Pigments

From the viewpoints of improving color tone, preventing the generation of interference fringes and preventing irradiation upon laser exposure, various dyes and pigments (for instance, C.I. Pigment Blue 60, C.I. Pigment Blue 64, and C.I. Pigment Blue 15:6) can be used in the image forming layer according to the invention. Detailed description can be found in WO No. 98/36322, JP-A Nos. 10-268465 and 11-338098, and the like.

5) Nucleator

Concerning the black and white photothermographic material of the invention, it is preferred to add a nucleator into the image forming layer. Details on the nucleators, method for their addition, and addition amount can be found in paragraph No. 0118 of JP-A No. 11-65021, paragraph Nos. 0136 to 0193 of JP-A No. 11-223898, as compounds represented by formula (H), (1) to (3), (A), or (B) in JP-A No. 2000-284399; as for a nucleation accelerator, description can be found in paragraph No. 0102 of JP-A No. 11-65021, and in paragraph Nos. 0194 and 0195 of JP-A No. 11-223898.

In the case of using formic acid or formates as a strong fogging agent, it is preferably incorporated at the side having the image forming layer containing a photosensitive silver halide in an amount of 5 mmol or less, and more preferably 1 mmol or less, per 1 mol of silver.

In the case of using a nucleator in the black and white photothermographic material of the invention, it is preferred to use an acid obtained by hydration of diphosphorus pentaoxide, or a salt thereof in combination. Acids obtained by hydration of diphosphorus pentaoxide or salts thereof include metaphosphoric acid (salt), pyrophosphoric acid (salt), orthophosphoric acid (salt), triphosphoric acid (salt), tetraphosphoric acid (salt), hexametaphosphoric acid (salt), and the like. Particularly preferred acids obtained by hydration of diphosphorus pentaoxide or salts thereof include orthophosphoric acid (salt) and hexametaphosphoric acid (salt). Specific examples of the salt include sodium orthophosphate, sodium dihydrogen orthophosphate, sodium hexametaphosphate, ammonium hexametaphosphate, and the like.

The addition amount of the acid obtained by hydration of diphoshorus pentaoxide or the salt thereof (i.e., the coating amount per 1 $m^2$ of the photothermographic material) may be set as desired depending on sensitivity and fogging, but preferred is an amount of from 0.1 $mg/m^2$ to 500 $mg/m^2$, and more preferably from 0.5 $mg/m^2$ to 100 $mg/m^2$.

(Preparation of Coating Solution and coating)

The temperature for preparing the coating solution for the image forming layer according to the invention is preferably from 30° C. to 65° C., more preferably 35° C. or higher and lower than 60° C., and even more preferably from 35° C. to 55° C. Furthermore, the temperature of the coating solution for the image forming layer immediately after adding the polymer latex is preferably maintained within the temperature range of from 30° C. to 65° C.

(Layer Constitution and Constituent Components)

The black and white photothermographic material of the present invention can have a non-photosensitive layer in addition to the image forming layer. Non-photosensitive layers can be classified depending on the layer arrangement into (a) a surface protective layer provided on the image forming layer (on the side farther from the support), (b) an intermediate layer provided among plural image forming layers or between the image forming layer and the protective layer, (c) an undercoat layer provided between the image forming layer and the support, and (d) a back layer which is provided on the opposite side of the support from the image forming layer.

Furthermore, a layer that functions as an optical filter may be provided as (a) or (b) above. An antihalation layer may be provided as (c) or (d) to the photothermographic material.

1) Surface Protective Layer

The black and white photothermographic material of the invention can comprise a surface protective layer with an object to prevent adhesion of the image forming layer, or the like. The surface protective layer may be a single layer or plural layers.

Description on the surface protective layer may be found in paragraph Nos. 0119 and 0120 of JP-A No. 11-65021 and in JP-A No. 2000-171936.

Preferred as the binder of the surface protective layer according to the invention is gelatin, but poly(vinyl alcohol) (PVA) is also preferably used instead, or in combination. As gelatin, there can be used inert gelatin (e.g., Nitta gelatin 750), phthalated gelatin (e.g., Nitta gelatin 801), and the like. Usable as PVA are those described in paragraph Nos. 0009 to 0020 of JP-A No. 2000-171936, and preferred are the completely saponified product PVA-105, the partially saponified product PVA-205 and PVA-335, as well as modified poly (vinyl alcohol) MP-203 (all trade name of products from Kuraray Ltd.), and the like. The amount of coated poly(vinyl alcohol) (per 1 $m^2$ of support) in the protective layer (per one layer) is preferably in a range of from 0.3 $g/m^2$ to 4.0 $g/m^2$, and more preferably from 0.3 $g/m^2$ to 2.0 $g/m^2$.

The total amount of the coated binder (including water-soluble polymer and latex polymer) (per 1 $m^2$ of support) in the surface protective layer (per one layer) is preferably in a range of from 0.3 $g/m^2$ to 5.0 $g/m^2$, and more preferably from 0.3 $g/m^2$ to 2.0 $g/m^2$.

2) Antihalation Layer

The black and white photothermographic material of the present invention can comprise an antihalation layer provided to the side farther from the light source than the image forming layer. It is preferred that an antihalation layer is a back layer or a layer provided between the image forming layer and the support.

Descriptions on the antihalation layer can be found in paragraph Nos. 0123 and 0124 of JP-A No. 11-65021, in JP-A Nos. 11-223898, 9-230531, 10-36695, 10-104779, 11-231457, 11-352625, 11-352626, and the like.

The antihalation layer contains an antihalation dye having its absorption at the wavelength of the exposure light. In the case where the exposure wavelength is in the infrared region, it is enough that an infrared-absorbing dye is used, and in such a case, preferred are dyes having no absorption in the visible light region.

In general, the dye is used in an amount as such that the optical density (absorbance) exceeds 0.1 when measured at the desired wavelength. The optical density is preferably in a range of from 0.15 to 2, and more preferably from 0.2 to 1. The addition amount of dyes to obtain optical density in the above range is generally about from 0.001 $g/m^2$ to 1 $g/m^2$.

3) Back Layer

Back layers that can be used in the invention are described in paragraph Nos. 0128 to 0130 of JP-A No. 11-65021.

In the invention, coloring matters having maximum absorption in the wavelength range of from 300 nm to 450 nm can be added in order to improve color tone of developed silver images and deterioration of the images during aging. Such coloring matters are described in, for example, JP-A Nos. 62-210458, 63-104046, 63-103235, 63-208846, 63-306436, 63-314535, 01-61745, 2001-100363, and the like.

Such coloring matters are generally added in a range of from 0.1 $mg/m^2$ to 1 $g/m^2$, preferably to the back layer which is provided to the opposite side of the support from the image forming layer.

4) Matting Agent

A matting agent is preferably added to the black and white photothermographic material of the invention in order to improve transportability. Description on the matting agent can be found in paragraphs Nos. 0126 and 0127 of JP-A No. 11-65021. The addition amount of the matting agent is preferably in a range of from 1 mg/m$^2$ to 400 mg/m$^2$, and more preferably from 5 mg/m$^2$ to 300 mg/m$^2$, with respect to the coating amount per 1 m$^2$ of the photothermographic material.

The shape of the matting agent that can be used in the invention may be a fixed form or non-fixed form. Preferred is to use those having a fixed form and a spherical shape. The mean particle diameter is preferably in a range of from 0.5 μm to 10 μm, more preferably, from 1.0 μm to 8.0 μm, and even more preferably, from 2.0 μm to 6.0 μm. Furthermore, the particle size distribution of the matting agent is preferably set as such that the variation coefficient is 50% or lower, more preferably 40% or lower, and even more preferably 30% or lower. Herein, the variation coefficient is defined by (the standard deviation of particle diameter)/(mean diameter of the particle)×100. Furthermore, it is preferred to use two types of matting agents having low variation coefficient, in which the ratio of their mean particle diameters being higher than 3, in combination.

The level of matting on the image forming layer surface is not restricted as long as star-dust trouble does not occur, but the level of matting is preferably from 30 sec to 2000 sec, and particularly preferably from 40 sec to 1500 sec, when expressed by a Beck's smoothness. Beck's smoothness can be calculated easily, using Japan Industrial Standard (JIS) P8119 "The method of testing Beck's smoothness for papers and sheets using a Beck's test apparatus", or TAPPI standard method T479.

The level of matting of the back layer in the invention is preferably in a range of 1200 sec or less and 10 sec or more; more preferably, 800 sec or less and 20 sec or more; and even more preferably, 500 sec or less and 40 sec or more, when expressed by a Beck's smoothness.

In the present invention, a matting agent is preferably contained in an outermost layer of the photothermographic material, in a layer which functions as an outermost layer, or in a layer nearer to outer surface, and is also preferably contained in a layer which functions as a so-called protective layer.

5) Film Surface pH

The film surface pH of the black and white photothermographic material of the invention preferably yields a pH of 7.0 or lower, and more preferably 6.6 or lower, before thermal developing processing. Although there is no particular restriction concerning the lower limit, the lower limit of pH value is about 3. The most preferred film surface pH range is from 4 to 6.2. From the viewpoint of reducing the film surface pH, it is preferred to use an organic acid such as a phthalic acid derivative or a non-volatile acid such as sulfuric acid, or a volatile base such as ammonia for the adjustment of the film surface pH. In particular, ammonia is preferably used for the achievement of low film surface pH, because it can easily vaporize to remove it in the coating step or before applying thermal development.

It is also preferred to use a non-volatile base such as sodium hydroxide, potassium hydroxide, lithium hydroxide, or the like, in combination with ammonia. The method of measuring the film surface pH value is described in paragraph No. 0123 of the specification of JP-A No. 2000-284399.

6) Hardener

A hardener may be used in each of the image forming layer, protective layer, back layer, and the like according to the invention. As examples of the hardener, descriptions of various methods can be found in pages 77 to 87 of T. H. James, "THE THEORY OF THE PHOTOGRAPHIC PROCESS, FOURTH EDITION" (Macmillan Publishing Co., Inc., 1977). Preferably used are, in addition to chromium alum, sodium salt of 2,4-dichloro-6-hydroxy-s-triazine, N,N-ethylenebis(vinylsulfonacetamide), and N,N-propylenebis(vinylsulfonacetamide), polyvalent metal ions described in page 78 of the above literature and the like, polyisocyanates described in U.S. Pat. No. 4,281,060, JP-A No. 6-208193, and the like, epoxy compounds of U.S. Pat. No. 4,791,042 and the like, and vinylsulfone compounds of JP-A No. 62-89048 and the like.

The hardener is added as a solution, and this solution is added to the coating solution for the protective layer at the time from 180 minutes before coating to just before coating, and preferably at the time from 60 minutes before coating to 10 seconds before coating. However, so long as the effects of the invention are sufficiently realized, there is no particular restriction concerning the mixing method and the conditions of mixing. As specific mixing methods, there can be mentioned a method of mixing in the tank, in which the average stay time calculated from the flow rate of addition and the feed rate to the coater is controlled to yield a desired time, and a method using static mixer such as described in Chapter 8 of N. Harnby, M. F. Edwards, and A. W. Nienow (translated by Koji Takahashi) "Ekitai Kongo Gijutu (Liquid Mixing Technology)" (Nikkan Kogyo Shinbunsha, 1989), and the like.

7) Surfactant

Concerning the surfactant, the solvent, the support, the antistatic or electrically conductive layer, and the method for obtaining color images applicable in the invention, there can be used those described in paragraph numbers 0132, 0133, 0134, 0135, and 0136, respectively, of JP-A No. 11-65021. Concerning lubricants, there can be used those disclosed in paragraph numbers 0061 to 0064 of JP-A No. 11-84573.

In the invention, it is preferred to use a fluorocarbon surfactant. Specific examples of the fluorocarbon surfactant include the compounds described in JP-A Nos. 10-197985, 2000-19680, and 2000-214554. Polymer fluorocarbon surfactants described in JP-A No. 9-281636 are also used preferably. For the black and white photothermographic material of the invention, the fluorocarbon surfactants described in JP-A Nos. 2002-82411, 2003-57780, and 2001-264110 are preferably used. In the case of conducting coating manufacture with an aqueous coating solution, the usage of the fluorocarbon surfactants described in JP-A Nos. 2003-57780 and 2001-264110 is particularly preferred viewed from the standpoints of capacity in static control, stability of the coated surface state, and sliding capability. The fluorocarbon surfactant described in JP-A No. 2001-264110 is most preferred because of high capacity in static control and that it needs small amount to use.

According to the invention, the fluorocarbon surfactant can be used on either side of the image forming layer side or the backside, but is preferably used on the two sides. Further, it is particularly preferred to use it in combination with an electrically conductive layer including metal oxides described below. In this case, sufficient performance is obtained even if the amount of the fluorocarbon surfactant on the side having the electrically conductive layer is reduced or removed.

The addition amount of the fluorocarbon surfactant is preferably in a range of from 0.1 mg/m$^2$ to 100 mg/m$^2$ on each side of the image forming layer side and backside, more preferably from 0.3 mg/m$^2$ to 30 mg/m$^2$, and even more preferably from 1 mg/m$^2$ to 10 mg/m$^2$. Especially, the fluorocarbon surfactant described in JP-A No. 2001-264110 is effective, and is preferably used in a range of from 0.01 $mg/m^2$ to 10 $mg/m^2$, and more preferably in a range of from 0.1 $mg/m^2$ to 5 $mg/m^2$.

8) Antistatic Agent

The black and white photothermographic material of the invention preferably has an antistatic layer including metal oxides or electrically conductive polymer. The antistatic layer may serve as an undercoat layer, a back surface protective layer, or the like, but can also be placed specially. As an electrically conductive material of the antistatic layer, metal oxides having enhanced electric conductivity by the method of introducing oxygen defects or different types of metallic atoms into the metal oxides are preferable for use. Preferred examples of the metal oxide include ZnO, $TiO_2$, and $SnO_2$. The addition of Al, or In with respect to ZnO, the addition of Sb, Nb, P, halogen element, or the like with respect to $SnO_2$, and the addition of Nb, Ta, or the like with respect to $TiO_2$ are preferred.

Particularly preferred for use is $SnO_2$ combined with Sb. The addition amount of heteroatom is preferably in a range of from 0.01 mol % to 30 mol %, and more preferably in a range of from 0.1 mol % to 10 mol %. The shape of the metal oxide includes, for example, spherical, needle-like, or tabular shape. Needle-like particle, in which a ratio of (the major axis)/(the minor axis) is 2.0 or higher, and more preferably from 3.0 to 50, is preferred viewed from the standpoint of the electric conductivity effect. The metal oxide is preferably used in a range of from 1 $mg/m^2$ to 1000 $mg/m^2$, more preferably from 10 $mg/m^2$ to 500 $mg/m^2$, and even more preferably from 20 $mg/m^2$ to 200 $mg/m^2$.

The antistatic layer according to the invention may be disposed on either side of the image forming layer side or the backside, but it is preferred to set between the support and the back layer.

Specific examples of the antistatic layer according to the invention are described in paragraph Nos. 0135 of JP-A No. 11-65021, in JP-A Nos. 56-143430, 56-143431, 58-62646, and 56-120519, and in paragraph Nos. 0040 to 0051 of JP-A No. 11-84573, in U.S. Pat. No. 5,575,957, and in paragraph Nos. 0078 to 0084 of JP-A No. 11-223898.

9) Support

As the transparent support, preferably used is polyester, particularly, polyethylene terephthalate, which is subjected to heat treatment in the temperature range of from 130° C. to 185° C. in order to relax the internal strain which is caused by biaxial stretching and remaining inside the film, and to remove strain ascribed to heat shrinkage generated during thermal development. In the case of a photothermographic material for medical use, the transparent support may be colored with a blue dye (for instance, dye-1 described in the Example of JP-A No. 8-240877), or may be uncolored. Concerning the support, it is preferred to apply undercoating technology such as water-soluble polyester described in JP-A No. 11-84574, a styrene-butadiene copolymer described in JP-A No. 10-186565, a vinylidene chloride copolymer described in JP-A No. 2000-39684, or the like. The moisture content of the support is preferably 0.5% by weight or lower, when coating for image forming layer or back layer is conducted on the support.

10) Other Additives

Furthermore, an antioxidant, stabilizer, plasticizer, ultraviolet absorber, or film-forming promoting agent may be added to the black and white photothermographic material of the invention. Each of the additives is added to either of the image forming layer or the non-photosensitive layer. Reference can be made to WO No. 98/36322, EP No. 803,764A1, JP-A Nos. 10-186567 and 10-18568, and the like.

11) Coating Method

The black and white photothermographic material of the invention may be coated by any method. Specifically, various types of coating operations including extrusion coating, slide coating, curtain coating, immersion coating, knife coating, flow coating, or an extrusion coating using the type of hopper described in U.S. Pat. No. 2,681,294 are used. Preferably used is slide coating or extrusion coating described in pages 399 to 536 of Stephen F. Kistler and Petert M. Schweizer, "LIQUID FILM COATING" (Chapman & Hall, 1997), and particularly preferably used is slide coating. An example of the shape of the slide coater for use in slide coating is shown in FIG. 11b.1, page 427, of the same literature. If desired, two or more layers can be coated simultaneously by the method described in pages 399 to 536 of the same literature or by the method described in U.S. Pat. No. 2,761,791 and British Patent No. 837,095. Particularly preferable coating method in the invention is the method described in JP-A Nos. 2001-194748, 2002-153808, 2002-153803, and 2002-182333.

The coating solution for the image forming layer according to the invention is preferably a so-called thixotropic fluid. For the details of this technology, reference can be made to JP-A No. 11-52509. Viscosity of the coating solution for the image forming layer according to the invention at a shear velocity of $0.1S^{-1}$ is preferably from 400 mPa·s to 100,000 mPa·s, and more preferably from 500 mPa·s to 20,000 mPa·s. At a shear velocity of $1000S^{-1}$, the viscosity is preferably from 1 mPa·s to 200 mPa·s, and more preferably from 5 mPa·s to 80 mPa·s.

In the case of mixing two types of liquids on preparing the coating solution used for the invention, known in-line mixer or in-plant mixer is preferably used. Preferred in-line mixer used for the invention is described in JP-A No. 2002-85948, and preferred in-plant mixer used for the invention is described in JP-A No. 2002-90940.

The coating solution according to the invention is preferably subjected to antifoaming treatment to maintain the coated surface in a good state. Preferred method for antifoaming treatment in the invention is described in JP-A No. 2002-66431.

In the case of applying the coating solution according to the invention to the support, it is preferred to perform diselectrification in order to prevent adhesion of dust, particulates, and the like due to charging of the support. Preferred example of the method of diselectrification for use in the invention is described in JP-A No. 2002-143747.

Since a non-setting coating solution is used for the image forming layer in the invention, it is important to precisely control the drying air and the drying temperature. Preferred drying method for use in the invention is described in detail in JP-A Nos. 2001-194749 and 2002-139814.

In order to improve film-forming properties in the black and white photothermographic material of the invention, it is preferred to apply heat treatment immediately after coating and drying. The temperature of the heat treatment is preferably in a range of from 60° C. to 100° C. at the film surface, and the time period for heating is preferably in a range of from 1 sec to 60 sec. More preferably, heating is performed in a temperature range of from 70° C. to 90° C. at the film surface, and the time period for heating is from 2 sec to 10 sec. A preferred method of heat treatment for the invention is described in JP-A No. 2002-107872.

Furthermore, the production methods described in JP-A Nos. 2002-156728 and 2002-182333 are preferably employed in order to produce the black and white photothermographic material of the invention stably and successively.

The black and white photothermographic material is preferably of mono-sheet type (i.e., a type which forms an image on the photothermographic material without using other sheets such as an image-receiving material).

12) Wrapping Material

In order to suppress fluctuation from occurring on photographic performance during raw stock storage of the black and white photothermographic material of the invention, or in order to improve curling or winding tendencies when the black and white photothermographic material is manufactured in a roll state, it is preferred that a wrapping material having low oxygen permeability and/or moisture permeability is used. Preferably, oxygen permeability is 50 $mL \cdot atm^{-1} m^{-2} day^{-1}$ or lower at 25° C., more preferably 10 $mL \cdot atm^{-1} m^{-2} day^{-1}$ or lower, and even more preferably 1.0 $mL \cdot atm^{-1} m^{-2} day^{-1}$ or lower. Preferably, moisture permeability is 10 $g \cdot atm^{-1} m^{-2} day^{-1}$ or lower, more preferably 5 $g \cdot atm^{-1} m^{-2} day^{-1}$ or lower, and even more preferably 1 $g \cdot atm^{-1} m^{-2} day^{-1}$ or lower.

As specific examples of a wrapping material having low oxygen permeability and/or moisture permeability, reference can be made to, for instance, the wrapping material described in JP-A Nos. 8-254793 and 2000-206653.

13) Other Applicable Techniques

Techniques which can be used for the black and white photothermographic material of the invention also include those in EP No. 803,764A1, EP No. 883,022A1, WO No. 98/36322, JP-A Nos. 56-62648 and 58-62644, JP-A Nos. 9-43766, 9-281637, 9-297367, 9-304869, 9-311405, 9-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, and 11-343420, JP-A Nos. 2000-187298, 2000-10229, 2000-47345, 2000-206642, 2000-98530, 2000-98531, 2000-112059, 2000-112060, 2000-112104, 2000-112064, and 2000-171936.

(Image forming Method)

1) Imagewise Exposure

The black and white photothermographic material of the invention may be subjected to imagewise exposure by any means. Preferably, the black and white photothermographic material of the present invention is subjected to scanning exposure using a laser beam. As preferred laser beam which can be used in the invention, He—Ne laser of red through infrared emission, red laser diode, or $Ar^+$, He—Ne, He—Cd laser of blue through green emission, and blue laser diode are described. Preferred is red to infrared laser diode and the peak wavelength of laser beam is from 600 nm to 900 nm, and preferably from 620 nm to 850 nm.

In recent years, development has been made particularly on a light source module with an SHG (a second harmonic generator) device and a laser diode integrated into a single piece, and on a blue laser diode, whereby a laser output apparatus in a short wavelength region has become popular. A blue laser diode enables high definition image recording and makes it possible to obtain an increase in recording density and a stable output over a long lifetime, which results in expectation of an expanded demand in the future. The peak wavelength of blue laser beam is preferably from 300 nm to 500 nm, and particularly preferably from 400 nm to 500 nm.

Laser beam which oscillates in a longitudinal multiple modulation by a method such as high frequency superposition is also preferably employed.

2) Thermal development

Although any method may be used for developing the black and white photothermographic material of the present invention, development is usually performed by elevating the temperature of the black and white photothermographic material exposed imagewise. The temperature of development is preferably from 80° C. to 250° C., more preferably from 100° C. to 140° C., and even more preferably from 110° C. to 130° C. The time period for development is preferably from 1 sec to 60 sec, more preferably from 3 sec to 30 sec, and even more preferably from 5 sec to 25 sec.

In the process of thermal development, either a drum type heater or a plate type heater may be used, although a plate type heater is preferred. A preferable process of thermal development by a plate type heater is a process described in JP-A No. 11-133572, which discloses a thermal developing apparatus in which a visible image is obtained by bringing a photothermographic material with a formed latent image into contact with a heating means at a thermal developing portion, wherein the heating means comprises a plate heater, and a plurality of pressing rollers are oppositely provided along one surface of the plate heater, and the thermal developing apparatus is characterized in that thermal development is performed by passing the photothermographic material between the pressing rollers and the plate heater. It is preferred that the plate heater is divided into 2 to 6 steps, with the leading end having a lower temperature by 1° C. to 10° C. For example, 4 sets of plate heaters which can be independently subjected to the temperature control are used, and are controlled so that they respectively become 112° C., 119° C., 121° C., and 120° C. Such a process is also described in JP-A No. 54-30032, which allows for passage of moisture and organic solvents included in the photothermographic material out of the system, and also allows for suppressing the change in shapes of the support of the photothermographic material upon rapid heating of the photothermographic material.

For downsizing the thermal developing apparatus and for reducing the time period for thermal development, it is preferred that the heater is more stably controlled and that the top part of one sheet of the photothermographic material is imagewise exposed and thermal development of the exposed part is started before exposure of the end part of the sheet has completed.

Preferable imagers which enable a rapid processing according to the invention are described in, for example, JP-A Nos. 2002-289804 and 2002-287668.

APPLICATION OF THE INVENTION

The black and white photothermographic material of the present invention is preferably employed as mono-sheet type photothermographic materials for use in medical diagnosis, through forming black and white images by silver imaging and being observed directly on the material, but may also be employed as photothermographic materials for use in industrial photographs, photothermographic materials for use in graphic arts, as well as for COM.

All publications, patent applications, and technical standards mentioned in this specification are herein incorporated by reference to the same extent as if each individual publication, patent application, or technical standard was specifically and individually indicated to be incorporated by reference.

EXAMPLES

The present invention is specifically explained by way of Examples below, which should not be construed as limiting the invention thereto.

Example 1

1. Preparation of PET Support 1-1. Film Manufacturing

PET having IV (intrinsic viscosity) of 0.66 (measured in phenol/tetrachloroethane=6/4 (by weight ratio) at 25° C.) was obtained according to a conventional manner using terephthalic acid and ethylene glycol. The product was pelletized, dried at 130° C. for 4 hours, and melted at 300° C. Thereafter, the mixture was extruded from a T-die and rapidly cooled to form a non-tentered film.

The film was stretched along the longitudinal direction by 3.3 times using rollers of different peripheral speeds, and then stretched along the transverse direction by 4.5 times using a tenter machine. The temperatures used for these operations were 110° C. and 130° C., respectively. Then, the film was subjected to thermal fixation at 240° C. for 20 seconds, and relaxed by 4% along the transverse direction at the same temperature. Thereafter, the chucking part of the tenter machine was slit off, and both edges of the film were knurled. Then the film was rolled up at the tension of 4 kg/cm$^2$ to obtain a roll having a thickness of 175 μm.

1-2. Surface Corona Discharge Treatment

Both surfaces of the support were treated at room temperature at 20 m/minute using Solid State Corona Discharge Treatment Machine Model 6KVA manufactured by Piller GmbH. It was proven that treatment of 0.375 kV·A·minute/m$^2$ was executed, judging from the readings of current and voltage on that occasion. The frequency upon this treatment was 9.6 kHz, and the gap clearance between the electrode and dielectric roll was 1.6 mm.

1-3. Undercoating

1) Preparation of Coating Solutions for Undercoat Layer

| Formula (1) (for undercoat layer on the image forming layer side) | |
|---|---|
| Pesresin A-520 manufactured by Takamatsu Oil & Fat Co., Ltd. (30% by weight solution) | 46.8 g |
| BAIRONAARU MD-1200 manufactured by Toyo Boseki Co., Ltd. | 10.4 g |
| Polyethylene glycol monononylphenyl ether (average number of ethylene oxide = 8.5) 1% by weight solution | 11.0 g |
| MP-1000 manufactured by Soken Chemical & Engineering Co., Ltd. (PMMA polymer fine particles, mean particle diameter of 0.4 μm) | 0.91 g |
| Distilled water | 931 mL |
| **Formula (2) (for first layer on the backside)** | |
| Styrene-butadiene copolymer latex (solid content of 40% by weight, styrene/butadiene weight ratio = 68/32) | 130.8 g |
| Sodium salt of 2,4-dichloro-6-hydroxy-S-triazine (8% by weight aqueous solution) | 5.2 g |
| 1% by weight aqueous solution of sodium laurylbenzenesulfonate | 10 mL |
| Polystyrene particle dispersion (mean particle diameter of 2 μm, 20% by weight) | 0.5 g |
| Distilled water | 854 mL |
| **Formula (3) (for second layer on the backside)** | |
| $SnO_2$/SbO (9/1 by weight ratio, mean particle diameter of 0.5 μm, 17% by weight dispersion) | 84 g |

-continued

| | |
|---|---|
| Gelatin | 7.9 g |
| METOLOSE TC-5 manufactured by Shin-Etsu Chemical Co., Ltd. (2% by weight aqueous solution) | 10 g |
| 1% by weight aqueous solution of sodium dodecylbenzenesulfonate | 10 mL |
| NaOH (1% by weight) | 7 g |
| Proxel (manufactured by Imperial Chemical Industries PLC) | 0.5 g |
| Distilled water | 881 mL |

2) Undercoating

Both surfaces of the biaxially stretched polyethylene terephthalate support having the thickness of 175 μm were subjected to the corona discharge treatment described above, respectively. Thereafter, the aforementioned formula (1) of the coating solution for the undercoat was coated on one side (image forming layer side) with a wire bar so that the amount of wet coating became 6.6 mL/m$^2$ (per one side), and dried at 180° C. for 5 minutes. Then, the aforementioned formula (2) of the coating solution for the undercoat was coated on the reverse side (backside) with a wire bar so that the amount of wet coating became 5.7 mL/m$^2$, and dried at 180° C. for 5 minutes. Furthermore, the aforementioned formula (3) of the coating solution for the undercoat was coated on the reverse side (backside) with a wire bar so that the amount of wet coating became 8.4 mL/m$^2$, and dried at 180° C. for 6 minutes. Thus, an undercoated support was produced.

2. Back Layer

1) Preparation of Coating Solutions for Back Layer (Preparation of Dispersion of Solid Fine Particles (a) of Base Precursor)

2.5 kg of base precursor-1, 300 g of surfactant (trade name: DEMOL N, manufactured by Kao Corporation), 800 g of diphenyl sulfone, and 1.0 g of benzisothiazolinone sodium salt were mixed with distilled water to give the total amount of 8.0 kg. This mixed liquid was subjected to beads dispersion using a horizontal sand mill (UVM-2: manufactured by AIMEX Co., Ltd.). The process of dispersion includes feeding the mixed liquid to UVM-2 packed with zirconia beads having a mean particle diameter of 0.5 mm with a diaphragm pump, followed by dispersion at the inner pressure of 50 hPa or higher until desired mean particle diameter could be achieved.

Dispersion was continued until the ratio of the optical density at 450 nm to the optical density at 650 nm for the spectral absorption of the dispersion ($D_{450}/D_{650}$) became 3.0 upon spectral absorption measurement. The resulting dispersion was diluted with distilled water so that the concentration of the base precursor became 25% by weight, and filtrated (with a polypropylene filter having a mean fine pore diameter of 3 μm) for eliminating dust to put into practical use.

(Preparation of Solid Fine Particle Dispersion of Dye)

Cyanine dye-1 in an amount of 6.0 kg, 3.0 kg of sodium p-dodecylbenzenesulfonate, 0.6 kg of surfactant DEMOL SNB (manufactured by Kao Corporation), and 0.15 kg of antifoaming agent (trade name: SURFYNOL 104E, manufactured by Nissin Chemical Industry Co., Ltd.) were mixed with distilled water to give the total amount of 60 kg. The mixed liquid was subjected to dispersion with 0.5 mm zirconia beads using a horizontal sand mill (UVM-2: manufactured by AIMEX Co., Ltd.).

Dispersion was continued until the ratio of the optical density at 650 nm to the optical density at 750 nm for the spectral absorption of the dispersion ($D_{650}/D_{750}$) became 5.0 or higher upon spectral absorption measurement. The resulting dispersion was diluted with distilled water so that the concentration of the cyanine dye became 6% by weight, and filtrated with a filter (mean fine pore diameter: 1 μm) for eliminating dust to put into practical use.

(Preparation of Coating Solution for Antihalation Layer)

A vessel was kept at 40° C., and thereto were added 37 g of gelatin having an isoelectric point of 6.6 (ABA gelatin, manufactured by Nippi Co., Ltd.), 0.1 g of benzisothiazolinone, and water to allow gelatin to be dissolved. Additionally, 36 g of the above-mentioned dispersion of the solid fine particles of the dye, 73 g of the above-mentioned dispersion of the solid fine particles (a) of the base precursor, 43 mL of a 3% by weight aqueous solution of sodium polystyrenesulfonate, and 82 g of a 10% by weight liquid of SBR latex (styrene/butadiene/acrylic acid copolymer; weight ratio of the copolymerization of 68.3/28.7/3.0) were admixed to provide a coating solution for the antihalation layer in an amount of 773 mL. The pH of the resulting coating solution was 6.3.

(Preparation of Coating Solution for Back Surface Protective Layer)

A vessel was kept at 40° C., and thereto were added 43 g of gelatin having an isoelectric point of 4.8 (PZ gelatin, manufactured by Miyagi Chemical Industry Co., Ltd.), 0.21 g of benzisothiazolinone, and water to allow gelatin to be dissolved. Additionally, 8.1 mL of 1 mol/L sodium acetate aqueous solution, 0.93 g of fine particles of monodispersed poly (ethylene glycol dimethacrylate-co-methyl methacrylate) (mean particle size of 7.7 μm, standard deviation of particle diameter of 0.3), 5 g of a 10% by weight emulsified dispersion of liquid paraffin, 10 g of a 10% by weight emulsified dispersion of dipentaerythritol hexaisostearate, 10 mL of a 5% by weight aqueous solution of di(2-ethylhexyl) sodium sulfosuccinate, 17 mL of a 3% by weight aqueous solution of sodium polystyrenesulfonate, 2.4 mL of a 2% by weight solution of fluorocarbon surfactant (F-1), 2.4 mL of a 2% by weight solution of fluorocarbon surfactant (F-2), and 30 mL of a 20% by weight liquid of ethyl acrylate/acrylic acid copolymer (weight ratio of the copolymerization of 96.4/3.6) latex were admixed. Just prior to coating, 50 mL of a 4% by weight aqueous solution of N,N-ethylenebis(vinylsulfone acetamide) was admixed to provide a coating solution for the back surface protective layer in an amount of 855 mL. The pH of the resulting coating solution was 6.2.

2) Coating of Back Layer

The backside of the undercoated support described above was subjected to simultaneous double coating so that the coating solution for the antihalation layer gave the coating amount of gelatin of 0.54 g/m$^2$, and so that the coating solution for the back surface protective layer gave the coating amount of gelatin of 1.85 g/m$^2$, followed by drying to produce a back layer.

3. Image Forming Layer, Intermediate Layer, and Surface Protective Layer 3-1. Preparation of Coating Materials 1) Silver Halide Emulsion <<Preparation of Silver Halide Emulsion 1>>

A liquid was prepared by adding 3.1 mL of a 1% by weight solution of potassium bromide, and then 3.5 mL of 0.5 mol/L sulfuric acid and 31.7 g of phthalated gelatin to 1421 mL of distilled water. The liquid was kept at 30° C. while stirring in a stainless-steel reaction vessel, and thereto were added a total amount of: solution A prepared through diluting 22.22 g of silver nitrate by adding distilled water to give the volume of 95.4 mL; and solution B prepared through diluting 15.3 g of potassium bromide and 0.8 g of potassium iodide with distilled water to give the volume of 97.4 mL, over 45 seconds at a constant flow rate. Thereafter, 10 mL of a 3.5% by weight aqueous solution of hydrogen peroxide was added thereto, and 10.8 mL of a 10% by weight aqueous solution of benzimidazole was further added. Moreover, solution C prepared through diluting 51.86 g of silver nitrate by adding distilled water to give the volume of 317.5 mL and solution D prepared through diluting 44.2 g of potassium bromide and 2.2 g of potassium iodide with distilled water to give the volume of 400 mL were added. A controlled double jet method was executed through adding the solution C in its entirety at a constant flow rate over 20 minutes, accompanied by adding the solution D while maintaining the pAg at 8.1. Potassium hexachloroiridate (III) was added in its entirety to give $1\times10^{-4}$ mol per 1 mol of silver, at 10 minutes post initiation of the addition of the solution C and the solution D. Moreover, at 5 seconds after completing the addition of the solution C, an aqueous solution of potassium hexacyanoferrate (II) was added in its entirety to give $3\times10^{-4}$ mol per 1 mol of silver. The mixture was adjusted to the pH of 3.8 with 0.5 mol/L sulfuric acid. After stopping stirring, the mixture was subjected to precipitation/desalting/water washing steps. The mixture was adjusted to the pH of 5.9 with 1 mol/L sodium hydroxide to produce a silver halide dispersion having the pAg of 8.0.

The above-described silver halide dispersion was kept at 38° C. with stirring, and thereto was added 5 mL of a 0.34% by weight methanol solution of 1,2-benzisothiazolin-3-one, followed by elevating the temperature to 47° C. at 40 minutes thereafter. At 20 minutes after elevating the temperature, sodium benzenethiosulfonate in a methanol solution was added at $7.6\times10^{-5}$ mol per 1 mol of silver. At additional 5 minutes later, tellurium sensitizer C in a methanol solution was added at $2.9\times10^{-4}$ mol per 1 mol of silver, and the mixture was subjected to ripening for 91 minutes. Thereafter, a methanol solution of spectral sensitizing dye A and spectral sensitizing dye B with a molar ratio of 3:1 was added thereto at $1.2\times10^{-3}$ mol in total of the spectral sensitizing dyes A and B per 1 mol of silver. At one minute later, 1.3 mL of a 0.8% by weight methanol solution of N,N'-dihydroxy-N",N"-diethylmelamine was added thereto, and at additional 4 minutes thereafter, 5-methyl-2-mercaptobenzimidazole in a methanol solution at $4.8\times10^{-3}$ mol per 1 mol of silver, 1-phenyl-2-heptyl-5-mercapto-1,3,4-triazole in a methanol solution at $5.4\times10^{-3}$ mol per 1 mol of silver, and 1-(3-methylureidophenyl)-5-mercaptotetrazole in an aqueous solution at $8.5\times10^{-3}$ mol per 1 mol of silver were added to produce silver halide emulsion 1.

Grains in thus prepared silver halide emulsion were silver iodobromide grains having a mean equivalent spherical diameter of 0.042 μm, a variation coefficient of an equivalent spherical diameter distribution of 20%, which uniformly include iodine at 3.5 mol %. Grain size and the like were determined from the average of 1000 grains using an electron microscope. The {100} face ratio of these grains was found to be 80% using a Kubelka-Munk method.

<<Preparation of Silver Halide Emulsion 2>>

Preparation of silver halide emulsion 2 was conducted in a similar manner to the process in the preparation of the silver halide emulsion 1 except that: the temperature of the liquid at the time of grain formation was altered from 30° C. to 47° C.; the solution B was changed to that prepared through diluting 15.9 g of potassium bromide with distilled water to give the volume of 97.4 mL; the solution D was changed to that prepared through diluting 45.8 g of potassium bromide with distilled water to give the volume of 400 mL; the time period for adding the solution C was changed to 30 minutes; and potassium hexacyanoferrate (II) was deleted. Further, precipitation/desalting/water washing/dispersion were carried out similar to the silver halide emulsion 1. Furthermore, spectral sensitization, chemical sensitization, and addition of 5-methyl-2-mercaptobenzimidazole and 1-phenyl-2-heptyl-5-mercapto-1,3,4-triazole were executed similar to those in the preparation of the silver halide emulsion 1 except that: the amount of the tellurium sensitizer C to be added was changed to $1.1\times10^{-4}$ mol per 1 mol of silver; the amount of the methanol solution of spectral sensitizing dye A and spectral sensitizing dye B with a molar ratio of 3:1 to be added was changed to $7.0\times10^{-4}$ mol in total of the spectral sensitizing dyes A and B per 1 mol of silver; the addition of 1-phenyl-2-heptyl-5-mercapto-1,3,4-triazole was changed to give $3.3\times10^{-3}$ mol per 1 mol of silver; and the addition of 1-(3-methylureidophenyl)-5-mercaptotetrazole was changed to give $4.7\times10^{-3}$ mol per 1 mol of silver. Thereby, silver halide emulsion 2 was obtained. Grains in the silver halide emulsion 2 were cubic pure silver bromide grains having a mean equivalent spherical diameter of 0.080 μm and a variation coefficient of an equivalent spherical diameter distribution of 20%.

<<Preparation of Silver Halide Emulsion 3>>

Preparation of silver halide emulsion 3 was conducted in a similar manner to the process in the preparation of the silver halide emulsion 1 except that the temperature of the liquid at the time of grain formation was altered from 30° C. to 27° C. Further, precipitation/desalting/water washing/dispersion were carried out similar to the silver halide emulsion 1. Silver halide emulsion 3 was obtained similar to the silver halide emulsion 1 except that: the spectral sensitizing dye A and the spectral sensitizing dye B were added as a solid dispersion (aqueous gelatin solution) at a molar ratio of 1:1 with the amount to be added being $6\times10^{-3}$ mol in total of the spectral sensitizing dyes A and B per 1 mol of silver; the addition amount of the tellurium sensitizer C was changed to $5.2\times10^{-4}$ mol per 1 mol of silver; and bromoauric acid at $5\times10^{-4}$ mol per 1 mol of silver and potassium thiocyanate at $2\times10^{-3}$ mol per 1 mol of silver were added at 3 minutes following the addition of the tellurium sensitizer. Grains in the silver halide emulsion 3 were silver iodobromide grains having a mean equivalent spherical diameter of 0.034 μm and a variation coefficient of an equivalent spherical diameter distribution of 20%, which uniformly include iodine at 3.5 mol %.

<<Preparation of Mixed Emulsion A for Coating Solution>>

The silver halide emulsion 1 at 70% by weight, the silver halide emulsion 2 at 15% by weight, and the silver halide emulsion 3 at 15% by weight were dissolved, and thereto was added benzothiazolium iodide in a 1% by weight aqueous solution to give $7\times10^{-3}$ mol per 1 mol of silver.

Further, as "a compound that is one-electron-oxidized to provide a one-electron oxidation product which releases one or more electrons", the compounds Nos. 1, 2, and 3 were added respectively in an amount of $2\times10^{-3}$ mol per 1 mol of silver in silver halide.

Thereafter, as "a compound having an adsorptive group and a reducing group", the compound Nos. 1 and 2 were added respectively in an amount of $5\times10^{-3}$ mol per 1 mol of silver halide.

Further, water was added thereto to give the content of silver of 38.2 g per 1 kg of the mixed emulsion for a coating solution, and 1-(3-methylureidophenyl)-5-mercaptotetrazole was added to give 0.34 g per 1 kg of the mixed emulsion for a coating solution.

2) Preparation of Dispersion of Silver Salt of Fatty Acid

<Preparation of Recrystallized Behenic Acid>

Behenic acid manufactured by Henkel Co. (trade name: Edenor C22-85R) in an amount of 100 kg was admixed with 1200 kg of isopropyl alcohol, and dissolved at 50° C. The mixture was filtrated through a 10 μm filter, and cooled to 30C to allow recrystallization. Cooling speed for the recrystallization was controlled to be 3° C./hour. The resulting crystal was subjected to centrifugal filtration, and washing was performed with 100 kg of isopropyl alcohol. Thereafter, the crystal was dried. The resulting crystal was esterified, and subjected to GC-FID analysis to give the result of the content of behenic acid being 96%. In addition, lignoceric acid, arachidic acid, and erucic acid were included in an amount of 2%, 2%, and 0.001%, respectively.

<Preparation of Dispersion of Silver Salt of Fatty Acid>

88 kg of the recrystallized behenic acid, 422 L of distilled water, 49.2 L of 5 mol/L sodium hydroxide aqueous solution, and 120 L of t-butyl alcohol were admixed, and subjected to reaction with stirring at 75° C. for one hour to provide a solution of sodium behenate. Separately, 206.2 L of an aqueous solution containing 40.4 kg of silver nitrate (pH 4.0) was provided, and kept at a temperature of 10° C. A reaction vessel charged with 635 L of distilled water and 30 L of t-butyl alcohol was kept at 30° C., and thereto were added the total amount of the solution of sodium behenate and the total amount of the aqueous solution of silver nitrate with sufficient stirring at a constant flow rate over 93 minutes and 15 seconds, and 90 minutes, respectively.

In this process, during first 11 minutes following the initiation of adding the aqueous solution of silver nitrate, the added material was restricted to the aqueous solution of silver nitrate alone. The addition of the solution of sodium behenate was thereafter started, and during 14 minutes and 15 seconds following the completion of adding the aqueous solution of silver nitrate, the added material was restricted to the solution of sodium behenate alone. In this process, the temperature inside of the reaction vessel was set to be 30° C. and the temperature outside was controlled so that the temperature of the liquid was kept constant. In addition, the temperature of a pipeline for the addition system of the solution of sodium behenate was kept constant by circulation of warm water outside of a double wall pipe, so that the temperature of the liquid at an outlet in the leading edge of the nozzle for addition was adjusted to be 75° C. Further, the temperature of a pipeline for the addition system of the aqueous solution of silver nitrate was kept constant by circulation of cool water outside of a double wall pipe. The position at which the solution of sodium behenate was added and the position at which the aqueous solution of silver nitrate was added were arranged symmetrically with a shaft for stirring located at a center. Moreover, both of the positions were adjusted to avoid contact with the reaction liquid.

After completing the addition of the solution of sodium behenate, the mixture was left to stand at the temperature as it was for 20 minutes while stirring. The temperature of the mixture was then elevated to 35° C. over 30 minutes followed by ripening for 210 minutes. Immediately after completing the ripening, solid matters were filtered out with centrifugal filtration. The solid matters were washed with water until the electric conductivity of the filtrated water became 30 μS/cm. Thereby, a silver salt of a fatty acid was obtained. The resulting solid matters were stored as a wet cake without drying.

When the shape of the resulting particles of silver behenate was evaluated by electron micrography, a crystal was revealed having a=0.21 μm, b=0.4 μm and c=0.4 μm on the average value, with a mean aspect ratio of 2.1, and a variation coefficient of an equivalent spherical diameter distribution of 11% (a, b, and c are as defined aforementioned.).

To the wet cake corresponding to 260 kg of a dry solid matter content, were added 19.3 kg of poly(vinyl alcohol)

(trade name: PVA-217) and water to give the total amount of 1000 kg. Then, slurry was obtained from the mixture using a dissolver blade. Additionally, the slurry was subjected to preliminary dispersion with a pipeline mixer (manufactured by MIZUHO Industrial Co., Ltd.: PM-10 type).

Next, a stock liquid after the preliminary dispersion was treated three times using a dispersing machine (trade name: Microfluidizer M-610, manufactured by Microfluidex International Corporation, using Z type Interaction Chamber) with the pressure controlled to be 1150 kg/cm$^2$ to provide a dispersion of silver behenate. For the cooling operation, coiled heat exchangers were equipped in front of and behind the interaction chamber respectively, and accordingly, the temperature for the dispersion was set to be 18° C. by regulating the temperature of the cooling medium.

3) Preparation of Dispersion of Reducing Agent for Silver Ions

<<Dispersion of Comparative Reducing Agent>>

Reducing agent-1 and reducing agent-2 were used as comparative reducing agents to prepare dispersions of comparative reducing agent.

To 10 kg of the reducing agent and 16 kg of a 10% by weight aqueous solution of modified poly(vinyl alcohol) (manufactured by Kuraray Co., Ltd., Poval MP-203) was added 10 kg of water, and thoroughly mixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours. Thereafter, 0.2 g of benzisothiazolinone sodium salt and water were added thereto, thereby adjusting the concentration of the reducing agent to be 25% by weight. This dispersion was subjected to heat treatment at 60° C. for 5 hours. Thereby, the dispersion of comparative reducing agent-1 and the dispersion of comparative reducing agent-2 were obtained.

Particles of the reducing agent included in the resulting reducing agent dispersion had a median diameter of 0.40 μm, and a maximum particle diameter of 1.4 μm or less. The resulting reducing agent dispersion was subjected to filtration with a polypropylene filter having a pore size of 3.0 μm to remove foreign substances such as dust, and stored.

<<Dispersion of Compound of Formula (PP)>>

Preparation of dispersion of the compound of formula (PP) (shown in Table 1) was conducted in a similar manner to the process in the preparation of the dispersion of comparative reducing agent.

4) Preparation of Hydrogen Bonding Compound Dispersion

To 10 kg of hydrogen bonding compound-1 (tri(4-t-butylphenyl)phosphineoxide) and 16 kg of a 10% by weight aqueous solution of modified poly(vinyl alcohol) (manufactured by Kuraray Co., Ltd., Poval MP-203) was added 10 kg of water, and thoroughly mixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 4 hours. Thereafter, 0.2 g of benzisothiazolinone sodium salt and water were added thereto, thereby adjusting the concentration of the hydrogen bonding compound to be 25% by weight. This dispersion was heated at 40° C. for one hour, followed by a subsequent heat treatment at 80° C. for one hour to obtain hydrogen bonding compound-1 dispersion. Particles of the hydrogen bonding compound included in the resulting hydrogen bonding compound dispersion had a median diameter of 0.45 μm, and a maximum particle diameter of 1.3 μm or less. The resulting hydrogen bonding compound dispersion was subjected to filtration with a polypropylene filter having a pore size of 3.0 μm to remove foreign substances such as dust, and stored.

5) Preparation of Development Accelerator Dispersion

To the development accelerator according to the invention (shown in Table 1) in an amount of 10 kg and 20 kg of a 10% by weight aqueous solution of modified poly(vinyl alcohol) (manufactured by Kuraray Co., Ltd., Poval MP-203) was added 10 kg of water, and thoroughly mixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 3 hours and 30 minutes. Thereafter, 0.2 g of benzisothiazolinone sodium salt and water were added thereto, thereby adjusting the concentration of the development accelerator to be 20% by weight. Thereby, a development accelerator dispersion was obtained. Particles of the development accelerator included in the resulting development accelerator dispersion had a median diameter of 0.48 μm, and a maximum particle diameter of 1.4 μm or less. The resulting development accelerator dispersion was subjected to filtration with a polypropylene filter having a pore size of 3.0 μm to remove foreign substances such as dust, and stored.

6) Preparation of Organic Polyhalogen Compound Dispersion

<Preparation of Organic Polyhalogen Compound-1 Dispersion>

10 kg of organic polyhalogen compound-1 (tribromomethane sulfonylbenzene), 10 kg of a 20% by weight aqueous solution of modified poly(vinyl alcohol) (manufactured by Kuraray Co., Ltd., Poval MP-203), 0.4 kg of a 20% by weight aqueous solution of sodium triisopropylnaphthalenesulfonate and 14 kg of water were thoroughly admixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of benzisothiazolinone sodium salt and water were added thereto, thereby adjusting the concentration of the organic polyhalogen compound to be 30% by weight. Accordingly, organic polyhalogen compound-1 dispersion was obtained. Particles of the organic polyhalogen compound included in the resulting organic polyhalogen compound dispersion had a median diameter of 0.41 μm, and a maximum particle diameter of 2.0 μm or less. The resulting organic polyhalogen compound dispersion was subjected to filtration with a polypropylene filter having a pore size of 10.0 μm to remove foreign substances such as dust, and stored.

<Preparation of Organic Polyhalogen Compound-2 Dispersion>

10 kg of organic polyhalogen compound-2 (N-butyl-3-tribromomethane sulfonylbenzamide), 20 kg of a 10% by weight aqueous solution of modified poly(vinyl alcohol) (manufactured by Kuraray Co., Ltd., Poval MP-203) and 0.4 kg of a 20% by weight aqueous solution of sodium triisopropylnaphthalenesulfonate were thoroughly admixed to give slurry. This slurry was fed with a diaphragm pump, and was subjected to dispersion with a horizontal sand mill (UVM-2: manufactured by AIMEX Co., Ltd.) packed with zirconia beads having a mean particle diameter of 0.5 mm for 5 hours. Thereafter, 0.2 g of benzisothiazolinone sodium salt and water were added thereto, thereby adjusting the concentration of the organic polyhalogen compound to be 30% by weight. This dispersion was warmed at 40° C. for 5 hours to obtain organic polyhalogen compound-2 dispersion. Particles of the organic polyhalogen compound included in the resulting organic polyhalogen compound dispersion had a median diameter of 0.40 μm, and a maximum particle diameter of 1.3 μm or less. The resulting organic polyhalogen compound dispersion was subjected to filtration with a polypropylene filter having a pore size of 3.0 μm to remove foreign substances such as dust, and stored.

7) Preparation of Dispersion A of Silver Salt of Benzotriazole 1 kg of benzotriazole was added to a liquid prepared by dissolving 360 g of sodium hydroxide in 9100 mL of water, and then the mixture was stirred for 60 minutes. Thereby, solution BT of sodium salt of benzotriazole was prepared. A liquid prepared by dissolving 55.9 g of alkali-processed deionized gelatin in 1400 mL of distilled water was kept at 70° C. while stirring in a stainless-steel reaction vessel. And then, solution A prepared through diluting 54.0 g of silver nitrate by adding distilled water to give the volume of 400 mL, and solution B prepared through diluting 397 mL of the solution BT of sodium salt of benzotriazole with distilled water to give the volume of 420 mL were added. A method of double jet was executed through adding 220 mL of the solution B at a constant flow rate of 20 mL/min over 11 minutes to the stainless-steel reaction vessel, and at one minute post initiation of the addition of the solution B, 200 mL of the solution A was added thereto at a constant flow rate of 20 mL/min over 10 minutes. Moreover, at 6 minutes later after completing the addition, the solution A and the solution B were added simultaneously at a constant flow rate of 33.34 mL/min over 6 minutes in an amount of 200 mL respectively. The mixture was cooled to 45° C., and 92 mL of Demol N (10% aqueous solution, manufactured by Kao Corporation) was added to the mixture while stirring. The mixture was adjusted to the pH of 4.1 with 1 mol/L sulfuric acid. After stopping stirring, the mixture was subjected to precipitation/desalting/water washing steps.

Thereafter, the resulting mixture was warmed to 50° C. and 51 mL of 1 mol/L sodium hydroxide was added thereto while stirring, and then 11 mL of a methanol solution of benzoisothiazolinone (3.5%) and 7.7 mL of a methanol solution of sodium benzenethiosulfonate (1%) were added thereto. After stirring the mixture for a period of 80 minutes, the mixture was adjusted to the pH of 7.8 with 1 mol/L sulfuric acid. Thereby, dispersion A of silver salt of benzotriazole was prepared.

Particles of the prepared dispersion of silver salt of benzotriazole had a mean equivalent circular diameter of 0.172 μm, a variation coefficient of an equivalent circular diameter distribution of 18.5%, a mean length of long side of 0.32 μm, a mean length of short side of 0.09 μm, and a mean ratio of the length of short side to the length of long side of 0.298. Particle size and the like were determined from the average of 300 particles using an electron microscope.

8) Preparation of Phthalazine Compound Solution

Modified poly(vinyl alcohol) MP-203 manufactured by Kuraray Co., Ltd. in an amount of 8 kg was dissolved in 174.57 kg of water, and then, thereto were added 3.15 kg of a 20% by weight aqueous solution of sodium triisopropylnaphthalenesulfonate and 14.28 kg of a 70% by weight aqueous solution of 6-isopropyl phthalazine to provide a 5% by weight solution.

9) Preparation of Solution of Additive

<Preparation of Aqueous Solution of Mercapto Compound-1>

Mercapto compound-1 (1-(3-sulfophenyl)-5-mercaptotetrazole sodium salt) in an amount of 7 g was dissolved in 993 g of water to provide a 0.7% by weight aqueous solution.

<Preparation of Aqueous Solution of Mercapto Compound-2>

Mercapto compound-2 (1-(3-methylureidophenyl)-5-mercaptotetrazole) in an amount of 20 g was dissolved in 980 g of water to provide a 2.0% by weight aqueous solution.

<Preparation of Aqueous Solution of Phthalic Acid>

A 20% by weight aqueous solution of diammonium phthalate was prepared.

10) Preparation of Latex Binder

<<Preparation of SBR Latex Liquid (TP-1)>>

Into a polymerization vessel of a gas monomer reaction apparatus (manufactured by Taiatsu Techno Corporation, TAS-2J type) were poured 287 g of distilled water, 7.73 g of surfactant (PIONIN A-43-S (manufactured by TAKEMOTO OIL & FAT CO., LTD.): solid matter content of 48.5% by weight), 14.06 mL of 1 mol/L sodium hydroxide, 0.15 g of ethylenediamine tetraacetate tetrasodium salt, 255 g of styrene, 11.25 g of acrylic acid, and 3.0 g of tert-dodecyl mercaptan, followed by sealing of the reaction vessel and stirring at a stirring rate of 200 rpm. Degassing was conducted with a vacuum pump, followed by repeating nitrogen gas replacement several times. Thereto was injected 108.75 g of 1,3-butadiene, and the inner temperature of the vessel was elevated to 60° C. Thereto was added a solution obtained by dissolving 1.875 g of ammonium persulfate in 50 mL of water, and the mixture was stirred for 5 hours as it stands. Further, the mixture was heated to 90° C., followed by stirring for 3 hours. After completing the reaction, the inner temperature of the vessel was lowered to reach to the room temperature, and thereafter the mixture was treated by adding 1 mol/L sodium hydroxide and ammonium hydroxide to give the molar ratio of $Na^+$ ion:$NH_4^+$ ion=1: 5.3, and thus, the pH of the mixture was adjusted to 8.4. Thereafter, filtration with a polypropylene filter having a pore size of 1.0 μm was conducted to remove foreign substances such as dust, and stored. Thereby, SBR latex (TP-1) was obtained in an amount of 774.7 g.

The aforementioned latex had a mean particle diameter of 90 nm, Tg of 17° C., a solid content of 44% by weight, an equilibrium moisture content at 25° C. and 60% RH of 0.6% by weight, an ionic conductivity of 4.80 mS/cm (measurement of the ionic conductivity was performed using a conductometer CM-30S manufactured by Toa Electronics Ltd. for the latex stock solution (44% by weight) at 25° C.), and the pH of 8.4.

<<Preparation of Isoprene Latex Liquid (TP-2)>>

1500 g of distilled water was poured into a polymerization vessel of a gas monomer reaction apparatus (manufactured by Taiatsu Techno Corporation, TAS-2J type), and the vessel was heated for 3 hours at 90° C. to make passive film over the stainless-steel surface of the polymerization vessel and stainless-steel stirring device. Thereafter, 582.28 g of distilled water deaerated by nitrogen gas for one hour, 9.49 g of surfactant (PIONIN A-43-S, manufactured by Takemoto Oil & Fat Co., Ltd.), 19.56 g of 1 mol/L sodium hydroxide, 0.20 g of ethylenediamine tetraacetic acid tetrasodium salt, 314.99 g of styrene, 190.87 g of isoprene, 10.43 g of acrylic acid, and 2.09 g of tert-dodecyl mercaptan were added into the pretreated polymerization vessel. And then, the reaction vessel was sealed and the mixture was stirred at a stirring rate of 225 rpm, followed by elevating the inner temperature to 65° C. A solution obtained by dissolving 2.61 g of ammonium persulfate in 40 mL of water was added thereto, and the mixture was kept for 6 hours with stirring. At this point, the polymerization ratio was 90% according to the solid content measurement. Thereto, a solution obtained by dissolving 5.22 g of acrylic acid in 46.98 g of water was added, and then 10 g of water was added, and further a solution obtained by dissolving 1.30 g of ammonium persulfate in 50.7 mL of water was added. After the addition, the mixture was heated to 90° C. and stirred for 3 hours. After completing the reaction, the inner temperature of the vessel was lowered to reach to the room temperature, and thereafter the mixture was treated by adding 1 mol/L sodium hydroxide and ammonium hydroxide to give the molar ratio of $Na^+$ ion:$NH_4^+$ ion=1:5.3, and thus, the pH of the mixture was adjusted to 8.3. Thereafter, the resulting mixture was filtered with a polypropylene filter having a pore size of 1.0 μm to remove foreign substances such as dust, and stored. Thereby, 1248 g of isoprene latex (TP-2) was obtained.

The above-described latex had a mean particle diameter of 113 nm, Tg of 15° C., a solid content of 41.3% by weight, an equilibrium moisture content at 25° C. and 60RH % of 0.4% by weight, and an ionic conductivity of 5.23 mS/cm (measurement of the ionic conductivity was performed using a conductometer CM-30S manufactured by Toa Electronics Ltd. at 25° C.).

3-2. Preparation of Coating Solutions

1) Preparation of Coating Solution for Image Forming Layer

To the dispersion of silver salt of a fatty acid in an amount of 1000 g were serially added water, the organic polyhalogen compound-1 dispersion, the organic polyhalogen compound-2 dispersion, the SBR latex liquid (TP-1), the isoprene latex liquid (TP-2), the dispersion of reducing agent for silver ions (shown in Table 1), the hydrogen bonding compound-1 dispersion, the development accelerator dispersion (shown in Table 1), the phthalazine compound solution, the mercapto compound-1 aqueous solution, and the mercapto compound-2 aqueous solution. By adding, just prior to coating, the mixed emulsion A for a coating solution thereto and mixing sufficiently, a coating solution for the image forming layer was prepared and allowed to be transported to a coating die and coated.

Comparative reducing agent-1

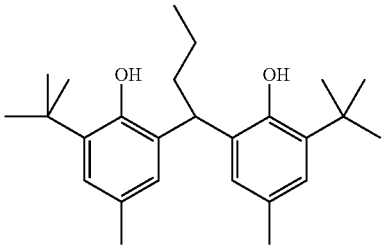

Comparative reducing agent-2

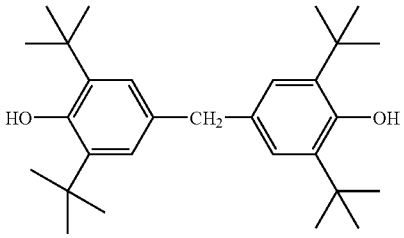

-continued

PP-1

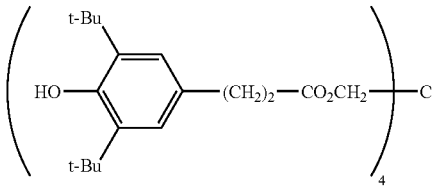

PP-4

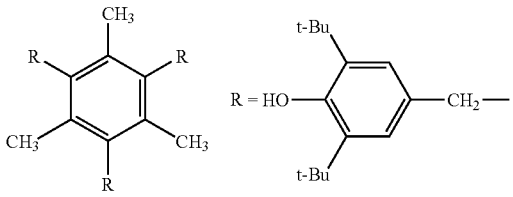

PP-6

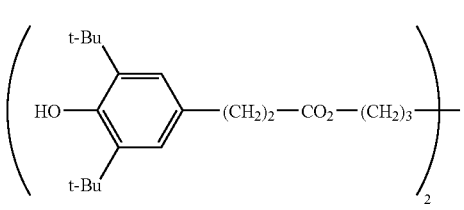

PP-8

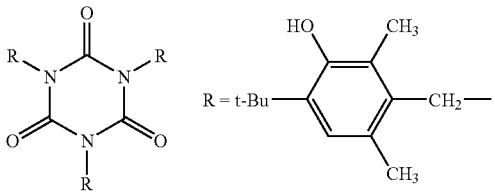

2) Preparation of Coating Solution for Intermediate Layer

To 625 g of poly(vinyl alcohol) PVA-205 (manufactured by Kuraray Co., Ltd.), 27 mL of a 5% by weight aqueous solution of di(2-ethylhexyl) sodium sulfosuccinate, 5614 mL of the 42% by weight liquid of isoprene latex (TP-2), 27 mL of a 5% by weight aqueous solution of aerosol OT (manufactured by American Cyanamid Co.), and 135 mL of a 20% by weight aqueous solution of diammonium phthalate was added water to give the total amount of 10000 g. The mixture was adjusted to the pH of 7.5 with sodium hydroxide. Thereby, a coating solution for the intermediate layer was prepared and fed to a coating die to provide 8.9 mL/$m^2$.

3) Preparation of Coating Solution for First Layer of Surface Protective Layers

In 704 mL of water were dissolved 100 g of inert gelatin and 10 mg of benzisothiazolinone, and thereto were added 146 g of the dispersion A of silver salt of benzotriazole, 180 g of a 19% by weight liquid of methyl methacrylate/styrene/butyl acrylate/hydroxyethyl methacrylate/acrylic acid copolymer (weight ratio of the copolymerization of 57/8/28/

5/2) latex, 46 mL of a 15% by weight methanol solution of phthalic acid, and 5.4 mL of a 5% by weight aqueous solution of di(2-ethylhexyl) sodium sulfosuccinate, and were mixed. By adding, just prior to coating, 40 mL of a 4% by weight chrome alum thereto and mixing with a static mixer, a coating solution for the first layer of the surface protective layers was prepared and fed to a coating die so that the amount of the coating solution became 35 mL/$m^2$.

Viscosity of the coating solution was 20 [mPa·s] which was measured with a B type viscometer at 40° C. (No. 1 rotor, 60 rpm).

4) Preparation of Coating Solution for Second Layer of Surface Protective Layers In water was dissolved 80 g of inert gelatin and thereto were added 102 g of a 27.5% by weight liquid of methyl methacrylate/styrene/butyl acrylate/hydroxyethyl methacrylate/acrylic acid copolymer (weight ratio of the copolymerization of 64/9/20/5/2) latex, 5.4 mL of a 2% by weight solution of fluorocarbon surfactant (F-1), 5.4 mL of a 2% by weight aqueous solution of fluorocarbon surfactant (F-2), 23 mL of a 5% by weight aqueous solution of aerosol OT (manufactured by American Cyanamid Co.), 4 g of poly(methyl methacrylate) fine particles (mean particle diameter of 0.7 μm, distribution of volume-weighted average of 30%), 21 g of poly(methyl methacrylate) fine particles (mean particle diameter of 3.6 μm, distribution of volume-weighted average of 60%), 1.6 g of 4-methyl phthalic acid, 4.8 g of phthalic acid, 44 mL of 0.5 mol/L sulfuric acid, and 10 mg of benzisothiazolinone. Water was added to give the total amount of 650 g. Just prior to coating, 445 mL of an aqueous solution containing 4% by weight chrome alum and 0.67% by weight phthalic acid was added and admixed with a static mixer to provide a coating solution for the second layer of the surface protective layers, which was fed to a coating die to provide 8.3 mL/$m^2$.

Viscosity of the coating solution was 19 [mPa·s] which was measured with a B type viscometer at 40° C. (No. 1 rotor, 60 rpm).

4. Preparation of Photothermographic Material

1) Preparation of Photothermographic Material 1 to 11

Reverse surface of the back surface was subjected to simultaneous multilayer coating by a slide bead coating method in order of the image forming layer, intermediate layer, first layer of the surface protective layers, and second layer of the surface protective layers, starting from the undercoated face, and thereby samples of photothermographic material were produced.

The coating amount of each compound (g/$m^2$) for the image forming layer is as follows.

| | |
|---|---|
| Silver salt of a fatty acid | 5.27 |
| Organic polyhalogen compound-1 | 0.14 |
| Organic polyhalogen compound-2 | 0.28 |
| Phthalazine compound | 0.18 |
| SBR latex (TP-1) | 3.20 |
| Isoprene latex (TP-2) | 7.46 |
| Reducing agent for silver ions | (See Table 1) |
| Hydrogen bonding compound-1 | 0.112 |
| Development accelerator | (See Table 1) |
| Mercapto compound-2 | 0.003 |
| Silver halide (on the basis of Ag content) | 0.13 |

TABLE 1

| | Reducing Agent for Silver Ions | | Development Accelerator | | |
|---|---|---|---|---|---|
| Sample No. | Compound No. | Addition Amount (mmol/$m^2$) | Compound No. | Addition Amount (mmol/$m^2$) | Note |
| 1 | Comparative reducing agent-1 | 2.0 | — | — | Comparative |
| 2 | Comparative reducing agent-2 | 2.0 | — | — | Comparative |
| 3 | Comparative reducing agent-1 | 2.0 | Development accelerator-1 | 0.06 | Comparative |
| 4 | Comparative reducing agent-2 | 2.0 | Development accelerator-1 | 0.12 | Comparative |
| 5 | PP-1 | 1.0 | — | — | Comparative |
| 6 | PP-1 | 1.0 | Development accelerator-1 | 0.12 | Invention |
| 7 | PP-1 | 1.0 | Development accelerator-2 | 0.12 | Invention |
| 8 | PP-1 | 1.0 | Development accelerator-3 | 0.12 | Invention |
| 9 | PP-4 | 1.3 | Development accelerator-1 | 0.12 | Invention |
| 10 | PP-6 | 2.0 | Development accelerator-1 | 0.12 | Invention |
| 11 | PP-8 | 1.3 | Development accelerator-1 | 0.12 | Invention |

Chemical structures of the compounds used in Examples of the invention are shown below.

Spectral sensitizing dye A

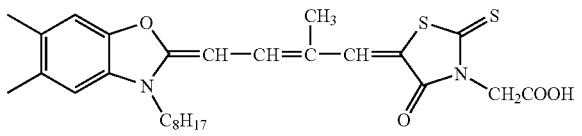

-continued

Spectral sensitizing dye B

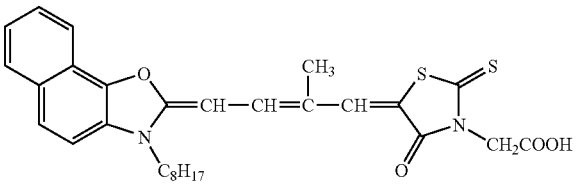

Tellurium sensitizer C

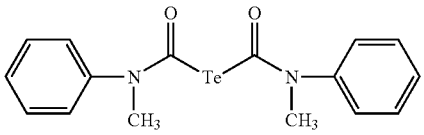

Compound 1 that is one-electron-oxidized to provide a one-electron oxidation product which releases one or more electrons

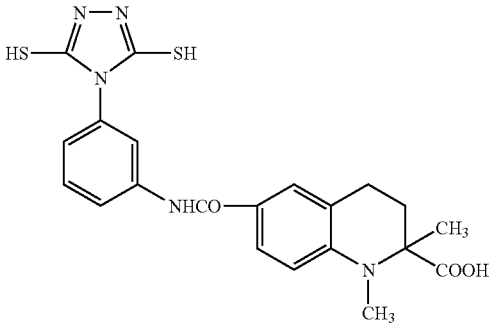

Compound 2 that is one-electron-oxidized to provide a one-electron oxidation product which releases one or more electrons

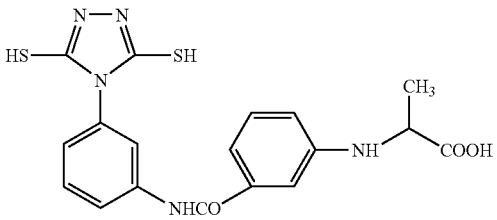

Compound 3 that is one-electron-oxidized to provide a one-electron oxidation product which releases one or more electrons

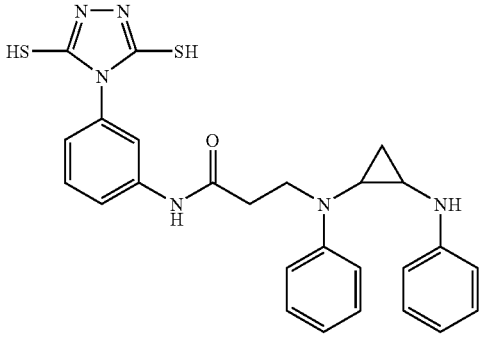

Compound 1 having adsorptive group and reducing group

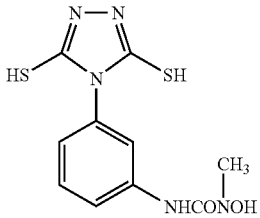

Compound 2 having adsorptive group and reducing group

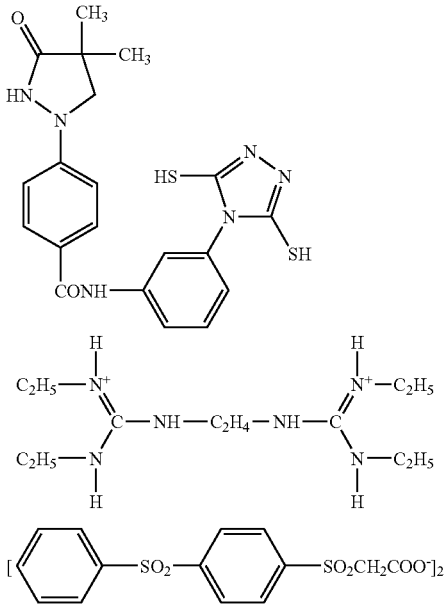

Base precursor-1

-continued

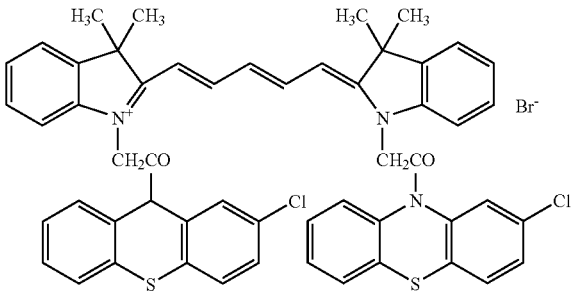

Cyanine dye-1

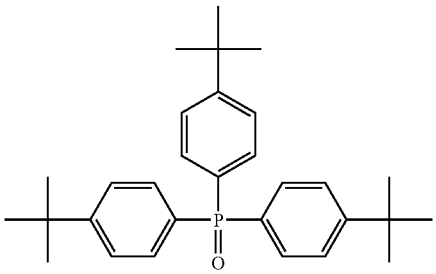

Hydrogen bonding compound-1

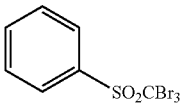

Organic polyhalogen compound-1

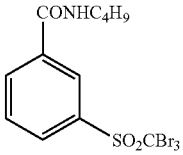

Organic polyhalogen compound-2

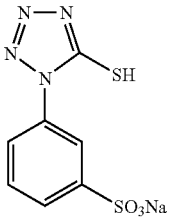

Mercapto compound-1

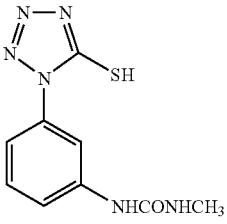

Mercapto compound-2

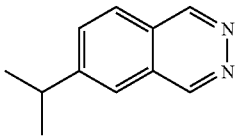

Phthalazine compound-1

-continued

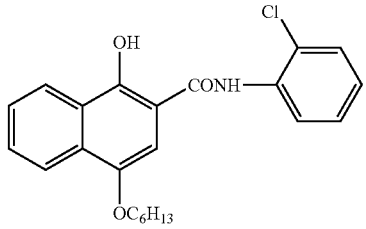

Development accelerator-1

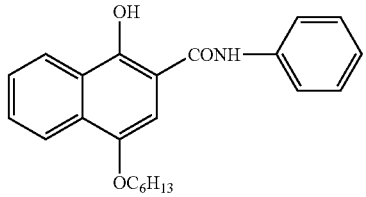

Development accelerator-2

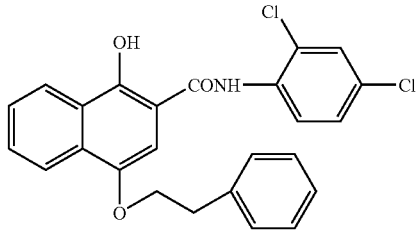

Development accelerator-3

(F-1)

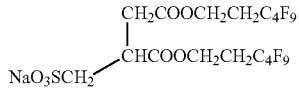

(F-2)

Mixture of

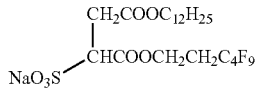

and

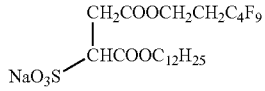

5. Evaluation of Performance

1) Preparation

The obtained sample was cut into a half-cut size, and was wrapped with the following packaging material under an environment of 25° C. and 50% RH, and stored for 2 weeks at an ambient temperature.

(Packaging Material)

A laminate film of 10 μm of PET/12 μm of PE/9 μm of aluminum foil/15 μm of Ny/50 μm of polyethylene containing carbon in an amount of 3% by weight:

oxygen permeability at 25° C.: 0.02 $mL \cdot atm^{-1}m^{-2}day^{-1}$;

vapor permeability at 25° C.: 0.10 $g \cdot atm^{-1}m^{-2}day^{-1}$.

2) Imagewise Exposure and Thermal Development

Using each sample, imagewise exposure and thermal development (14 seconds in total with 3 panel heaters respectively set to 1 07° C., 121° C., and 121° C.) with a Fuji Medical Dry Laser Imager DRYPIX 7000 (equipped with a 660 nm laser diode having a maximum output of 50 mW (IIIB)) were performed.

3) Evaluation of Photographic Performance

Visual density of the obtained image was measured using a TD904 type Macbeth densitometer.

<<Fog>>

Fog is expressed in terms of a density of an unexposed portion.

<<Sensitivity (S)>>

Sensitivity is the inverse of the exposure value giving a density of fog +1.0. The sensitivities of samples are shown as relative values, with the sensitivity of sample No. 3 designated as 100.

<<Maximum Density (Dmax)>>

Dmax is expressed in terms of a saturated maximum density with an increasing exposure value.

<<Image Tone>>

Image tones in the low density area of the image (the portion having a density of from 0.3 to 0.5), the middle density area (the portion having a density of from 1.0 to 1.5), and the high density area (Dmax portion) were sensory evaluated.

<Evaluation Criteria>

○: Blue-black tone and a preferable color tone.

Δ: Warm black tone to natural black tone and within the practically allowable range.

×: Bluish or brownish black tone and outside of the practically allowable range.

×: Brownish black tone to apparently warm black tone and outside of the practically allowable range.

<<Test of Image Storability in Dark and Hot Place>>

Thermally developed samples were left for 10 minutes on a transmission-type lighting viewer (an illumination condition of 7,000 lux under an environment of 25° C. and 60RH %) and then stored for 5 days in a dark place under an environment of 40° C. and 50% RH. Thereafter, changes in color tone were sensory evaluated before and after the above test with respect to the image having a density of 1.0.

◎: Changes in color tone are not observed;

○: Changes in color tone are slightly observed but practical level for image reading;

Δ: Apparent changes in color tone are seen and laborious levels for image reading;

×: Changes in color tone are great and difficult for image reading.

4) Results

The obtained results are shown in Table 2. The samples of the present invention provide images with high Dmax and excellent color tone. Moreover, the samples of the present invention exhibit excellent raw stock storage stability and excellent image storage stability.

In contrast, the comparative sample Nos. 1 and 4 exhibit low Dmax and unfavorable color tone.

Further, the comparative sample Nos. 2 and 3 exhibit high Dmax, but unfavorable color tone, and particularly, problematic color tone upon raw stock storage.

TABLE 2

| Sample | Photographic Properties | | | Image Tone | | | Raw Stock Storage Stability | | | | |
|---|---|---|---|---|---|---|---|---|---|---|---|
| | | | | Low Density | Middle Density | High Density | Low Density | Middle Density | High Density | Image Storage | |
| No. | Fog | S | Dmax | Area | Area | Area | Area | Area | Area | Stability | Note |
| 1 | 0.14 | 64 | 2.40 | X | X | X | X | X | X | X | Comparative |
| 2 | 0.14 | 42 | 4.00 | X | X | X | X | X | X | X | Comparative |
| 3 | 0.16 | 100 | 4.00 | ○ | Δ | Δ | Δ | Δ | X | Δ | Comparative |
| 4 | 0.16 | 85 | 2.20 | X | X | X | X | X | X | X | Comparative |
| 5 | 0.13 | — | 0.13 | — | — | — | — | — | — | — | Comparative |
| 6 | 0.16 | 102 | 4.00 | ○ | ○ | ○ | ○ | ○ | ○ | ◎ | Invention |
| 7 | 0.16 | 97 | 3.90 | ○ | ○ | ○ | ○ | ○ | ○ | ◎ | Invention |
| 8 | 0.16 | 106 | 4.10 | ○ | ○ | ○ | ○ | ○ | ○ | ◎ | Invention |
| 9 | 0.16 | 98 | 4.00 | ○ | ○ | ○ | ○ | ○ | ○ | ◎ | Invention |
| 10 | 0.16 | 99 | 4.00 | ○ | ○ | ○ | ○ | ○ | ○ | ◎ | Invention |
| 11 | 0.16 | 100 | 4.00 | ○ | ○ | ○ | ○ | ○ | ○ | ◎ | Invention |

<<Evaluation of Raw Stock Storability>>

The photothermographic material was taken out from the package mentioned above and stored for 7 days under an environment of 35° C. and 70% RH. Thereafter, the sample was subjected to imagewise exposure and thermal development. Image tones in the low density area of the image (the portion having an approximate optical density of 0.3 or less), the middle density area (the portion having an approximate optical density of from 0.5 to 1.0), and the high density area (Dmax portion) were sensory evaluated.

<Evaluation Criteria>

○: Blue-black tone and a preferable color tone.

Δ: Warm black tone to natural black tone and within the practically allowable range.

Example 2

1. Preparation of Dispersions

1) Preparation of Color Developing Agent Dispersion

Preparation of dispersions of each of the compound (1-5) and (1-6) of formula (1) was conducted in a similar manner to the process in the preparation of the reducing agent dispersion of Example 1. Particles of the color developing agent included in the dispersion obtained had a median diameter of from 0.20 μm to 0.50 μm, and a maximum particle diameter of 5.0 μm or less.

2) Preparation of Coupler Dispersion

Preparation of dispersions of each of the coupler (CC-3) and (CC-8) was conducted in a similar manner to the process in the preparation of the reducing agent dispersion of Example 1. Particles of the coupler included in the dispersion obtained had a median diameter of from 0.20 μm to 0.50 μm, and a maximum particle diameter of 5.0 μm or less.

1-5

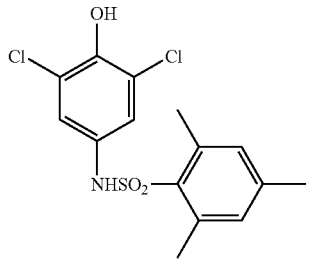

1-6

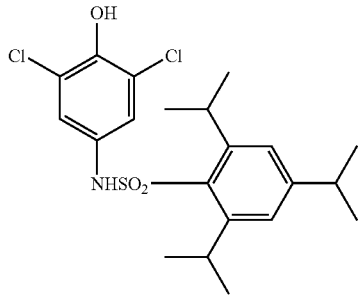

CC-3

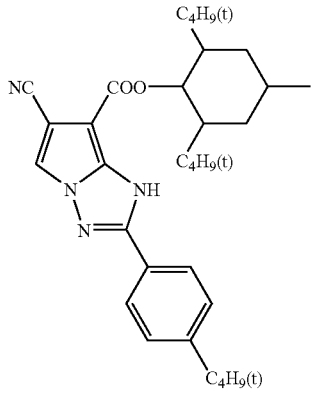

-continued

CC-8

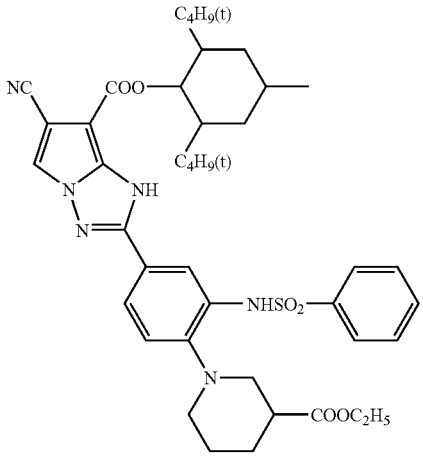

2. Preparation of Coating Solutions

1) Preparation of Coating Solution 1 to 8 for First Image Forming Layer

To the dispersion of silver salt of a fatty acid in an amount of 1000 g were serially added water, the organic polyhalogen compound-1 dispersion, the organic polyhalogen compound-2 dispersion, the SBR latex liquid (TP-1), the isoprene latex liquid (TP-2), the dispersion of reducing agent for silver ions (shown in Table 3), the hydrogen bonding compound-1 dispersion, the development accelerator dispersion (shown in Table 3), the phthalazine compound solution, the mercapto compound-1 aqueous solution, and the mercapto compound-2 aqueous solution. By adding, just prior to coating, the mixed emulsion A for a coating solution thereto and mixing sufficiently, a coating solution for the first image forming layer was prepared, and allowed to be transported to a coating die and coated.

2) Preparation of Coating Solution 1 to 3 for Second Image Forming Layer

To 625 g of poly(vinyl alcohol) PVA-205 (manufactured by Kuraray Co., Ltd.), 27 mL of a 5% by weight aqueous solution of di(2-ethylhexyl) sodium sulfosuccinate, 5614 mL of the 42% by weight liquid of isoprene latex (TP-2), the color developing agent dispersion (shown in Table 3), the coupler dispersion (shown in Table 3), 27 mL of a 5% by weight aqueous solution of aerosol OT (manufactured by American Cyanamid Co.), and 135 mL of a 20% by weight aqueous solution of diammonium phthalate was added water to give the total amount of 10000 g. The mixture was adjusted to the pH of 7.5 with sodium hydroxide. Thereby, a coating solution for the second image forming layer was prepared and fed to a coating die to provide 8.9 mL/$m^2$.

3. Preparation of Coated Samples

Preparation of photothermographic material 101 to 110 was conducted similar to Example 1, except that the image forming layer was changed to the first image forming layer and second image forming layer shown in Table 3.

TABLE 3

| | First Image Forming Layer | | | | | Second Image Forming Layer | | | |
|---|---|---|---|---|---|---|---|---|---|
| | | Reducing Agent for Silver Ions | | Development Accelerator | | | Color Developing | | |
| Sample No. | Coating Solution No. | Compound No. | Addition Amount (mmol/m$^2$) | Compound No. | Addition Amount (mmol/m$^2$) | Coating Solution No. | Agent No./Amount (mmol/m$^2$) | Coupler No./Amount (mmol/m$^2$) | Note |
| 101 | 1 | Comparative reducing agent-1 | 2.0 | Development accelerator-1 | 0.06 | 1 | 1-6/0.23 | CC-3/0.23 | Comparative |
| 102 | 2 | Comparative reducing agent-2 | 2.0 | Development accelerator-1 | 0.12 | 1 | 1-6/0.23 | CC-3/0.23 | Comparative |
| 103 | 3 | PP-1 | 1.0 | Development accelerator-1 | 0.12 | 1 | 1-6/0.23 | CC-3/0.23 | Invention |
| 104 | 3 | PP-1 | 1.0 | Development accelerator-1 | 0.12 | 2 | 1-5/0.23 | CC-3/0.23 | Invention |
| 105 | 3 | PP-1 | 1.0 | Development accelerator-1 | 0.12 | 3 | 1-6/0.23 | CC-8/0.23 | Invention |
| 106 | 4 | PP-4 | 1.3 | Development accelerator-1 | 0.12 | 1 | 1-6/0.23 | CC-3/0.23 | Invention |
| 107 | 5 | PP-8 | 1.3 | Development accelerator-1 | 0.12 | 1 | 1-6/0.23 | CC-3/0.23 | Invention |
| 108 | 6 | PP-6 | 2.0 | Development accelerator-1 | 0.12 | 1 | 1-6/0.23 | CC-3/0.23 | Invention |
| 109 | 7 | PP-1 | 1.0 | Development accelerator-2 | 0.12 | 1 | 1-6/0.23 | CC-3/0.23 | Invention |
| 110 | 8 | PP-1 | 1.0 | Development accelerator-3 | 0.12 | 1 | 1-6/0.23 | CC-3/0.23 | Invention |

4. Performance Evaluation

1) Terms of Evaluation

Evaluation of photographic performance was carried out similar to Example 1. In addition, the residual rate of coupler after thermal development, and color forming efficiency were measured by the following means.

1-1) Measurement of Residual Rate of Coupler

A definite area of a Dmax portion of the imagewise exposured and developed sample was soaked in a definite quantity of extracting solvent (mixed solution with a volume ratio of methanol/dimethyl formamide/water of 7/2/1) for 2 hours at 40° C. to extract organic materials. Thereafter, concentration of the coupler contained in the resulting solution was determined by high-performance liquid chromatography. Further, the amount of coupler extracted from the unexposed and undeveloped, raw sample was determined by a similar procedure. Thereby, the amount of the residual coupler ([Cp] mmol/m$^2$) in the Dmax portion of the sample and the amount of the coupler ([Cp] mmol/m$^2$) in the raw sample were determined respectively, and the residual rate of coupler is expressed in terms of [Cp] of Dmax portion/[Cp] of raw sample (%).

1-2) Measurement of Color Forming Efficiency

A definite area of a Dmax portion of the imagewise exposured and developed sample was soaked in a definite quantity of extracting solvent (mixed solution with a volume ratio of methanol/dimethyl formamide/water of 7/2/1) for 2 hours at 40° C. to extract organic materials. Thereafter, concentration of the color-forming dye contained in the resulting solution was determined by high-performance liquid chromatography. Further, the amount of coupler extracted from the unexposed and undeveloped, raw sample was determined by a similar procedure. Thereby, the amount of the formed dye ([dye] mmol/m$^2$) in the Dmax portion of the sample and the amount of the coupler ([Cp] mmol/m$^2$) in the raw sample were determined respectively, and the color forming efficiency is expressed in terms of [dye] of Dmax portion/[Cp] of raw sample (%).

2) Results of Evaluation

The obtained results are shown in Table 4.

Results of Residual Rate of Coupler, and Color Forming Efficiency

In the case where the combination of the compounds according to the present invention is used, a sample which exhibits high residual rate of coupler and high color forming efficiency is obtained. The use of conventionally known comparative reducing agent-1 results in low residual rate of coupler and low color forming efficiency.

Results of Photographic Performance

The samples of the present invention provide excellent results such as high maximum density, excellent color tone, excellent raw stock storage stability, and excellent image storage stability.

In contrast, the comparative sample Nos. 101 and 102 provide unfavorable results in color tone and image storage stability.

The molecular weight of the comparative reducing agent-2 is small and the sample No. 102 exhibits unfavorable color tone, but the sample of the present invention in which the reducing agent for silver ions according to the present invention having a great molecular weight is used exhibits favorable color tone.

TABLE 4

| Sample No. | Residual Rate of Coupler (%) | Color Forming Efficiency (%) | Photographic Properties Fog | S | Dmax | Image Tone Low Density Area | Middle Density Area | High Density Area | Raw Stock Storage Stability Low Density Area | Middle Density Area | High Density Area | Image Storage Stability | Note |
|---|---|---|---|---|---|---|---|---|---|---|---|---|---|
| 101 | 0 | 18 | 0.16 | 100 | 4.0 | Δ | Δ | Δ | X | X | X | Δ | Comparative |
| 102 | 29 | 58 | 0.16 | 110 | 4.1 | X | X | X | X | X | X | X | Comparative |
| 103 | 30 | 61 | 0.16 | 108 | 4.1 | ○ | ○ | ○ | ○ | ○ | ○ | ○ | Invention |
| 104 | 29 | 60 | 0.16 | 107 | 4.1 | ○ | ○ | ○ | ○ | ○ | ○ | ○ | Invention |
| 105 | 31 | 59 | 0.16 | 108 | 4.1 | ○ | ○ | ○ | ○ | ○ | ○ | ○ | Invention |
| 106 | 30 | 61 | 0.16 | 109 | 4.1 | ○ | ○ | ○ | ○ | ○ | ○ | ○ | Invention |
| 107 | 25 | 60 | 0.16 | 110 | 4.1 | ○ | ○ | ○ | ○ | ○ | ○ | ○ | Invention |
| 108 | 30 | 59 | 0.16 | 109 | 4.1 | ○ | ○ | ○ | ○ | ○ | ○ | ○ | Invention |
| 109 | 31 | 60 | 0.16 | 108 | 4.1 | ○ | ○ | ○ | ○ | ○ | ○ | ○ | Invention |
| 110 | 32 | 58 | 0.16 | 110 | 4.1 | ○ | ○ | ○ | ○ | ○ | ○ | ○ | Invention |

What is claimed is:

1. A black and white photothermographic material comprising, on at least one side of a support, at least a photosensitive silver halide, a non-photosensitive organic silver salt, and a reducing agent for silver ions, wherein the reducing agent for silver ions is a compound represented by the following formula (PP) and having a molecular weight of from 450 to 3000, and the black and white photothermographic material further comprises a compound represented by the following formula (II):

Formula (PP)

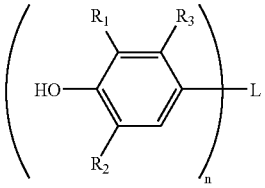

wherein $R_1$ and $R_2$ each independently represent a hydrogen atom or an alkyl group having 1 to 20 carbon atoms; at least one of $R_1$ and $R_2$ is an alkyl group having 1 to 20 carbon atoms; L represents a linking group having a valency of from 2 to 8 and represents an alkylene group, an arylene group, an aralkylene group, a heterocyclic linking group, or a combination thereof; $R_3$ represents a hydrogen atom or a substituent; and n represents an integer of from 2 to 8;

Formula (II)

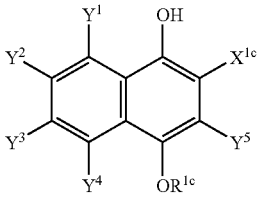

wherein $R^{1c}$ represents an alkyl group, an aryl group, an alkenyl group, or an alkynyl group; $X^{1c}$ represents an alkoxycarbonyl group, a carbamoyl group, a sulfonyl group, or a sulfamoyl group; and $Y^1$ to $Y^5$ each independently represent a hydrogen atom or a substituent.

2. The black and white photothermographic material according to claim 1, wherein, in the compound represented by formula (PP), $R_1$ and $R_2$ are each independently an alkyl group having 1 to 20 carbon atoms.

3. The black and white photothermographic material according to claim 1, wherein, in the compound represented by formula (PP), at least one of $R_1$ and $R_2$ is a secondary or tertiary alkyl group having 3 to 20 carbon atoms.

4. The black and white photothermographic material according to claim 1, wherein, in the compound represented by formula (PP), L is a substituted alkylene group.

5. The black and white photothermographic material according to claim 1, wherein, in the compound represented by formula (II), $R^{1c}$ is an alkyl group or an aryl group.

6. The black and white photothermographic material according to claim 5, wherein, in the compound represented by formula (II), $R^{1c}$ is an alkyl group.

7. The black and white photothermographic material according to claim 1, wherein, in the compound represented by formula (II), $X^{1c}$ is a carbamoyl group.

8. The black and white photothermographic material according to claim 7, wherein, in the compound represented by formula (II), $X^{1c}$ is an arylcarbamoyl group or an alkylcarbamoyl group.

9. The black and white photothermographic material according to claim 8, wherein, in the compound represented by formula (II), $X^{1c}$ is an arylcarbamoyl group.

10. The black and white photothermographic material according to claim 1, wherein, in the compound represented by formula (II), $Y^1$ to $Y^5$ are each a hydrogen atom.

11. The black and white photothermographic material according to claim 1, wherein, in the compound represented by formula (II), $R^{1c}$ is an alkyl group, $X^{1c}$ is a carbamoyl group, and $Y^1$ to $Y^5$ are each a hydrogen atom.

12. The black and white photothermographic material according to claim 1, wherein the black and white photothermographic material further comprises a color developing agent and a coupler.

13. The black and white photothermographic material according to claim 12, wherein the color developing agent is a compound represented by the following formula (1):

Formula (1)

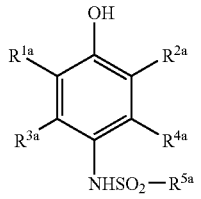

wherein $R^{1a}$ and $R^{2a}$ each independently represent a hydrogen atom, a halogen atom, an alkyl group, an alkoxy group, an acyl group, an arylcarbonyl group, an alkylcarbonyl group, an aryloxycarbonyl group, an alkoxycarbonyl group, an arylcarbamoyl group, an alkylcarbamoyl group, a carbamoyl group, an arylsulfonyl group, an alkylsulfonyl group, an arylsulfamoyl group, an alkylsulfamoyl group, or a sulfamoyl group; $R^{3a}$ and $R^{4a}$ each independently represent a hydrogen atom or a substituent which substitutes for a hydrogen atom on a benzene ring; and $R^{5a}$ represents an alkyl group, an aryl group, or a heterocyclic group.

14. The black and white photothermographic material according to claim 12, wherein the black and white photothermographic comprises, on one side of the support, a first image forming layer comprising at least the photosensitive silver halide, the non-photosensitive organic silver salt, and the reducing agent for silver ions, and a second image forming layer comprising at least the coupler, and at least one of the first image forming layer or the second image forming layer comprises the color developing agent.

15. The black and white photothermographic material according to claim 14, wherein the second image forming layer comprises the color developing agent.

16. The black and white photothermographic material according to claim 12, wherein the coupler is at least one compound represented by a formula selected from the group consisting of the following formulae (C-1), (C-2), (C-3), (M-1), (M-2), (M-3), (Y-1), (Y-2), and (Y-3):

Formula (C-1)

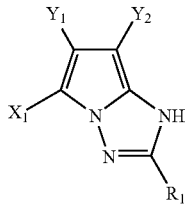

wherein $X_1$ represents a hydrogen atom or a leaving group; $Y_1$ and $Y_2$ each independently represent an electron-attracting substituent; and $R_1$ represents an alkyl group, an aryl group, or a heterocyclic group;

Formula (C-2)

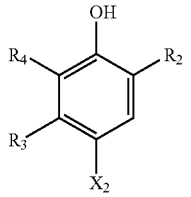

wherein $X_2$ represents a hydrogen atom or a leaving group; $R_2$ represents an acylamino group, a ureido group, or a urethane group; $R_3$ represents a hydrogen atom, an alkyl group, or an acylamino group; $R_4$ represents a hydrogen atom or a substituent; and $R_3$ and $R_4$ may link together to form a ring;

Formula (C-3)

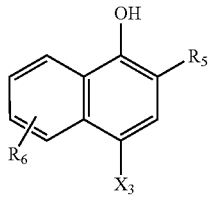

wherein $X_3$ represents a hydrogen atom or a leaving group; $R_5$ represents a carbamoyl group or a sulfamoyl group; and $R_6$ represents a hydrogen atom or a substituent;

Formula (M-1)

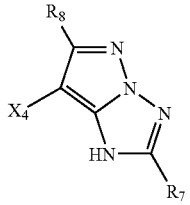

wherein $X_4$ represents a hydrogen atom or a leaving group; $R_7$ represents an alkyl group, an aryl group, or a heterocyclic group; and $R_8$ represents a substituent;

Formula (M-2)

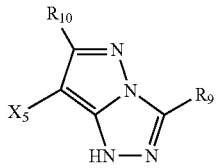

wherein $X_5$ represents a hydrogen atom or a leaving group; $R_9$ represents an alkyl group, an aryl group, or a heterocyclic group; and $R_{10}$ represents a substituent;

Formula (M-3)

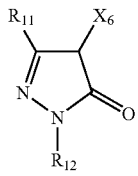

wherein $X_6$ represents a hydrogen atom or a leaving group; $R_{11}$ represents an alkyl group, an aryl group, an acylamino group, or an anilino group; and $R_{12}$ represents an alkyl group, an aryl group, or a heterocyclic group;

Formula (Y-1)

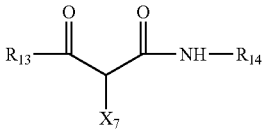

wherein $X_7$ represents a hydrogen atom or a leaving group; $R_{13}$ represents an alkyl group, an aryl group, or an indolenyl group; and $R_{14}$ represents an aryl group or a heterocyclic group;

Formula (Y-2)

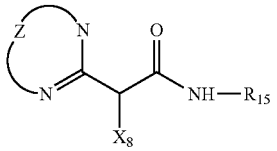

wherein $X_8$ represents a hydrogen atom or a leaving group; Z represents a divalent group necessary for forming a 5- to 7-membered ring; and $R_{15}$ represents an aryl group or a heterocyclic group;

Formula (Y-3)

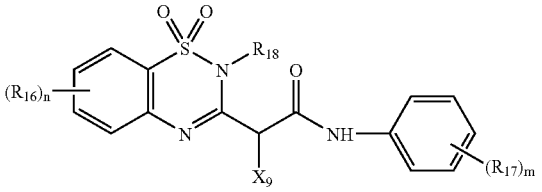

wherein $X_9$ represents a hydrogen atom or a leaving group; $R_{16}$, $R_{17}$, and $R_{18}$ each independently represent a substituent; n represents an integer of from 0 to 4; m represents an integer of from 0 to 5; when n represents 2 or more, a plurality of $R_{16}$ may be the same or different from one another; and when m represents 2 or more, a plurality of $R_{17}$ may be the same or different from one another.

17. The black and white photothermographic material according to claim 16, wherein, in formulae (C-1), (C-2), (C-3), (M-1), (M-2), (M-3), (Y-1), (Y-2), and (Y-3), $X_1$, $X_2$, $X_3$, $X_4$, $X_5$, $X_6$, $X_7$, $X_8$, and $X_9$ are each a hydrogen atom.

18. The black and white photothermographic material according to claim 12, wherein the coupler is a compound represented by the following formula (C-1):

Formula (C-1)

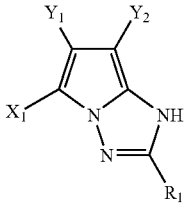

wherein $X_1$ represents a hydrogen atom or a leaving group; $Y_1$ and $Y_2$ each independently represent an electron-attracting substituent; and $R_1$ represents an alkyl group, an aryl group, or a heterocyclic group.

19. The black and white photothermographic material according to claim 18, wherein, in formula (C-1), $X_1$ is a hydrogen atom.

20. The black and white photothermographic material according to claim 14, wherein 50% by weight or more of a binder for each of the first image forming layer and the second image forming layer is a polymer latex.

21. The black and white photothermographic material according to claim 20, wherein the polymer latex is a polymer latex comprising a monomer component represented by the following formula (M) within a range of from 10% by weight to 70% by weight:

$$CH_2{=}CR^{01}{-}CR^{02}{=}CH_2 \qquad \text{Formula (M)}$$

wherein $R^{01}$ and $R^{02}$ each independently represent a hydrogen atom, an alkyl group having 1 to 6 carbon atoms, a halogen atom, or a cyano group.

22. The black and white photothermographic material according to claim 21, wherein, in formula (M), both of $R^{01}$ and $R^{02}$ are a hydrogen atom, or one of $R^{01}$ or $R^{02}$ is a hydrogen atom and the other is a methyl group.

* * * * *